US008109301B1

(12) United States Patent
Denise

(10) Patent No.: US 8,109,301 B1
(45) Date of Patent: Feb. 7, 2012

(54) ILLUMINATED REFRIGERATOR DISPENSER SYSTEM WITH SENSORS

(76) Inventor: Jason Adam Denise, Bowie, MD (US)

( * ) Notice: Subject to any disclaimer, the term of this patent is extended or adjusted under 35 U.S.C. 154(b) by 409 days.

(21) Appl. No.: 12/349,500

(22) Filed: Jan. 6, 2009

(51) Int. Cl.
*F25D 23/00* (2006.01)
*B65B 1/04* (2006.01)

(52) U.S. Cl. ..... 141/360; 141/94; 141/95; 141/351; 141/198; 62/264; 362/92; 222/113

(58) Field of Classification Search ..... 141/94, 141/95, 369, 192, 198, 351, 360; 222/113; 340/552–557, 565, 551; 62/264
See application file for complete search history.

(56) References Cited

U.S. PATENT DOCUMENTS

| | | | | |
|---|---|---|---|---|
| 4,901,922 | A * | 2/1990 | Kessener et al. | 239/12 |
| 5,454,406 | A * | 10/1995 | Rejret et al. | 141/1 |
| 5,491,617 | A * | 2/1996 | Currie | 362/96 |
| 5,901,879 | A | 5/1999 | Duhaime | |
| 5,986,236 | A | 11/1999 | Gainand | |
| 6,651,449 | B2 | 11/2003 | Heims | |
| 6,681,585 | B1 | 1/2004 | Stagg | |
| 6,868,983 | B2 | 3/2005 | Chirnomas | |
| 7,418,983 | B2 * | 9/2008 | Mizuno et al. | 141/94 |
| 7,673,661 | B2 * | 3/2010 | Chase et al. | 141/360 |
| 7,832,224 | B2 * | 11/2010 | Roo et al. | 62/264 |
| 2008/0163641 | A1 * | 7/2008 | Mitchell | 62/389 |
| 2008/0190514 | A1 * | 8/2008 | Lee et al. | 141/95 |
| 2008/0216504 | A1 * | 9/2008 | Kim et al. | 62/338 |
| 2008/0264092 | A1 | 10/2008 | Chase | |
| 2009/0183796 | A1 * | 7/2009 | Chase et al. | 141/1 |

FOREIGN PATENT DOCUMENTS

JP 04295988 A * 10/1992

* cited by examiner

*Primary Examiner* — Timothy L Maust
*Assistant Examiner* — Timothy Kelly

(57) ABSTRACT

A refrigerator having a dispenser that includes an outlet and that is configured to dispense content through the outlet and along an output flow path. The refrigerator also includes a detection unit configured to detect user activity that is indicative of a desire to fill a container with content using the dispenser. The refrigerator further includes an optical system that is configured to, in response to detecting the user activity, direct a beam of light along at least a portion of the output flow path of the dispenser to assist a user in positioning a container to receive content dispensed along the output flow path.

20 Claims, 34 Drawing Sheets

ILLUMINATED REFRIGERATOR DISPENSER SYSTEM WITH SENSORS

FIELD

This document relates to refrigerator and dispenser technology.

BACKGROUND

Refrigerators may be cooling appliances that include a thermally insulated compartment and a cooling mechanism that cools the contents of the compartment to a temperature below ambient. In addition to a refrigerating compartment, a refrigerator may include a freezing compartment that cools the contents of the freezing compartment to a temperature below freezing. The freezing compartment may include an ice maker that freezes liquid water into ice cubes. A refrigerator may include a dispenser that dispenses liquid water and/or ice.

SUMMARY

In one aspect, an appliance includes a dispenser that includes an outlet and that is configured to dispense content through the outlet and along an output flow path. The appliance also includes a detection unit configured to detect user activity that is indicative of a desire to fill a container with content using the dispenser and an optical system that is configured to, in response to detecting the user activity, direct a beam of light along at least a portion of the output flow path of the dispenser to assist a user in positioning a container to receive content dispensed along the output flow path.

Implementations may include one or more of the following features. For example, the optical system may be configured to, in response to detecting the user activity, direct a beam of light along a path that is parallel to the output flow path and that is spaced apart from the output flow path.

In some implementations, the optical system may be configured to, in response to detecting the user activity, direct a beam of light directly along the output flow path. In these implementations, the dispenser may include a chute that is configured to guide content to the outlet, and the optical system may include a laser component that is positioned above the chute and that is configured to generate a beam of light that passes through a transparent portion of the chute, through an opening defined by the outlet, and directly along the output flow path. Further, in these implementations, the dispenser may include a chute that is configured to guide content to the outlet, and the optical system may include a laser component that is positioned within the chute and that is configured to generate a beam of light that passes through an opening defined by the outlet and directly along the output flow path. The laser component may be suspended within the chute by a spoke arrangement that defines at least one content flow area that enables content to pass around the laser component within the chute.

In some examples, the optical system may be configured to direct a beam of light that is angled with respect to the output flow path and that intersects the output flow path. In these examples, the optical system may be configured to direct a beam of light that intersects the output flow path at a midpoint between the outlet and a tray that is configured to support a container being filled by the dispenser. In addition, in these examples, the optical system may be configured to direct a beam of light that intersects the output flow path at an offset point between the outlet and a tray that is configured to support a container being filled by the dispenser. The offset point may be closer to the outlet than the tray. Further, in these implementations, the optical system may be configured to direct a beam of light that intersects the output flow path at a point at which the output flow path intersects a tray that is configured to support a container being filled by the dispenser.

The detection unit may be configured to detect a user input command that is related to dispensing content. The appliance may include a user input device that is configured to receive a first user input command to set a particular quantity of content to dispense from the dispenser. The detection unit may be configured to detect the first user input command to set the particular quantity of content to dispense from the dispenser. The appliance also may include a controller configured to monitor for a second user input command to cause the dispenser to dispense the particular quantity of content. The controller may be configured to, in response to detecting the second user input command, control the dispenser to dispense the particular quantity of content and control the optical system to turn off the beam of light. The controller further may be configured to, in response to detecting at least a threshold amount of time has passed after receipt of the first user input command without receipt of the second user input command, control the optical system to turn off the beam of light.

The appliance may include a user input device that is configured to receive a user input command to dispense content from the dispenser. The detection unit may be configured to detect the user input command to dispense content from the dispenser. The appliance may include a controller configured to delay dispensing of content from the dispenser in response to the user input command, control the optical system to direct the beam of light along at least a portion of the output flow path while delaying the dispensing of content, and, after delaying the dispensing of content for a threshold period of time, control the dispenser to dispense content responsive to the user input command to dispense content from the dispenser.

In some examples, the detection unit includes at least one sensor and is configured to detect an object in an area proximate to the dispenser using the at least one sensor. In these examples, the optical system may be configured to direct the beam of light along at least a portion of the output flow path of the dispenser in response to the detection unit detecting the object in the area proximate to the dispenser using the at least one sensor. The detection unit may be configured to detect a container entering an area that is under the outlet of the dispenser.

In some implementations, the detection unit may be configured to detect a container in an area proximate to the dispenser and, in response to detecting the container in the area proximate to the dispenser, determine volume characteristics of the container based on sensor data. The volume characteristics may reflect an ability to fill the container with content from the dispenser. The appliance may include a controller configured to control the dispenser based on the determined volume characteristics of the container. In these implementations, the controller may be configured to identify a volume of content that the container is capable of receiving based on the determined volume characteristics and prevent the dispenser from dispensing, into the container, more than the identified volume of content that the container is capable of receiving. Further, in these implementations, the controller may be configured to identify a volume of content that the container is capable of receiving based on the determined volume characteristics and set a recommended quantity of content to dispense based on the identified volume of content and enable a user to dispense the recommended quantity of content or adjust the recommended quantity of content.

The detection unit may be configured to detect presence of a container being filled by the dispenser. The appliance may include a controller that is configured to detect an end of a dispensing operation, that is configured to monitor movement of the container subsequent to the end of the dispensing operation, that is configured to discontinue monitoring in response to detecting the container being removed from a dispensing area, and that is configured to provide an alert indicating that a filled container remains in the dispensing area in response to determining that a threshold period of time has passed after detecting the end of the dispensing operation.

The detection unit may be configured to detect a container in an area proximate to the dispenser and, in response to detecting the container in the area proximate to the dispenser, determine volume characteristics of the container based on sensor data. The volume characteristics may reflect an ability to fill the container with content from the dispenser. The appliance may include an ice detection unit configured to determine an amount of ice positioned in the container and adjust the determined volume characteristics to account for the determined amount of ice positioned in the container and a controller configured to control the dispenser based on the adjusted volume characteristics of the container.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Figure 1:
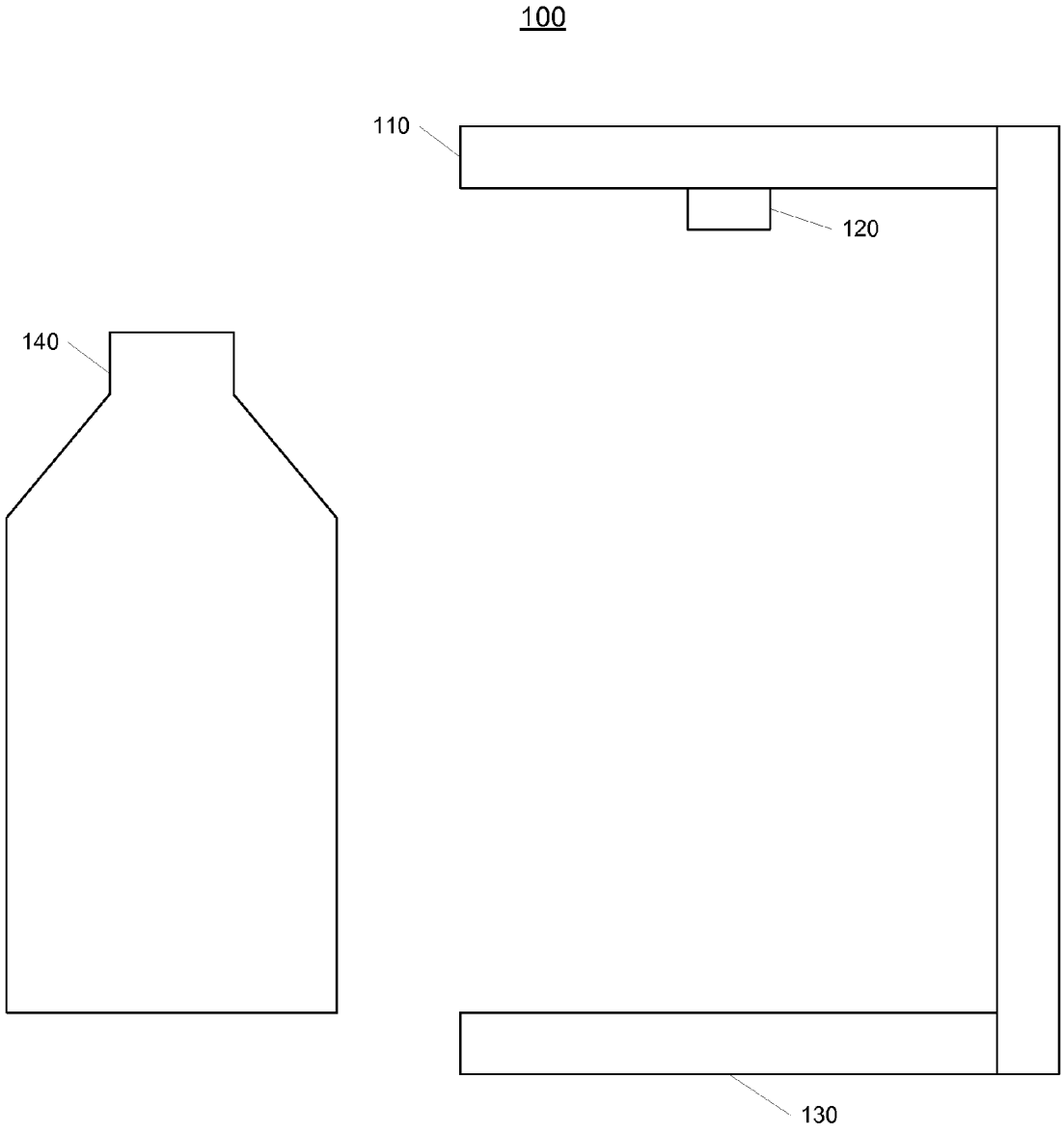
FIGS. 1-4 illustrate example diagrams of filling a container.

Referring to FIG. 1, a diagram 100 illustrates a dispenser that includes an outlet housing 110, an outlet 120, and a support 130. The outlet housing 110 provides a supporting structure for the outlet 120 and secures the outlet 120 at a position that enables a user to conveniently place a container proximate to (e.g., under) the outlet 120 for dispensing content through the outlet 120 and into the container. The outlet housing 110 also may secure a chute or tube that delivers content from a content source to the outlet 120 and further may define an upper portion of a dispensing space or cavity that is configured to receive or accommodate a container being filled by the dispenser. The dispensing space or cavity may be defined in a wall or door of an appliance or may be defined as a space exterior to a wall or door of an appliance. The outlet housing 110 may be fixed at a wall or door of an appliance such that the outlet housing 110 defines at least a portion of a space within the wall or door of the appliance, the outlet housing 110 may be movable from an interior of a wall or door of an appliance to an exterior of the wall or door of the appliance, or the outlet housing 110 may be positioned and attached to an appliance to remain at an exterior of a wall or door of the appliance.

In some implementations, the dispenser is included in a refrigerator. In these implementations, the dispenser may be attached to a freezing compartment door of the refrigerator or a refrigerating compartment of the refrigerator. In this regard, the dispenser may be provided in any type of refrigerator, whether the refrigerator be a side-by-side refrigerator in which a freezing compartment and refrigerating compartment are positioned next to one another, a top mount refrigerator in which the freezing compartment is positioned above the refrigerating compartment, or a bottom mount refrigerator in which the freezing compartment is positioned below the refrigerating compartment. Each compartment of the refrigerator may include one or multiple doors and the dispenser may be provided in any of the doors. The dispenser also may be provided in a refrigerator that does not include a freezing compartment or in a freezer that does not include a refrigerating compartment.

The outlet 120 defines an output flow path of content being dispensed from the dispenser. For instance, the dispenser includes a tube or chute that guides content to the outlet 120 and the outlet 120 guides the content to an exterior of the dispenser to be received by a container. The outlet 120 may be configured to dispense liquid water (e.g., water received through a water supply line and into a liquid water tank in a refrigerating compartment), ice (e.g., water frozen by an ice maker provided in either a freezing compartment or a refrigerating compartment of the refrigerator), or any other content that an appliance or dispenser may dispense (e.g., a different type of liquid beverage). The outlet 120 may be fixed in a stationary location (e.g., in a dispensing cavity defined in a door of the appliance or at an exterior of the appliance). The outlet 120 also may be movable to multiple different positions. For example, the outlet 120 (and, perhaps, the outlet housing 110) may move from a first position behind an outer surface of a wall or door of an appliance (e.g., where the outlet 120 is stored) to a second position in front of the outer surface of the wall or door of the appliance (e.g., where the outlet 120 may dispense content in the second position).

The support 130 is a tray or container support that supports a container being filled with content using the dispenser. The support 130 may be positioned under the outlet 120 and support a container being filled with content being dispensed through the outlet 120. The support also may include an indented or recessed portion that collects water dispensed through the outlet 120, but that is not received in a container. In some implementations, the support 130 may move from a first position behind an outer surface of a wall or door of an appliance (e.g., where the support 130 is stored) to a second position in front of the outer surface of the wall or door of the appliance (e.g., where the support 130 may support a container that is being filled by content being dispensed through the outlet 120 when the outlet 120 is positioned in front of the outer surface of the wall or door of the appliance).

The diagram 100 also illustrates a container 140. The container 140 may be any type of receptacle (e.g., a cup, a glass, etc.) that is able to receive content dispensed from the dispenser. As shown, the container 140 may be a water bottle that has a relatively narrow opening into which content may be received in the container 140. The opening of the container 140 may only be slightly larger than an opening defined by the outlet 120. Accordingly, a user may find it difficult to move the container 140 to a position under the outlet 120 at which all of the content dispensed through the outlet 120 is received in the container 140. In other words, a user may have difficulty filling the container 140 with content from the dispenser without spilling some content.

Figure 2:
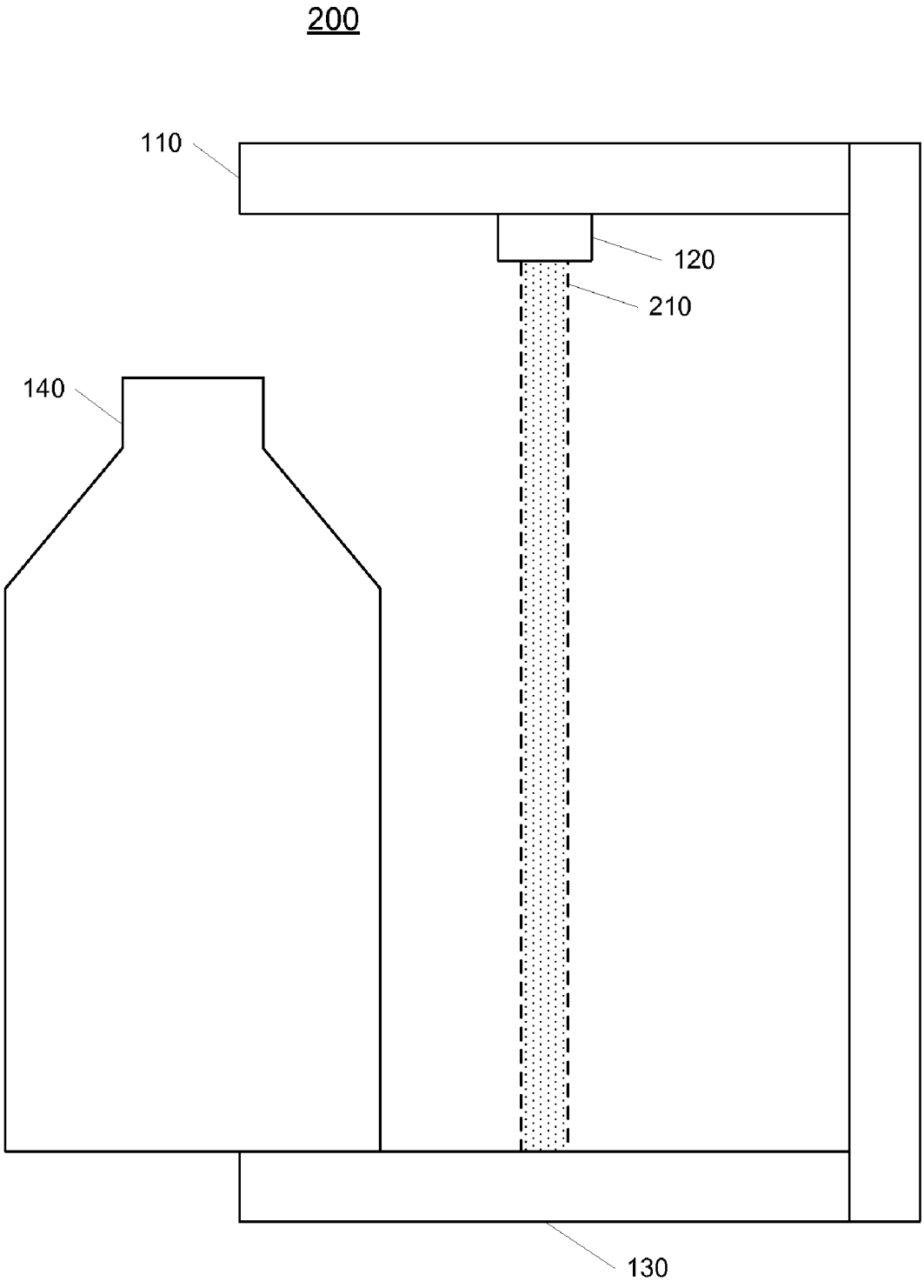

Referring to FIG. 2, a diagram 200 illustrates the dispenser shown in FIG. 1, but with the container 140 moved to a position that is closer to the outlet 120. For instance, the container 140 may have been moved by a user toward the outlet 120 to an area proximate to the outlet 120.

As shown in the diagram 200, the dispenser has directed a beam of light 210 along an output flow path of the outlet 120 in response to the container 140 being moved to the position that is closer to the outlet 120. For example, the dispenser may direct the beam of light 210 along the output flow path of the outlet 120 in response to sensor data that detects objects (e.g., containers) entering an area proximate to the outlet 120. In this example, the dispenser may direct the beam of light 210 in response to a sensor detecting the container 140 entering a dispensing area or cavity defined by the outlet housing 110 and the support 130. The dispenser also may direct the beam of light 210 in response to a sensor detecting the container 140 being placed on or otherwise contacting any portion of the support 130.

In some implementations, the dispenser may direct the beam of light 210 in response to a sensor detecting the container 140 in a position in which at least a portion of the container 140 is positioned directly under the outlet 120 or the dispenser may direct the beam of light 210 in response to a sensor detecting the container 140 being in a position that is within a threshold distance of the outlet 120 (e.g., within a two inches of the outlet 120 in a horizontal direction or within a four inch radius extending from the outlet 120). The beam of light 210 may be directed along the output flow path of the outlet 120 to assist a user in moving the container 140 to a position in which content dispensed through the outlet 120 is received within the container 140.

Figure 3:
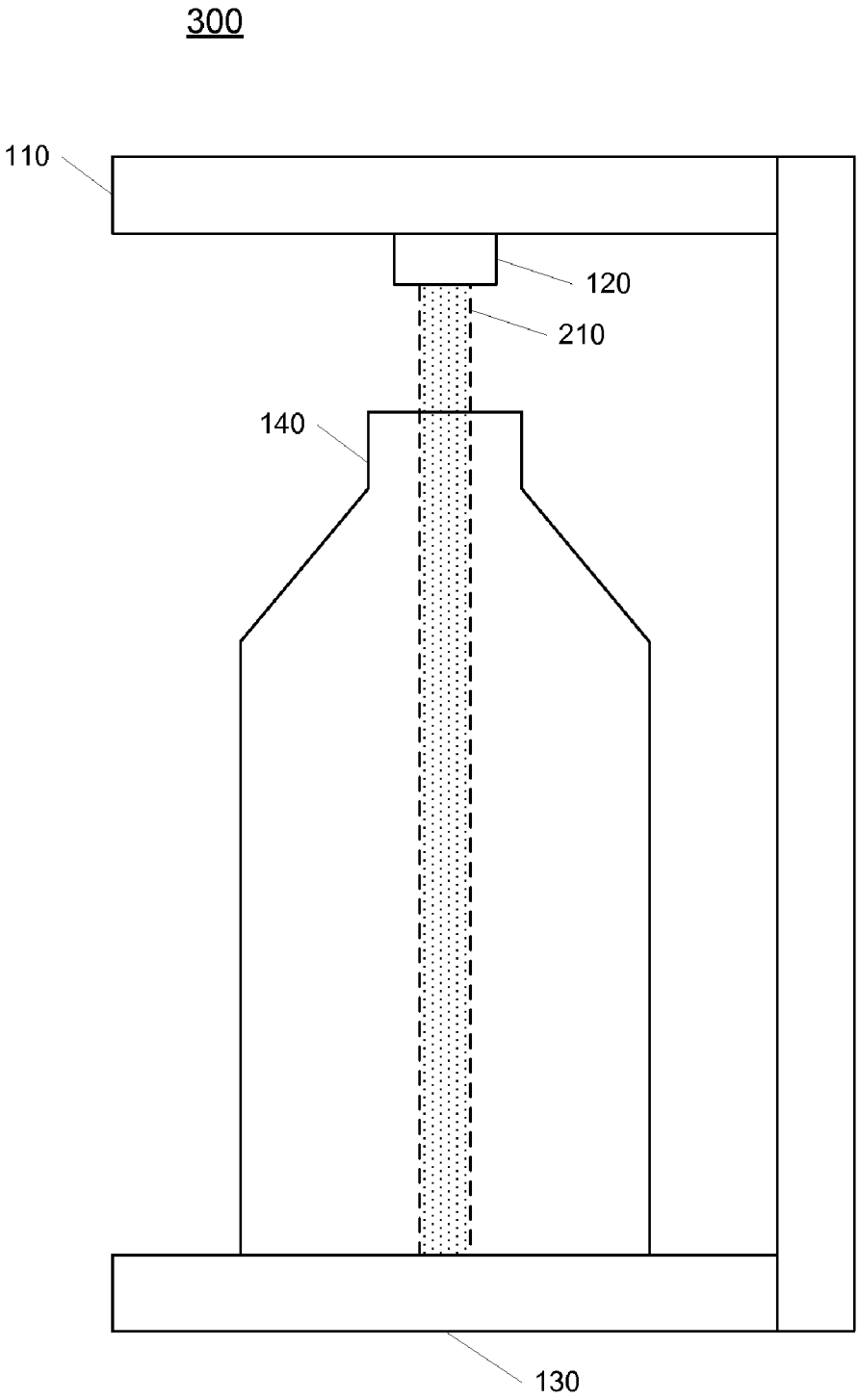

Referring to FIG. 3, a diagram 300 illustrates the container 140 being moved to a receiving position based on the beam of light 210. For example, the user positions the container 140 such that the beam of light 210 intersects an opening of the container 140. In this example, because the beam of light 210 is directed along the output flow path of the outlet 120, content dispensed through the outlet 120 generally follows along the beam of light 210 and, therefore, is likely to enter the opening of the container 140 without spillage when the container 140 is positioned at the receiving position.

Figure 4:
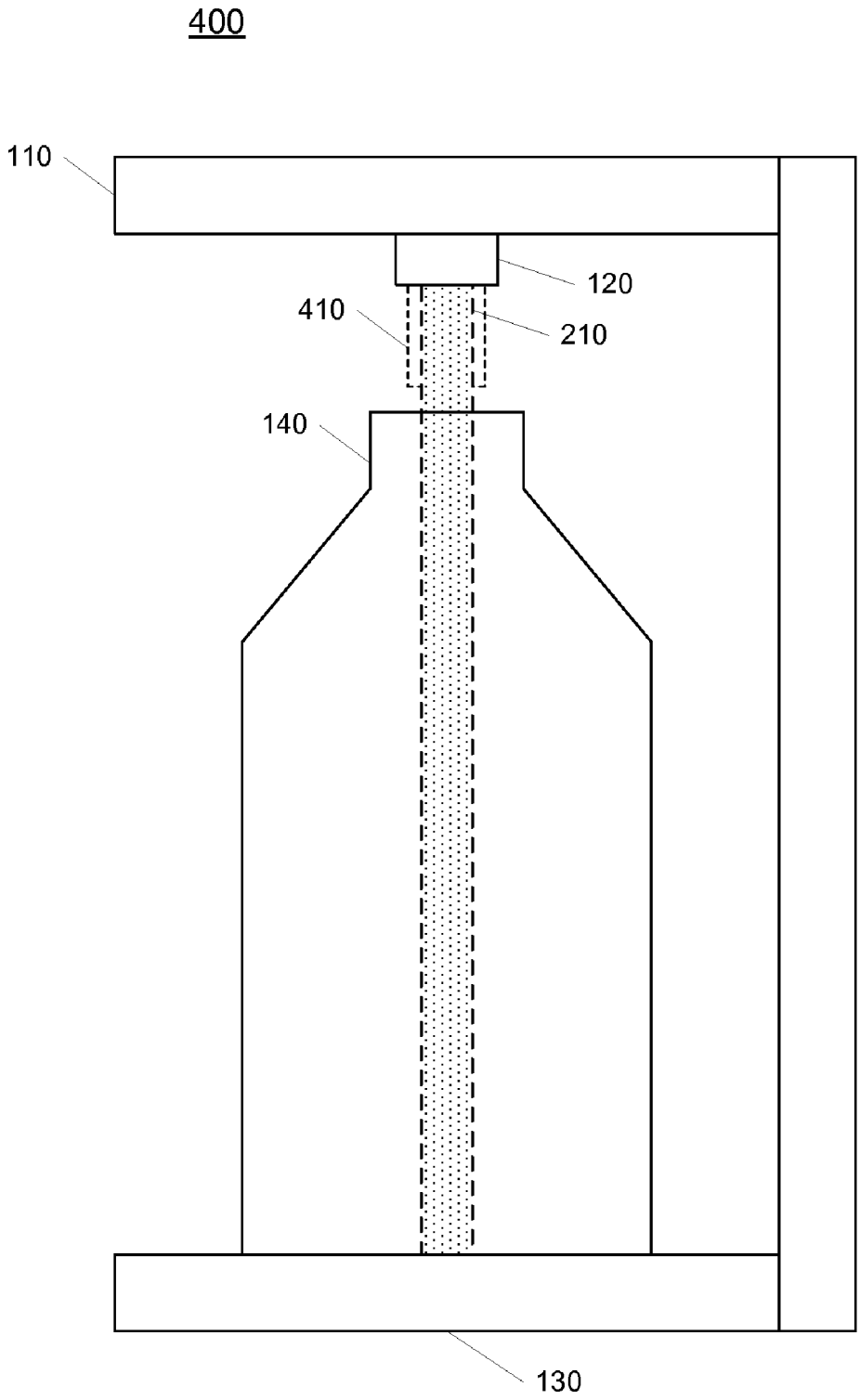

Referring to FIG. 4, a diagram 400 illustrates the dispenser dispensing content through the outlet 120 when the container 140 has been positioned at the receiving position based on the beam of light 210. The dispenser may dispense content through the outlet 120 based on user input provided after the container 140 has been moved to the receiving position using the beam of light 210.

As shown, content flow 410 (e.g., water being dispensed through the outlet 120) follows along the beam of light 210 and is directed to the opening of the container 140 because the opening of the container 140 was positioned to intersect the beam of light 210. Accordingly, the beam of light 210 may assist a user in moving the container 140 to a position at which the container 140 receives content dispensed through the outlet 120 without spillage. In this regard, directing the beam of light 210 in response to detecting the container 140 moving closer to the outlet 120 (e.g., to an area proximate to the outlet 120 or the dispenser) may enable the user to more accurately position the container 140 for filling and may reduce the likelihood that the user will spill content when attempting to fill the container 140 using the dispenser. This may be particularly beneficial when the user is attempting to fill a container, such as the container 140, that has a relatively narrow opening.

Although the beam of light 210 is shown as having a width that is narrower than a width of the content flow 410, the beam of light 210 may have a width that is equal to the width of the content flow 410. The beam of light 210 also may have a width that is slightly larger than the width of the content flow 410.

Figure 5:
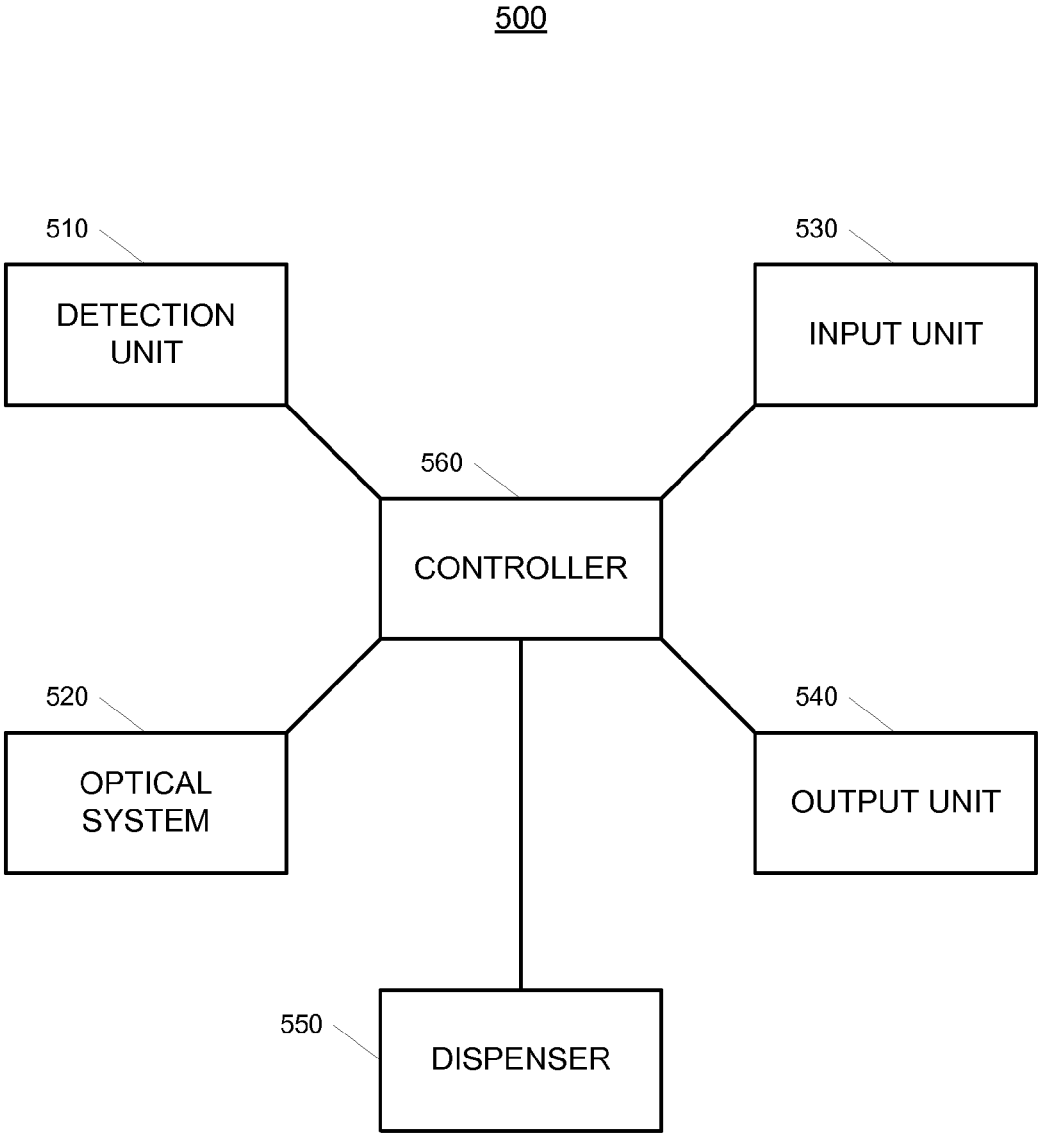
FIG. 5 is a block diagram of an example system.

FIG. 5 is a block diagram of an example system 500. The system 500 includes a detection unit 510, an optical system 520, an input unit 530, an output unit 540, a dispenser 550, and a controller 560. The detection unit 510 may be configured to detect various user actions related to operations of the system 500. For instance, the detection unit 510 may be configured to detect user input provided to the system 500 and also may be configured to detect movement or presence of a user or an object being manipulated by the user. The detection unit 510 may include one or more sensors that sense physical events that may be interpreted to detect presence of an object, measurements of an object, a shape of an object, movement of an object, and any other attributes of an object.

The one or more sensors included in the detection unit 510 may include a proximity sensor that is able to detect the presence of nearby objects without any physical contact. The proximity sensor may emit an electromagnetic or electrostatic field, or a beam of electromagnetic radiation (infrared, for instance), and detect changes in the field or return signal. An object being sensed (e.g., a container) may be referred to as the proximity sensor's target. The proximity sensor may include one or more of a capacitive or photoelectric sensor suitable for a plastic target and an inductive proximity sensor suitable for a metal target.

The detection unit 510 may include a position sensor. A position sensor may be any device that enables position measurement. The position sensor may be an infrared or ultrasonic sensor that emits an output signal and measures characteristics of a return signal to detect a position of an object. The detection unit 510 also may include a motion sensor that is configured to detect motion of an object near the motion sensor and/or an acoustic or sound sensor that is configured to detect sound near the acoustic or sound sensor. The detection 510 may detect presence of an object (e.g., a user) near the detection unit 510 in response to the motion sensor and/or acoustic or sound sensor being triggered.

The detection unit 510 further may include an optical interception detection device. The optical interception detection device may include an emitting source (e.g., an infrared emitter) that is configured to emit a signal and a receiving unit (e.g., an infrared receiver) that is configured to receive the signal emitted by the emitting source. When the signal emitted by the emitting source is blocked by an object the receiving unit detects presence of the object blocking the signal based on its failure to receive the signal.

The detection unit 510 may include pressure sensors that detect pressure of an object against the pressure sensors. The pressure sensors may be positioned at a container support and may be configured to detect presence of a container on the container support based on the pressure to the sensors caused by the container resting on the container support.

The detection unit 510 may include a scale/weight sensor. The scale/weight sensor may be positioned at a container support and may be configured to detect presence of a container on the container support based on the weight of the container on the container support. The scale may estimate characteristics of a container and/or content received in the based on the weight of the container measured by the scale.

For instance, the scale may be calibrated or zeroed out when a container is placed on the scale and the scale may be configured to measure a weight of material added to the container (e.g., dispensed content or other content placed in the container by a user). Operation of the system 500 may be controlled based on the measured weight and the weight of content placed within the container may be displayed to a user.

The detection unit 510 may include an image sensor that is configured to capture images of an area proximate to the dispenser. The captured images may be analyzed by the detection unit 510 or controller 560 to detect user actions related to the dispenser 550. For example, the detection unit 510 or controller 560 may analyze captured images to detect whether an object (e.g., a container) is present in an area proximate to the dispenser 550. The detection unit 510 or controller 560 also may analyze captured images to determine characteristics (e.g., volume characteristics) of an object (e.g., a container) positioned within view of the image sensor. The image sensor may be any device configured to capture images. For example, the image sensor may be a still digital camera or a video camera configured to capture multiple, successive images over time.

The optical system 520 may include optical components that are configured to direct a beam of light along at least a portion of an output flow path of a dispenser. The directed beam of light may be a ray or other narrow beam of light. In this regard, the optical system 520 may be designed by computationally propagating rays through the optical system 520 using the techniques of ray tracing.

The optical system 520 may include a light source. The light source may be a laser, which is a device that emits light (e.g., electromagnetic radiation) through stimulated emission. The light output by the laser may be spatially coherent; that is, the light may be emitted in a narrow, low-divergence beam, or may be converted into one using optical components such as lenses. The laser may emit light with a narrow wavelength spectrum. The laser may emit visible light that a person is capable of perceiving. For instance, the laser may be a small, visible-light laser aligned to emit a beam parallel to or along at least a portion of an output flow path of the dispenser 550. In some implementations, the laser may produce a red beam or a green beam. The laser may have low enough power that the projected beam presents a minimal hazard to eyes for incidental exposure. The laser may display a vertical illuminated line along at least a portion of an output flow path of the dispenser 550. The laser also may display a spot on a portion of a container support positioned directly under an outlet of a dispenser.

The laser component may be a laser diode. The laser diode may be a laser where the active medium is a semiconductor similar to that found in a light-emitting diode. The laser diode may be formed from a p-n junction and powered by injected electric current.

The optical system 520 also may include other optical components used in directing a beam of light. For instance, the optical system 520 may include a lens, which is an optical device that transmits and refracts light, converging or diverging the beam. The optical system 520 may include a simple lens consisting of a single optical element or a compound lens consisting of an array of simple lenses with a common axis. The lenses in the optical system 520 may be made of glass or transparent plastic.

The optical system 520 further may include a mirror, which is an object with a surface that reflects light. The mirror may be a flat mirror or a curved mirror. Lenses and/or mirrors may be used in the optical system 520 to direct a beam of light along at least a portion of an output flow path of a dispenser using light generated from a source that is positioned such that the light generated by the source does not follow along the output flow path of a dispenser. The optical system 520 may include other optical instruments or components used in forming and directing beams of light within the optical system 520.

The input unit 530 may include any type of user input device with which a user may provide input to the system 500. For example, the input unit 530 may be a mouse, a keyboard/keypad, a stylus, a touch screen, a track ball, a toggle control, one or more user input buttons, a microphone, or any other device that allows a user to input data into the system 500 or otherwise communicate with the system 500.

The output unit 540 may include a device configured to output information to a user. For instance, the output unit 540 may include a display device configured to display graphical user interfaces or other status indications related to operation of the system 500. The display device may be an LCD display, an LED display, a monitor or television screen, etc. The output unit 540 also may include a speaker configured to provide audible output related to operation of the system 500 (e.g., audible electronic content or alerts).

The dispenser 550 may be configured to dispense various types of content. For instance, the dispenser 550 may be configured to dispense water provided from a water supply source and also may be configured to dispense ice that is made by an ice maker. The dispenser 550 may receive content from a chute and transfer the received content to an exterior of the dispenser 550 through an outlet. The dispenser 550 may be mounted to a door or wall of an appliance (e.g., a refrigerator) and may be configured to dispense content through the door or wall to which the dispenser 550 is mounted. The appliance may be structured such that the dispenser 550 is mounted to and recessed in a door or wall of the appliance or the appliance may be structured such that the dispenser 550 is mounted to an exterior surface of the appliance. The dispenser 550 also may have movable components (e.g., a movable water outlet and/or a movable container support) that extend and retract from the door or wall of the appliance.

The controller 560 may be configured to receive input from and control operation of the detection unit 510, the optical system 520, the input unit 530, the output unit 540, and the dispenser 550. For instance, the controller 560 may receive user input from the input unit 530 and control the optical system 520, the output unit 540, and/or the dispenser 550 based on the received user input. The controller 560 also may receive input from the detection unit 510 and control operation of the optical system 520, the output unit 540, and/or the dispenser 550 based on the received input.

The controller 560 may be electrically connected, over a wired or wireless pathway, to the detection unit 510, the optical system 520, the input unit 530, the output unit 540, and the dispenser 550 and may control operation of the system 500. In some examples, the computing device 560 may include a processor or other control circuitry configured to execute an application. For instance, the controller 560 may be a processor suitable for the execution of a computer program such as a general or special purpose microprocessor, and any one or more processors of any kind of digital computer. Generally, a processor receives instructions and data from a read-only memory or a random access memory or both. The processor 540 receives instructions and data from the components of the system 500 to, for example, control operation of the optical system 520 and the dispenser 550. In some implementations, the controller 560 includes more than one processor. The controller 560 also may include other types of electronic control circuitry that is configured to communicate with and control operations of other components of the system 500.

Figure 6:
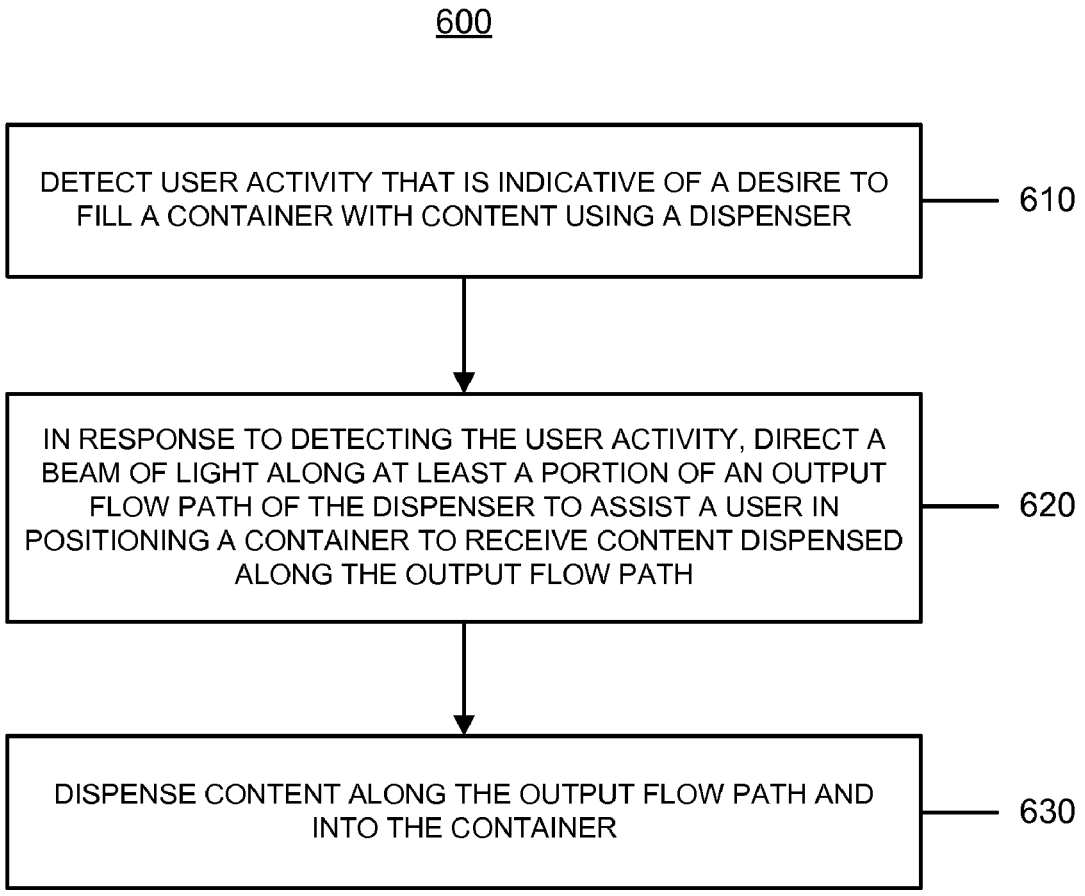
FIGS. 6, 15, 18, 21, 28, 31, and 33 are flowcharts of example processes.

FIG. 6 illustrates an example of a process 600 for directing a beam of light along at least a portion of an output flow path of a dispenser to assist a user in positioning a container to receive content dispensed along the output flow path. The operations of the process 600 are described generally as being performed by the system 500. The operations of the process 600 may be performed by any combination of the components of the system 500. In some implementations, operations of the process 600 may be performed by one or more processors included in one or more electronic devices.

The system 500 detects user activity that is indicative of a desire to fill a container with content using a dispenser (610). For example, the system 500 may detect any type of activity that a user typically performs prior to or shortly before the user fills a container with content using the dispenser. Because the user activity is typically performed shortly before filling of a container, the system 500 may detect that the activity is indicative of a desire to fill a container with content using the dispenser.

In some implementations, the system 500 may detect an object within an area proximate to the dispenser as the user activity that indicates a desire to fill a container with content using the dispenser. The system 500 may detect the object within an area proximate to the dispenser using any type of sensor that is configured to detect presence of an object. For example, the system 500 may detect the object using the detection unit 510 and any one or more of the sensors described above with respect to the detection unit 510. Because the object is within an area proximate to the dispenser, the system 500 may infer that presence of the object suggests that the dispenser will be used shortly and, therefore, indicates a desire of a user to operate the dispenser.

The system 500 may detect a container within an area proximate to the dispenser as the user activity. For example, the system 500 may detect a container being positioned under an outlet of the dispenser, detect a container being positioned within a dispensing area or cavity of the dispenser, and/or may detect a container being positioned within a threshold distance of the dispenser (e.g., within a foot or a few inches).

The system 500 also may detect a portion of a user's body within an area proximate to the dispenser as the user activity. For instance, the system 500 may detect a user's hand being positioned under an outlet of the dispenser, detect a user's hand being positioned within a dispensing area or cavity of the dispenser, and/or may detect a user's hand being positioned within a threshold distance of the dispenser (e.g., within a foot or a few inches).

In some examples, the system 500 may detect presence of a user's body in an area proximate to the dispenser. In these examples, the system 500 may detect a user standing in front of the dispenser within a threshold distance (e.g., within one foot) and infer that the user intends to use the dispenser. In implementations in which the system 500 includes an image based sensor, the system 500 may determine whether the user is facing toward the dispenser (e.g., the user's face is detected in an image looking toward the dispenser) or facing away from the dispenser (e.g., the user's face is detected in an image looking away from the dispenser or the user's face is not detected within an image). When the system 500 determines that the user is facing toward the dispenser, the system 500 may detect user activity that indicates a desire to fill a container with content because the user is in a typical position of a person filling a container. When the system 500 determines that the user is facing away from the dispenser, the system 500 may not detect user activity that indicates a desire to fill a container with content because the user is not in a typical position of a person filling a container.

The system 500 may detect motion of an object within an area proximate to the dispenser and use the detected motion in determining whether the user activity is indicative of a desire to fill a container with content using the dispenser. For example, the system 500 may detect whether an object is moving toward the dispenser or away from the dispenser. In this example, the system 500 may determine that the user activity is indicative of a desire to fill a container with content using the dispenser when the detected motion is toward the dispenser and determine that the user activity is not indicative of a desire to fill a container with content using the dispenser when the detected motion is away the dispenser.

In implementations in which the system 500 detects motion of an object, the system 500 may detect the motion using multiple sensors. For instance, the system 500 may include a first sensor (e.g., a sensor configured to detect presence of an object positioned at an entrance of a dispensing cavity defined by the dispenser) and a second sensor that is closer to an outlet of the dispenser than the first sensor (e.g., a sensor configured to detect presence of an object positioned within the dispensing cavity and under the outlet). The system 500 may detect motion of an object based on timing of when the first and second sensors are triggered. When an object triggers the first sensor, the system 500 may detect that the object is moving toward the dispenser (e.g., into the dispensing cavity) when the second sensor has not been triggered for a relatively long period of time prior to the first sensor being triggered. Alternatively, the system 500 may detect that the object is moving away from the dispenser (e.g., out of the dispensing cavity) when the second sensor was triggered a relatively short period of time prior to the first sensor being triggered.

In implementations in which the system 500 detects motion of an object, the system 500 may detect the motion using a single sensor. For instance, the single sensor may be a distance sensor that is positioned at the dispenser outlet (or within a dispensing cavity) and that is capable of detecting distance of an object from the sensor. Based on a comparison of multiple distance measurements taken successively in time, the system 500 may determine whether the distance of the object from the dispenser is increasing or decreasing. The single sensor also may be an image based sensor (e.g., a camera). Based on a comparison of multiple images taken successively in time, the system 500 may determine whether the object is moving toward or away from the dispenser.

A single object presence sensor also may be used in combination with other input to detect motion of an object. For example, a single object presence sensor may be positioned at an entrance of a dispensing cavity defined by the dispenser. In this example, the system 500 may use activity of the dispenser to determine whether an object that triggers the object presence sensor is moving into the dispensing cavity or out of the dispensing cavity. When an object triggers the object presence sensor, the system 500 may detect that the object is moving toward the dispenser (e.g., into the dispensing cavity) when the dispenser has not been used to dispense content for a relatively long period of time prior to the object presence sensor being triggered. Alternatively, the system 500 may detect that the object is moving away from the dispenser (e.g., out of the dispensing cavity) when the dispenser was used to dispense content a relatively short period of time prior to the object presence sensor being triggered.

In some implementations, the system 500 may detect user input related to the dispenser as the user activity that indicates a desire to fill a container with content using a dispenser. For instance, the system 500 may detect a user input command to dispense content (e.g., pressing of a button on a user input device that is configured to cause the dispenser to dispense content, pressing of a container against a dispensing lever that is configured to cause the dispenser to dispense content, etc.) as the user activity that indicates a desire to fill a container with content using a dispenser. The system 500 also may detect a user input command to set a particular quantity of content to dispense as the user activity that indicates a desire to fill a container with content using a dispenser. The system 500 further may detect a user input command to select a type of content to dispense (e.g., selection of ice or water) as the user activity that indicates a desire to fill a container with content using a dispenser.

In some examples, the system 500 may detect operations of components of the dispenser as the user activity that indicates a desire to fill a container with content using the dispenser. The system 500 may detect an outlet or outlet housing of the dispenser being extended (e.g., from a stored position to a dispensing position) as the user activity that indicates a desire to fill a container with content using a dispenser. The system 500 also may detect a container support or tray of the dispenser being extended (e.g., from a stored position to a supporting position) as the user activity that indicates a desire to fill a container with content using a dispenser. In implementations in which the dispenser is configured to dispense multiple types of content (e.g., ice and water), the system 500 may detect a dispensing operation of a first type of content (e.g., ice) as user activity that indicates a desire to dispense the second type of content (e.g., water) because user's typically dispense the second type of content (e.g., water) immediately or soon after dispensing the first type of content (e.g., ice).

In response to detecting the user activity, the system 500 directs a beam of light along at least a portion of an output flow path of the dispenser to assist a user in positioning a container to receive content dispensed along the output flow path (620). For instance, the system 500 may generate a beam of light using an optical source component (e.g., a laser component) and guide the beam of light along at least a portion of an output flow path of the dispenser. The system 500 may guide the beam of light along at least a portion of an output flow path of the dispenser using a mirror component, a lens component, or by generating the beam of light in a direction that causes the beam of light to pass along at least a portion of an output flow path of the dispenser. The optical system 520 and any one or more of the components described above with respect to the optical system 520 may be used to direct the beam of light along at least a portion of the output flow path of the dispenser. The output flow path may be a path along which content dispensed through an outlet of the dispenser travels. By directing a beam of light along the output flow path, the system 500 may assist a user in positioning a container to receive content dispensed along the output flow path because the beam of light may be used as a reference point or guide for positioning the container.

In directing a beam of light along at least a portion of an output flow path, the system 500 may direct a beam of light that passes directly along the output flow path (e.g., along the entire output flow path). The system 500 also may direct a beam light that intersects the output flow path and, therefore, passes along only a portion of the output flow path. When the system 500 directs a beam of light that intersects the output flow path, the point of intersection may be chosen such that the point relates to a position of a container properly positioned to receive content from the dispenser.

For instance, the point of intersection may be set to correspond to an average distance, from an outlet of the dispenser, of an opening of a container that is being filled with content. In this regard, in implementations in which containers typically extend above a midway point between a container support and the outlet of the dispenser, the point of intersection may be a point of the output flow path that is closer to the outlet than the container support. The point of intersection also may be a particular distance (e.g., two inches), from the outlet, that users typically hold (e.g., when a container support is not provided or is not being used) an opening of a container when dispensing content into the container.

The point of intersection further may correspond to a bottom of a container and illuminate an area of a container support or tray at which the bottom of the container should be placed for dispensing. For instance, the beam of light may intersect the output flow path at the point where the output flow path intersects the container support or tray.

When the system 500 directs a beam of light that intersects the output flow path, the point of intersection also may be chosen such that the point minimizes a divergence of the beam of light from the output flow path. For example, the beam of light may intersect the output flow path at a midway point between the outlet and the container support or tray.

To enhance the assistance provided to a user in positioning a container, the beam of light may have a relatively narrow width. For instance, the beam of light may have a width that is narrower than a width of content flow being dispensed along the output flow path. The beam of light also may have a width that is equal to a width of content flow being dispensed along the output flow path. The beam of light further may have a width that is greater than (e.g., slightly greater than) a width of content flow being dispensed along the output flow path.

In some implementations, the system 500 delays dispensing of content from the dispenser until the beam of light has been directed along at least a portion of the output flow path for a threshold period of time while delaying the dispensing of content. For example, when the detected user activity that triggers the system 500 to direct the beam of light is a user input command to dispense content, the system 500 may delay dispensing of content and measure a time from when the user input command to dispense content was received. While delaying the dispensing of content, the system 500 may direct the beam of light along at least a portion of the output flow path and compare the measured time from when the user input command to dispense content was received to a threshold time (e.g., three seconds). Based on the comparison, the system 500 may determine when the measured time from when the user input command to dispense content was received reaches the threshold time and control the dispenser to dispense content in response to a determination that the measured time from when the user input command to dispense content was received has reached the threshold time.

In another example, when the detected user activity that triggers the system 500 to direct the beam of light is something other than a user input command to dispense content, the system 500 may monitor for receipt of a user input command to dispense content and also may measure a time from when the user activity was detected or a length of time that the beam of light has been directed along the output flow path. When the system 500 receives a user input command to dispense content, the system 500 may compare the time from when the user activity was detected or the length of time that the beam of light has been directed along the output flow path to a threshold time (e.g., three seconds). If the comparison reveals that the time from when the user activity was detected or the length of time that the beam of light has been directed along the output flow path has reached the threshold time, the system 500 causes the dispenser to dispense content immediately in response to the user input command. However, if the comparison reveals that the time from when the user activity was detected or the length of time that the beam of light has been directed along the output flow path has not reached the threshold time, the system 500 delays dispensing of content until the time from when the user activity was detected or the length of time that the beam of light has been directed along the output flow path reaches the threshold time.

For instance, when the threshold period of time is three seconds and the system 500 receives a user input to dispense content when the beam of light has been directed along the output flow path for one second, the system 500 may wait an additional two seconds to dispense content. When the threshold period of time is three seconds and the system 500 receives a user input to dispense content when the beam of light has been directed along the output flow path for five seconds, the system 500 may dispense content immediately in response to the user input command.

By delaying dispensing of content for a threshold period of time, the system 500 may provide the user with an opportunity to use the beam of light to accurately position the container to receive content from the dispenser prior to any content being dispensed. In other words, if the beam of light has not been directed along the output flow path for the threshold period of time, the user may not receive the benefit of the beam of light in positioning the container and may have the same challenges in accurately positioning the container that exist when the beam of light is not provided.

The system 500 dispenses content along the output flow path and into the container (630). For example, the system 500 causes the dispenser to dispense content through an outlet of the dispenser, along an output flow path, and into a container that has been positioned along the output flow path based on the beam of light directed along at least a portion of the output flow path. As discussed above, the system 500 may delay dispensing of content for a threshold period of time to enable a user to use the beam of light to move the container to a position in which the container receives content dispensed from the dispenser.

Figure 7:
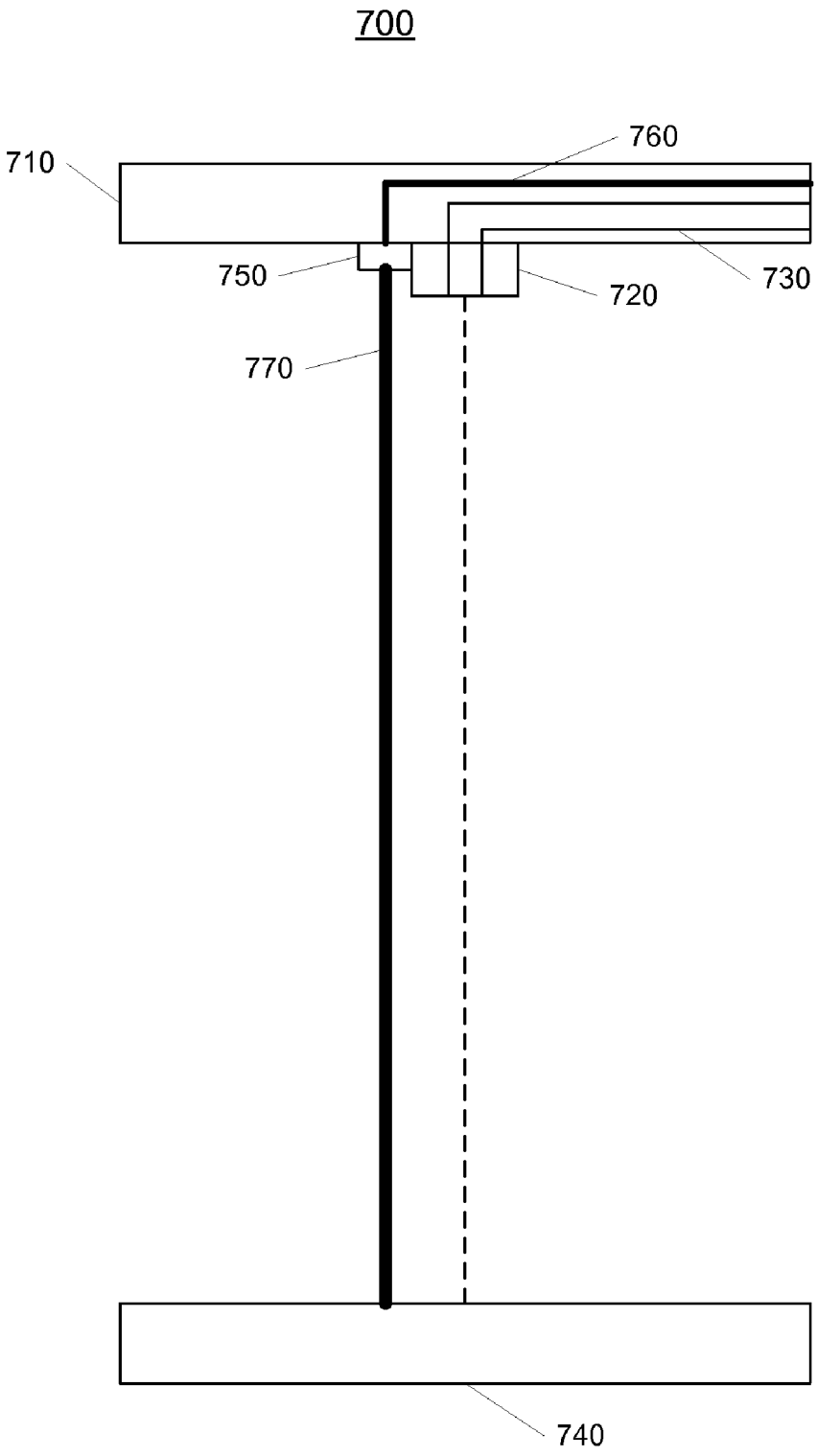
FIGS. 7-14, 16, 17, 19, 20, 22-27, 29, 30, 32, 34, and 35 depict example dispenser arrangements and dispenser components.

FIG. 7 illustrates an example of a dispenser arrangement 700 in which a beam of light is directed along a path that is parallel to an output flow path of a dispenser and that is spaced apart from the output flow path. The dispenser arrangement 700 includes an outlet housing 710, an outlet 720, a dispensing chute 730, a container support 740, an optical element 750, an electrical connection 760, and a beam of light 770. The outlet housing 710 provides a supporting structure for the outlet 720, the dispensing chute 730, the optical element 750, and the electrical connection 760. The outlet housing 710 may be similar to the outlet housing 110 described above with respect to FIG. 1.

The outlet 720 defines an outlet of the dispenser arrangement 700 and guides content dispensed from the dispenser arrangement 700 to an exterior of the dispenser arrangement 700. The outlet 720 may be similar to the outlet 120 described above with respect to FIG. 1.

The dispensing chute 730 guides content from a content source (e.g., a water tank, an ice bin, etc.) to the outlet 720 for dispensing. The dispensing chute 730 may be any type of tube or pipe that is capable of guiding content from a content source to the outlet 720.

The container support 740 supports a container being filled by the dispenser arrangement 700. The container support 740 may be similar to the support 130 described above with respect to FIG. 1.

The optical element 750 may be an optical component that is configured to direct a beam of light 770 along a path. In this example, the optical element 750 may be a laser component (e.g., a laser diode) or any other type of illumination source that is capable of generating and/or directing a beam of light 770 along a path. The optical element 750 may be the optical system 520 or may include any one or more of the components described above with respect to the optical system 520. Although the optical element 750 is shown as generating a beam of light 770, the optical element 750 may include a mirror and/or lens arrangement that guides a beam of light generated from a different location along the path shown.

The electrical connection 760 provides an electrical connection between a controller (and/or a power source) and the optical element 750. The electrical connection 760 may include a wired data pathway that allows a controller to control whether or not the optical element 750 directs a beam of light along the output flow path. The electrical connection 760 also may include a wired connection that is configured to transmit an electrical power signal to the optical element 750 that enables the optical element 750 to generate a beam of light 770. The beam of light 770 is directed along a path that is parallel to an output flow path (shown by the dashed line) defined by the outlet 720 and that is spaced apart from the output flow path.

Because the beam of light 770 does not directly pass along the output flow path, the beam of light 770 may only provide a close approximation of the location of the output flow path. The close approximation, however, may be sufficient to assist a user in accurately placing a container at a position at which the container is capable of receiving content dispensed along the output flow path. Specifically, the beam of light 770 may be spaced apart from the output flow path a relatively small distance that is less than one half of a width of a typical container opening. As such, when a container is positioned such that the beam of light 770 intersects an opening of the container at the middle of the opening, the output flow path also intersects the opening of the container because the beam of light 770 is close enough to the output flow path that the opening of the container extends past the output flow path. The distance with which the beam of light 770 is spaced apart from the output flow path may be minimized in the dispenser arrangement 700 to provide the most accurate container positioning assistance. Having the beam of light 770 spaced apart from the output flow path may be beneficial in that manufacturing and maintenance of the dispenser arrangement 700 may be more convenient and less costly than if the beam of light 770 follows directly along the output flow path.

Figure 8:
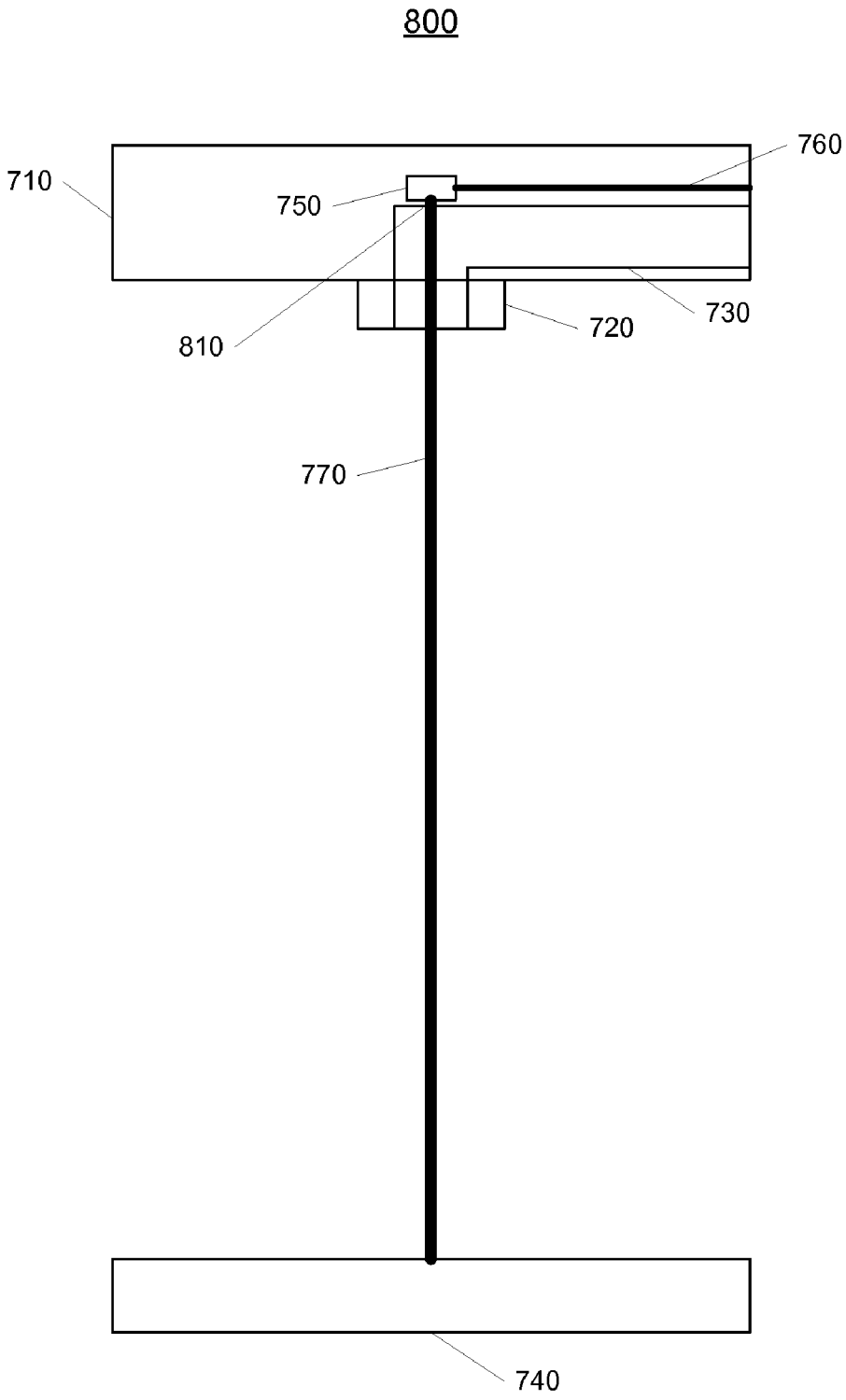

FIG. 8 illustrates an example of a dispenser arrangement 800 in which a beam of light is directed through a transparent portion of a chute of the dispenser, through an opening defined by an outlet of the dispenser, and directly along an output flow path of the dispenser. In the dispenser arrangement 800, the optical element 750 is positioned above the chute 730. The chute 730 includes a transparent portion 810 that allows a beam of light generated by the optical element 750 to pass through the chute 730. When the optical element 750 generates a beam of light 770, the beam of light 770 passes through the transparent portion 810 of the chute 730, through an opening defined by the outlet 720, and directly along an output flow path. The transparent portion 810 of the chute 730 may be a relatively small portion of the chute 730 (e.g., a small transparent window) or the chute 730 may be a completely transparent tube (e.g., a tube made of transparent plastic) and the beam of light 770 may pass through any portion of the chute 730. By allowing the beam of light 770 to pass directly along the output flow path, the dispenser arrangement 800 may enable a user to precisely position a container along the output flow path using the beam of light 770.

Figure 9:
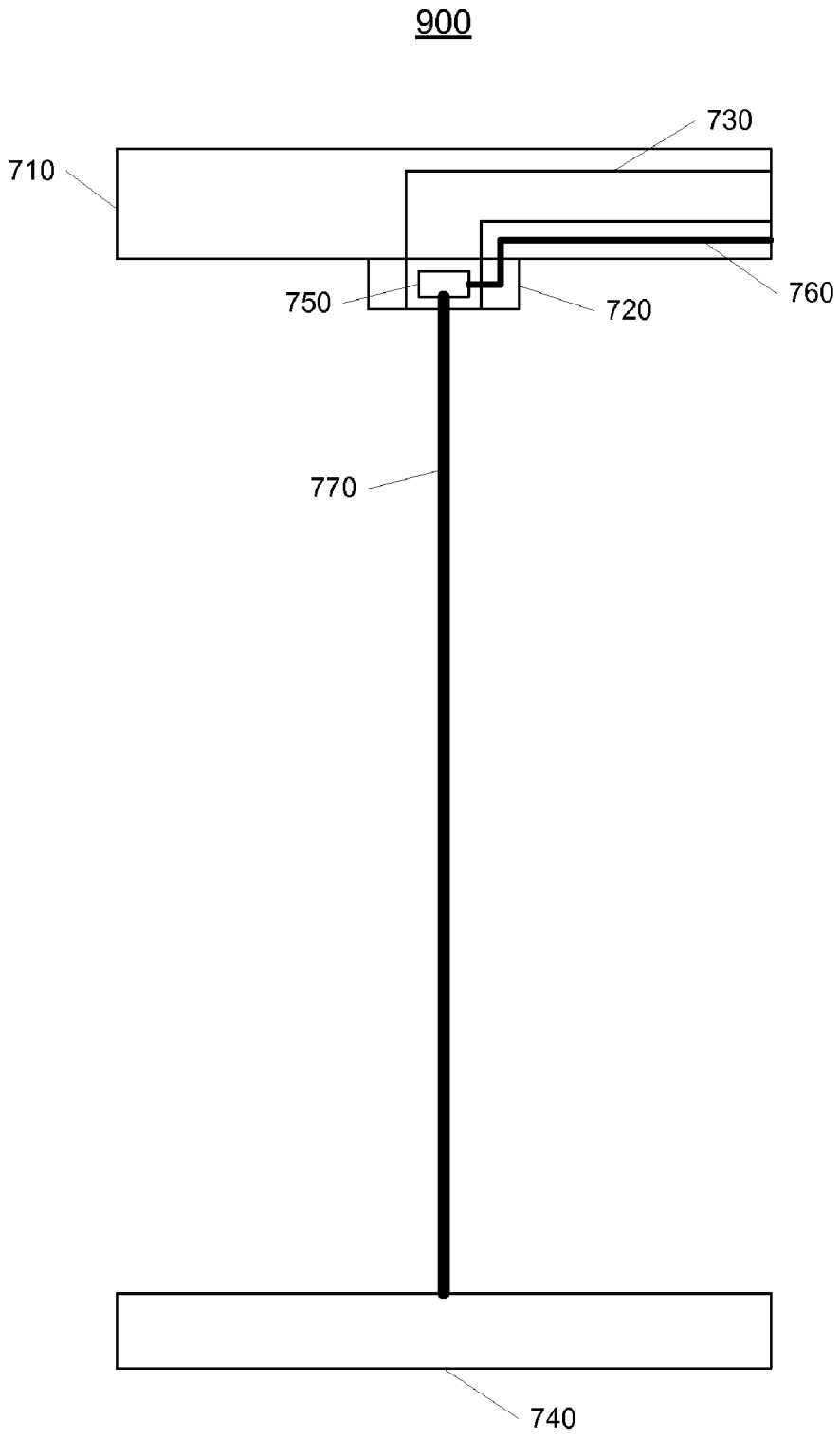

FIG. 9 illustrates an example of a dispenser arrangement 900 in which a beam of light is generated within a chute of the dispenser and passes through an opening defined by an outlet of the dispenser and directly along an output flow path of the dispenser. In the dispenser arrangement 900, the optical element 750 is positioned within the chute 730 and oriented to direct a beam of light 770 in the same direction as a path with which the chute 730 and the outlet 720 guide content. Because the optical element 750 is positioned within the chute 730 and oriented to direct a beam of light 770 in the same direction as a path with which the chute 730 and the outlet 720 guide content, the beam of light 770 generated by the optical element 750 follows directly along the output flow path. When the optical element 750 generates a beam of light 770 within the chute 730, the beam of light 770 passes through an opening defined by the outlet 720 and directly along the output flow path. The optical element 750 may be supported within the chute 730 in a manner that allows content to pass around or by the optical element 750 without being blocked by the optical element 750. By allowing the beam of light 770 to pass directly along the output flow path, the dispenser arrangement 900 may enable a user to precisely position a container along the output flow path using the beam of light 770.

Figure 10:
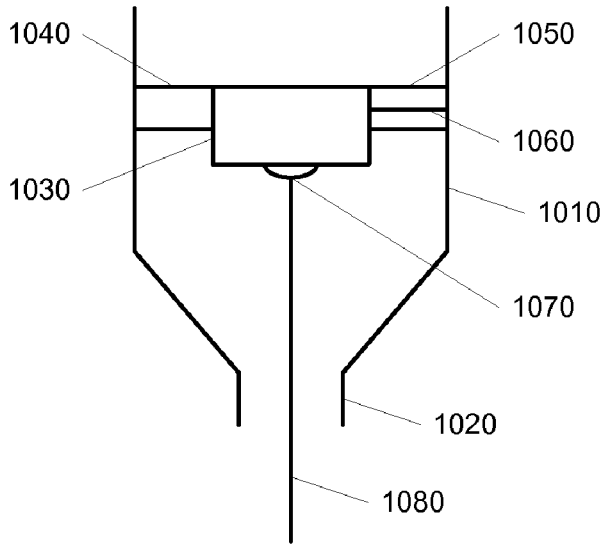
Figure 11:
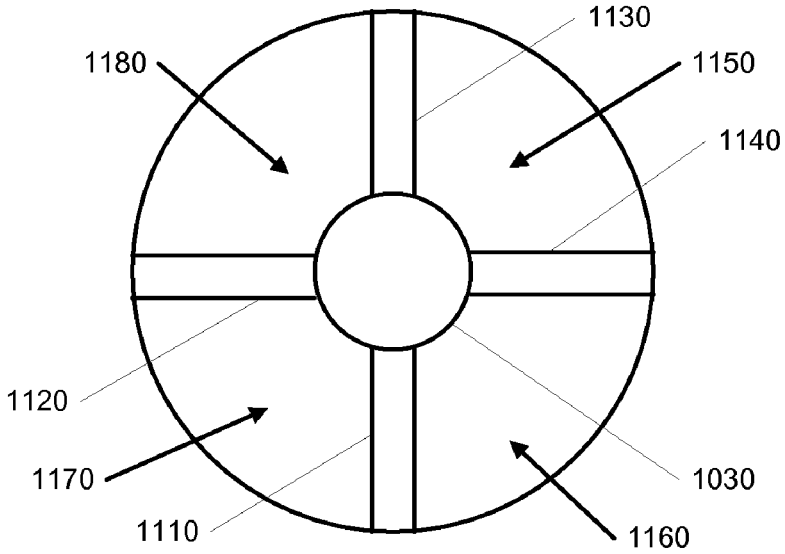

FIGS. 10 and 11 illustrate an example of a laser component positioned within a chute of a dispenser. The example shown in FIGS. 10 and 11 may be used in the dispenser arrangement 900 to secure the optical element 750 within the chute 730 in a manner that allows content to pass around or by the optical element 750.

As shown in FIG. 10, the chute 1010 has a shape configured to guide content to an outlet 1020. In some examples, the outlet 1020 may have a width that is narrower than a width of the chute 1010. The width of the chute 1010 may be wider to accommodate an optical element within the chute 1010 and allow content to pass by the optical element without a large amount of blockage. A laser component 1030 (e.g., a laser diode) is supported within the chute 1010 by multiple support structures 1040 and 1050. The multiple support structures 1040 and 1050 may be spokes that are attached to a side of the chute 1010 at one end and attached to a body of the laser component 1030 at the opposite end. An electrical connection 1060 for the laser component 1030 may be positioned within or along the support structure 1050. A laser output 1070 of the laser component 1030 is oriented such that a laser beam 1080 generated by the laser component 1030 is directed through the outlet 1020 and directly along an output flow path of content dispensed through the outlet 1020.

FIG. 11 illustrates the support structure for the laser component 1030 from a top view. As shown, the laser component 1030 is supported by four spokes 1110 to 1140 that each have one end secured to a side of the chute and an opposite end secured to the laser component 1030. The four spokes 1110 to 1140 have relatively narrow widths and define four content flow passageways 1150 to 1180. The four content flow passageways 1150 to 1180 enable content flowing through the chute to pass around the laser component 1030. Although four support structures and four content flow passageways are shown, more or fewer support structures and content flow passageways may be used in supporting the laser component 1030 within the chute in a manner that allows content to pass around or by the laser component 1030.

Figure 12:
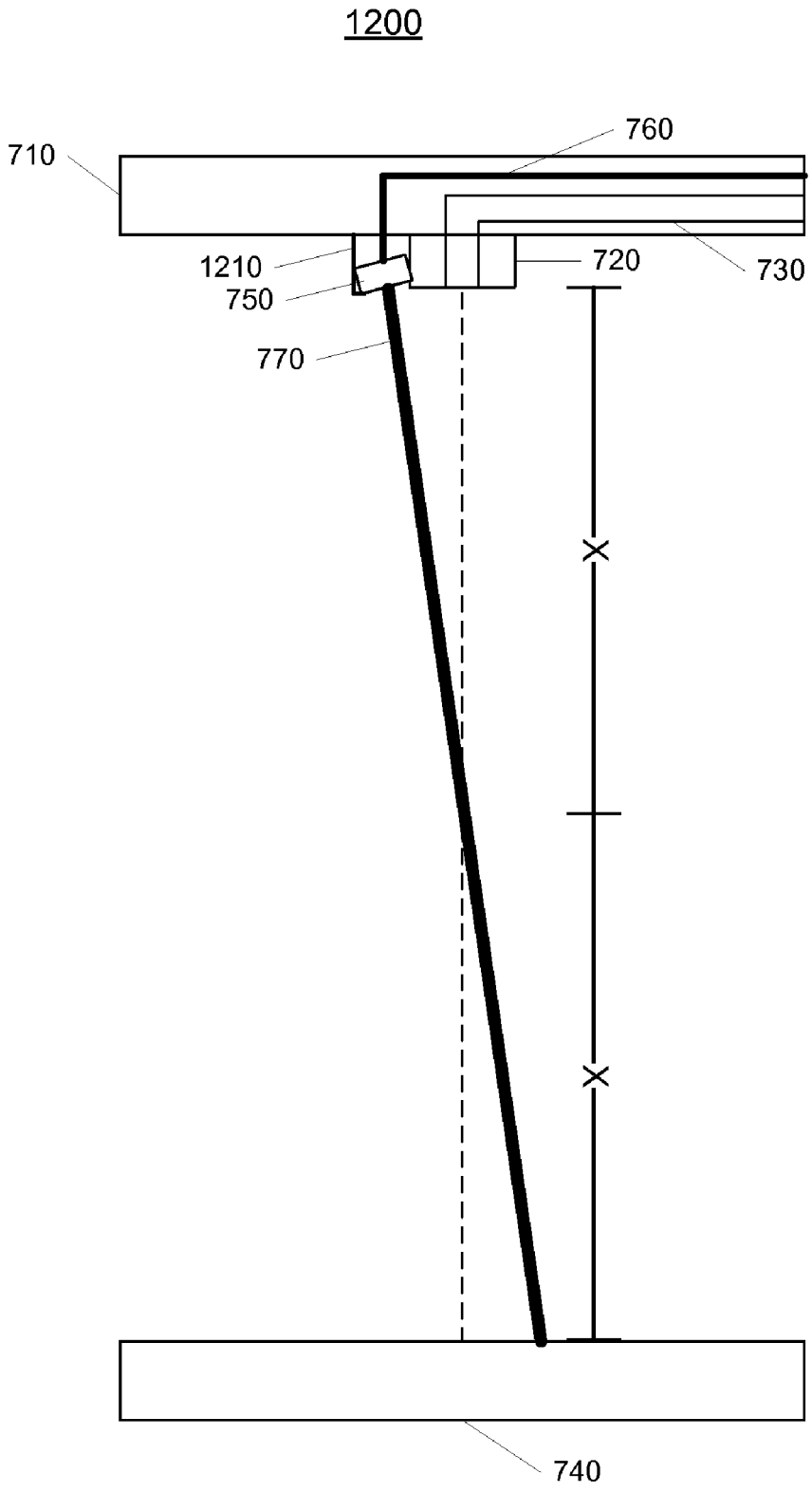

FIG. 12 illustrates an example of a dispenser arrangement 1200 in which a beam of light is angled with respect to an output flow path of a dispenser and intersects the output flow path at a midpoint between an outlet of the dispenser and a tray that is configured to support a container being filled by the dispenser. In the dispenser arrangement 1200, the optical element 750 is supported by a bracket 1210 next to the outlet 720 and oriented such that a beam of light 770 directed by the optical element 750 intersects the output flow path at a midpoint between the outlet 720 and the container support 740. By intersecting the output flow path at the midpoint, the divergence of the beam of light 770 from the output flow path at any point may be minimized.

Figure 13:
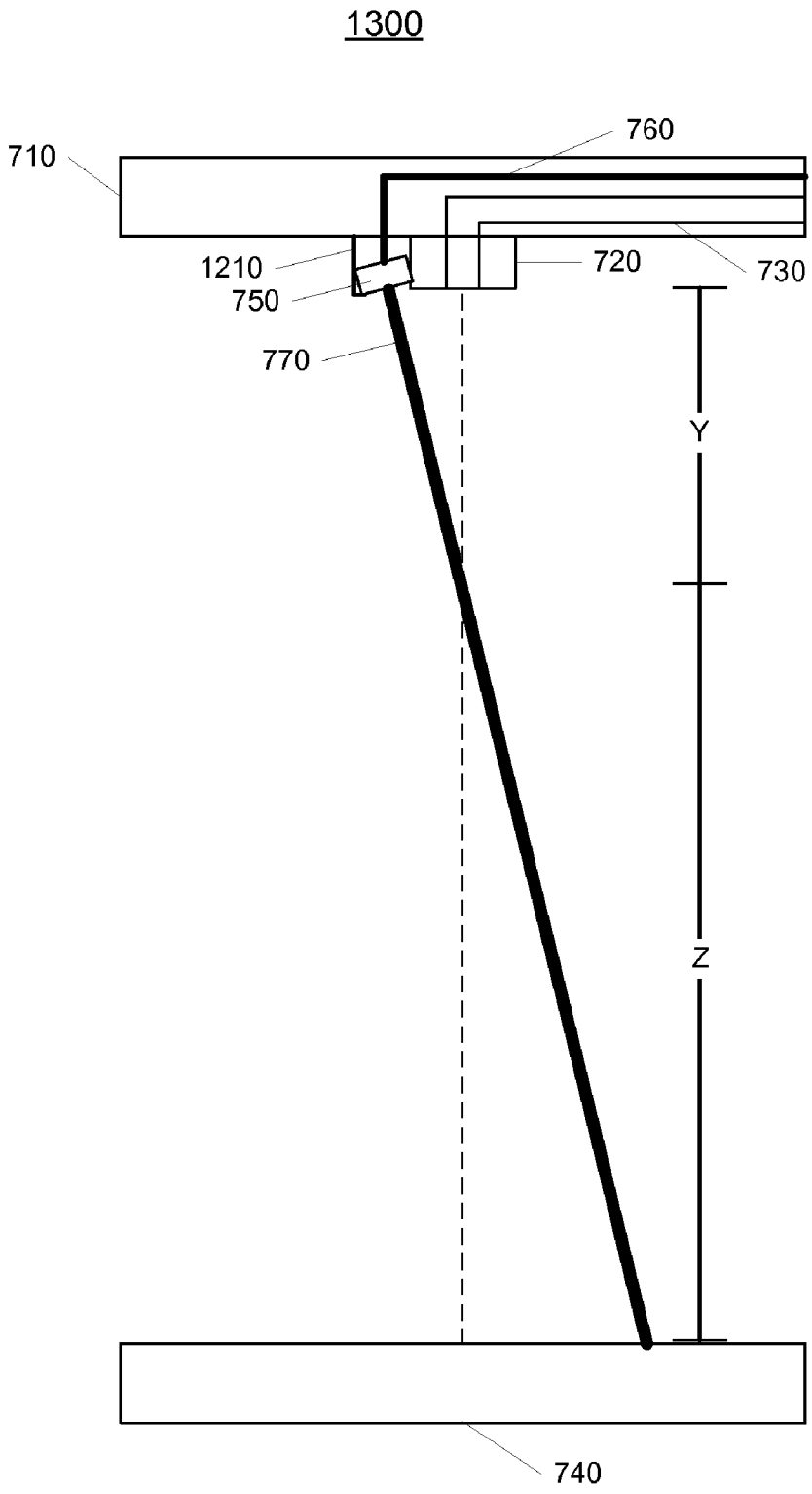

FIG. 13 illustrates an example of a dispenser arrangement 1300 in which a beam of light is angled with respect to an output flow path of a dispenser and intersects the output flow path at an offset point between an outlet of the dispenser and a tray that is configured to support a container being filled by the dispenser. In the dispenser arrangement 1300, the optical element 750 is supported by a bracket 1210 next to the outlet 720 and oriented such that a beam of light 770 directed by the optical element 750 intersects the output flow path at an offset point between the outlet 720 and the container support 740. The offset point may be closer to the outlet 720 than the container support 740 (e.g., the distance Y is smaller than the distance Z) because a majority of containers being filled by the dispenser arrangement 1300 may have an opening that is positioned closer to the outlet 720 than the container support 740 when being filled. The offset point may be defined based on a size of an average container or the size of a common container that is difficult to fill. For instance, the offset point may be selected to intersect the output flow path at the same point as an opening of a typical water bottle that is placed on the container support 740. The offset point also may be a predetermined distance from the outlet 720 (e.g., the distance Y is two inches). The predetermined distance may be based on how far away users typically hold a container from the outlet 720 when filling the container. By intersecting the output flow path at the offset point, the beam of light 770 may provide better assistance to a user attempting to position a container along the output flow path because the beam of light 770 may be closer to the output flow path near the opening of the container.

Figure 14:
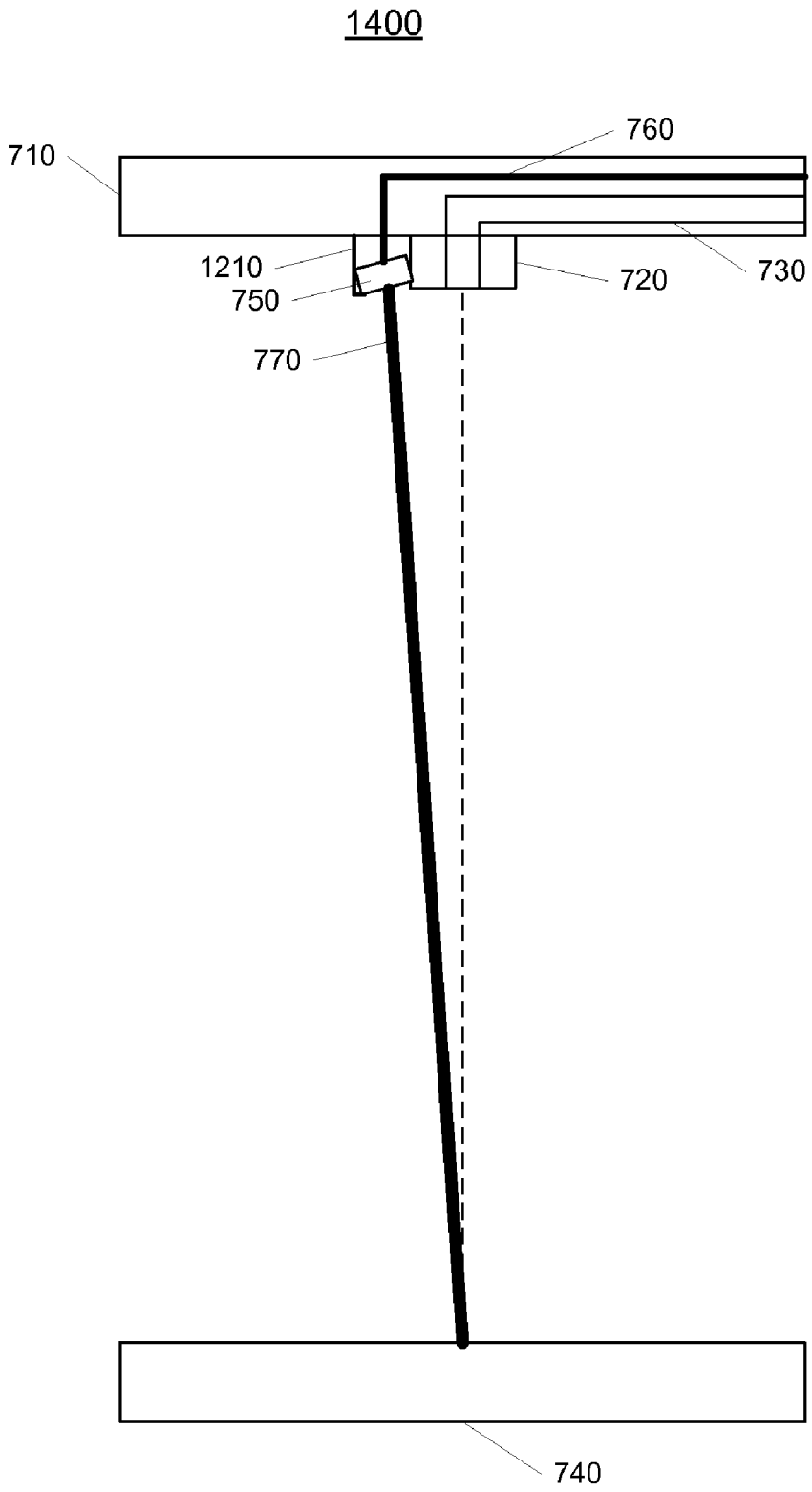

FIG. 14 illustrates an example of a dispenser arrangement 1400 in which a beam of light is angled with respect to an output flow path of a dispenser and intersects the output flow path at a point at which the output flow path intersects a tray that is configured to support a container being filled by the dispenser. In the dispenser arrangement 1400, the optical element 750 is supported by a bracket 1210 next to the outlet 720 and oriented such that a beam of light 770 directed by the optical element 750 intersects the output flow path at the container support 740. By intersecting the output flow path at the container support 740, a user may perceive the spot on the container support 740 that is directly under the outlet 720 and be able to place a container directly on the spot.

Although FIGS. 12 to 14 show the output flow path being perpendicular to the container support 740 and the beam of light 770 being angled with respect to the container support 740, other implementations may have the beam of light 770 being perpendicular to the container support 740 and the output flow path being angled with respect to the container support 740. In these implementations, the optical element 750 may be positioned and/or oriented such that the beam of light 770 intersects the angled output flow path at any one of the points described above with respect to FIGS. 12 to 14 (e.g., a midpoint, an offset point, an intersection point with the container support 740, etc.). When the output flow path is angled with respect to the container support 740, the optical element 750 may be positioned and/or oriented such that the beam of light 770 also is angled with respect to the container support 740. For instance, the optical element 750 may be positioned and/or oriented such that the beam of light 770 follows along the angled output flow path as closely as possible.

Figure 15:
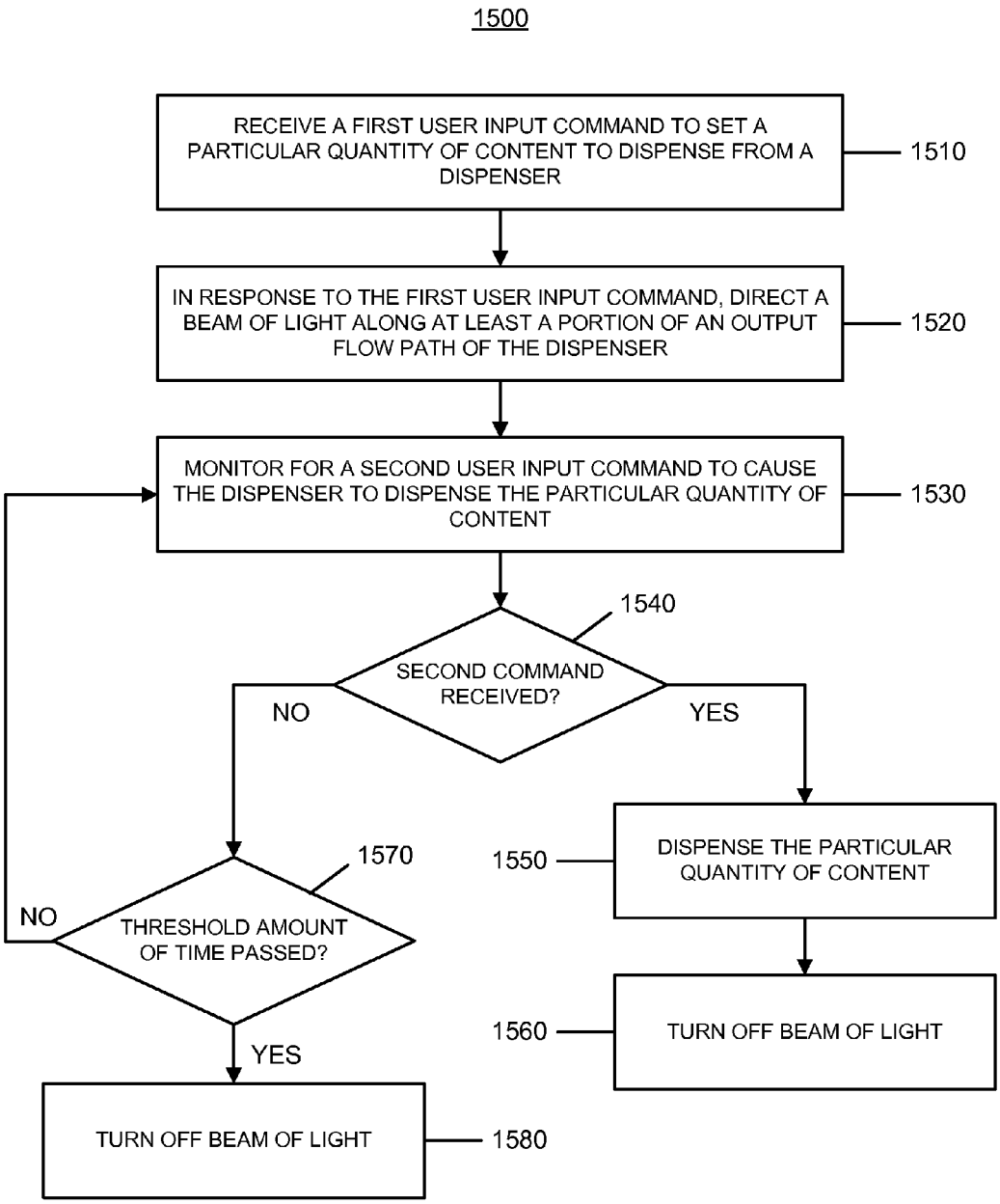

FIG. 15 illustrates an example of a process 1500 for directing a beam of light along at least a portion of an output flow path of a dispenser in response to a user input command related to dispensing. The operations of the process 1500 are described generally as being performed by the system 500. The operations of the process 1500 may be performed by any combination of the components of the system 500. In some implementations, operations of the process 1500 may be performed by one or more processors included in one or more electronic devices.

The system 500 receives a first user input command to set a particular quantity of content to dispense from a dispenser (1510). For instance, the system 500 may receive a signal from an input button pressed by a user. The input button may be a measured fill input button that controls the system 500 to set a particular quantity of content to dispense. The system 500 also may receive one or more user input actions to set or adjust the particular quantity of content to dispense. The system 500 may receive the first user input command using the input unit 530.

In response to the first user input command, the system 500 directs a beam of light along at least a portion of an output flow path of the dispenser (1520). The system 500 may direct a beam of light along at least a portion of an output flow path of the dispenser using techniques similar to those described above with respect to numeral 620 shown in FIG. 6 and FIGS. 7 to 14.

The system 500 monitors for a second user input command to cause the dispenser to dispense the particular quantity of content (1530). For instance, the system 500 may wait for the second user input command and track user input commands provided by a user subsequent to first user input command. The system 500 also may track a time from when the first user input command was received while monitoring for the second user input command.

The system 500 determines whether a second user input command to cause the dispenser to dispense the particular quantity of content is received based on the monitoring (1540). For example, the system 500 determines whether a signal from an input button pressed by a user has been received. The input button may be a dispense or fill input button that controls the system 500 to dispense content.

In response to a determination that the second user input command to cause the dispenser to dispense the particular quantity of content has been received, the system 500 dispenses the particular quantity of content (1550) and turns off beam of light (1560). For example, the controller 560 may control the dispenser 550 to dispense content (e.g., water) and may control the optical system 520 to turn off the beam of light. The system 500 may turn of the beam of light while dispensing content or may wait until all of the particular quantity of content has been dispensed prior to turning off the beam of light.

In response to a determination that the second user input command to cause the dispenser to dispense the particular quantity of content has not been received, the system 500 determines whether a threshold period of time has passed since receipt of the first user input command (1570). The system 500 may compare a time from when the first user input command was received to a threshold amount of time and make the determination based on the comparison. The threshold amount of time may be set to a time by which a user typically would have caused the dispenser to dispense the particular quantity of content after providing the user input command to set the particular quantity of content. For instance, the threshold amount of time may be set to thirty seconds or one minute.

In response to a determination that the threshold period of time has passed since receipt of the first user input command, the system 500 turns off the beam of light (1580). For example, the controller 560 may control the optical system 520 to turn off the beam of light. The system 500 may turn off the beam of light after a threshold period of time has passed to conserve power when it is unlikely the user is using the beam of light to position a container.

In response to a determination that the threshold period of time has not passed since receipt of the first user input command, the system 500 continues to monitor for a second user input command to cause the dispenser to dispense the particular quantity of content.

Figure 16:
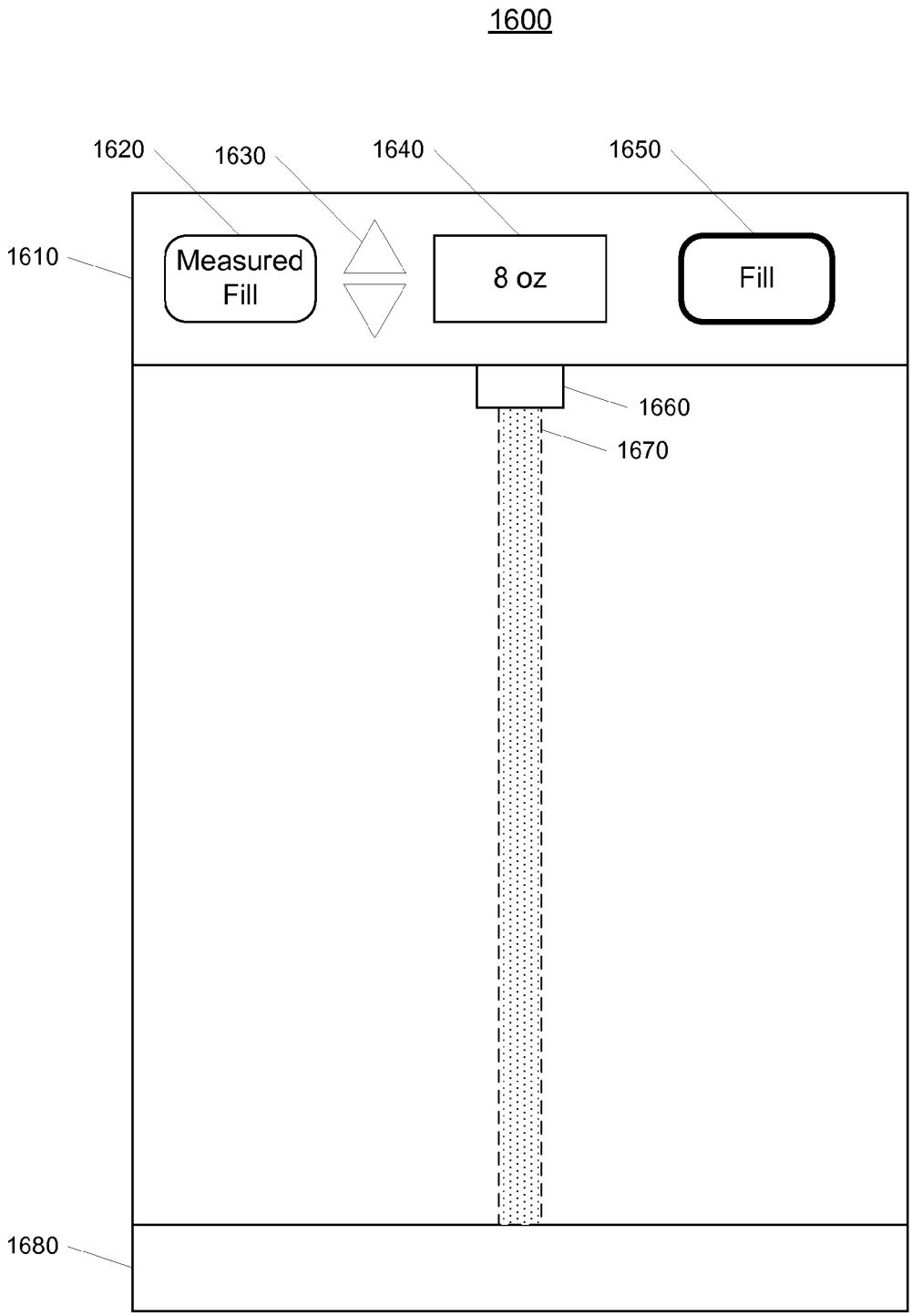

FIG. 16 illustrates an example of a dispenser arrangement 1600 after receipt of a first user input command to set a particular quantity of content to dispense from a dispenser. The dispenser arrangement 1600 may reflect a dispenser while the system 500 is monitoring for a second user input command as described above with respect to numeral 1530.

The dispenser arrangement 1600 includes an input area 1610, an outlet 1660, and a container support 1680. The input area 1610 includes a measured fill input button 1620, quantity control input buttons 1630, a display 1640, and a fill input button 1650. The measured fill input button 1620 causes the dispenser arrangement 1600 to set a particular quantity of content to dispense in response to the next command to dispense content that is received. The quantity control input buttons 1630 enable a user to adjust the particular quantity of content to dispense and the display 1640 displays the particular quantity of content to dispense. The fill input button 1650 causes the dispenser arrangement 1600 to dispense the particular quantity of content when pressed. As shown, the fill input button 1650 may be highlighted and/or enabled after the measured fill input button 1620 has been pressed.

The outlet 1660 may be similar to the outlet 720 described above and the container support 1680 may be similar to the container support 740 described above. The dispenser arrangement 1600 may be configured to direct a beam of light 1670 along an output flow path defined by the outlet 1660 in response to a user pressing the measured fill button 1620. After the measured fill button 1620 has been pressed, the dispenser arrangement 1600 may monitor for the fill input button 1650 being pressed.

Figure 17:
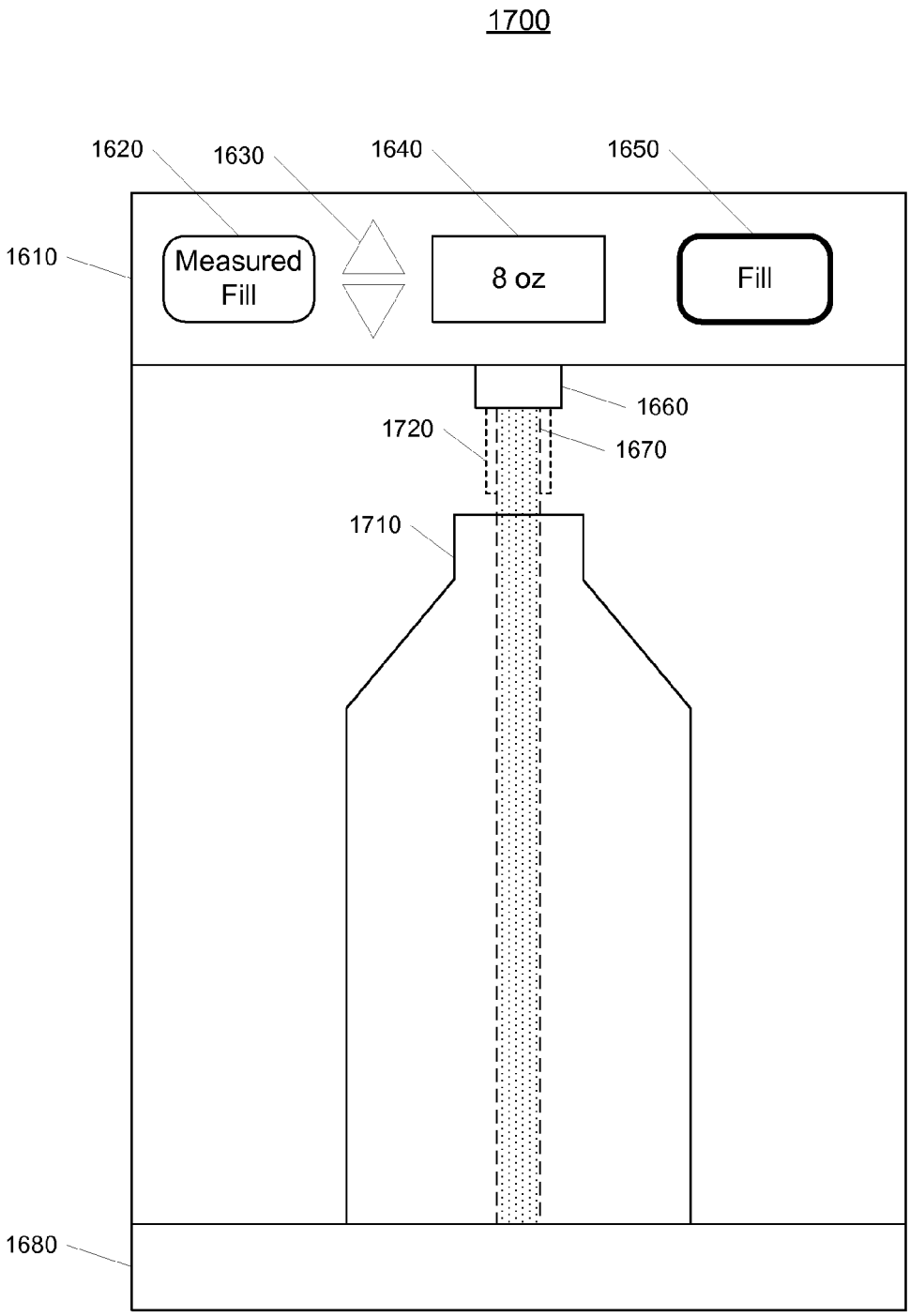

FIG. 17 illustrates an example of a dispenser arrangement 1700 after receipt of a second user input command to cause the dispenser to dispense the particular quantity of content. As shown, a user may position a container 1710 along an output flow path of the dispenser using the beam of light 1670. For instance, the user may place the container 1710 on the container support 1680 and move the container 1710 to a position at which an opening of the container 1710 intersects the beam of light 1670. After the container has been positioned, the user may press the fill input button 1650 to cause the dispenser to dispense the particular quantity of content. When the fill input button 1650 is pressed, the dispenser dispenses the particular quantity of content into the container as illustrated by the content flow 1720.

Figure 18:
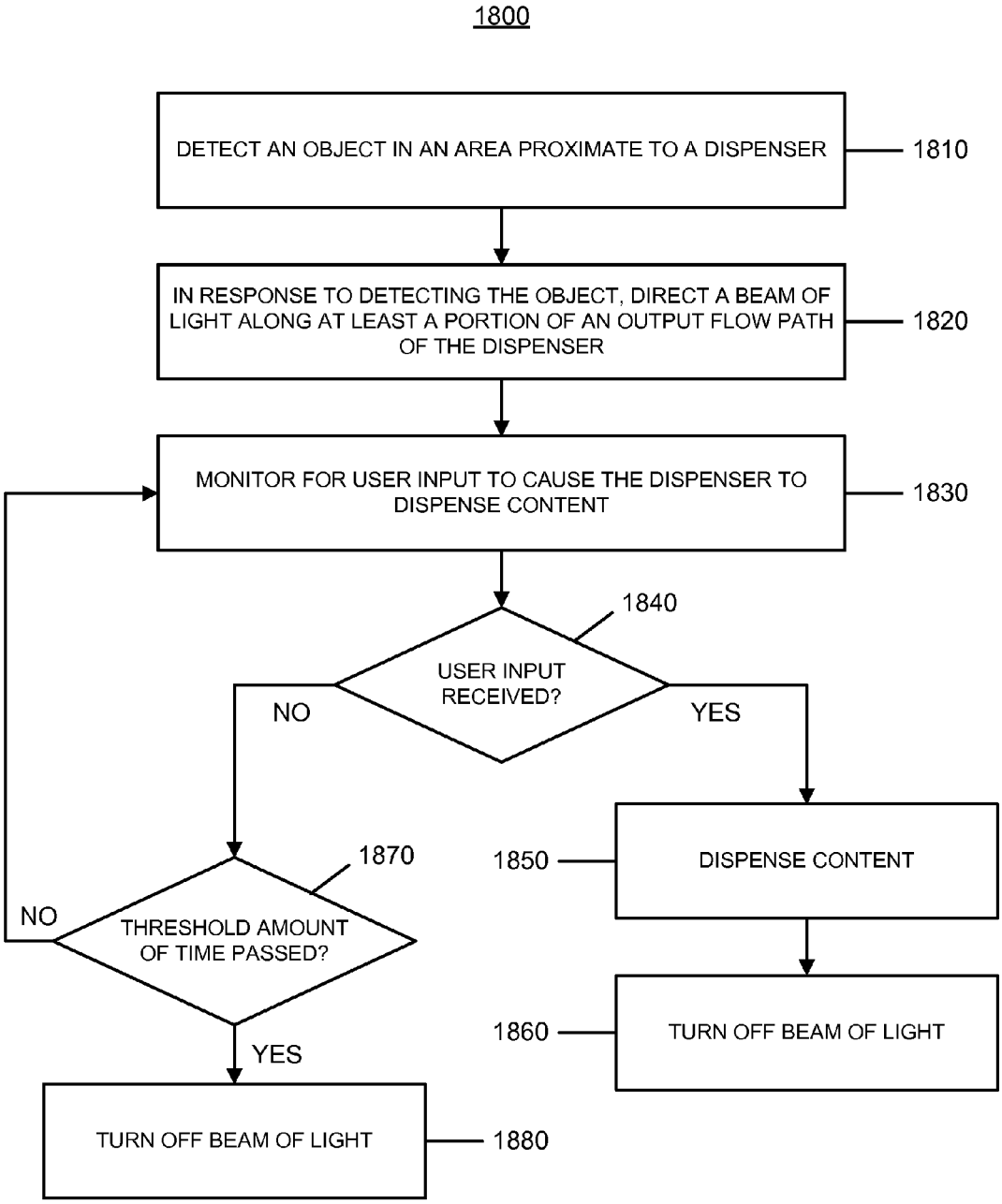

FIG. 18 illustrates an example of a process 1800 for directing a beam of light along at least a portion of an output flow path of a dispenser in response to detecting an object in an area proximate to the dispenser. The operations of the process 1800 are described generally as being performed by the system 500. The operations of the process 1800 may be performed by any combination of the components of the system 500. In some implementations, operations of the process 1800 may be performed by one or more processors included in one or more electronic devices.

The system 500 detects an object in an area proximate to a dispenser (1810). The system 500 may detect the object within an area proximate to the dispenser using any type of sensor that is configured to detect presence of an object. For example, the system 500 may detect the object using the detection unit 510 and any one or more of the sensors described above with respect to the detection unit 510.

The system 500 may detect a container within an area proximate to the dispenser as the user activity. For example, the system 500 may detect a container being positioned under an outlet of the dispenser, detect a container being positioned within a dispensing area or cavity of the dispenser, and/or may detect a container being positioned within a threshold distance of the dispenser (e.g., within a foot or a few inches).

The system 500 also may detect a portion of a user's body within an area proximate to the dispenser as the user activity. For instance, the system 500 may detect a user's hand being positioned under an outlet of the dispenser, detect a user's hand being positioned within a dispensing area or cavity of the dispenser, and/or may detect a user's hand being positioned within a threshold distance of the dispenser (e.g., within a foot or a few inches).

In some examples, the system 500 may detect presence of a user's body in an area proximate to the dispenser. In these examples, the system 500 may detect a user standing in front of the dispenser within a threshold distance (e.g., within one foot) and infer that the user intends to use the dispenser.

In response to detecting the object, the system 500 directs a beam of light along at least a portion of an output flow path of the dispenser (1820). The system 500 may direct a beam of light along at least a portion of an output flow path of the dispenser using techniques similar to those described above with respect to numeral 620 shown in FIG. 6 and FIGS. 7 to 14.

The system 500 monitors for user input to cause the dispenser to dispense content (1830). For instance, the system 500 may wait for a user input command to dispense content and track user input commands provided by a user subsequent to detecting the object in the area proximate to the dispenser. The system 500 also may track a time from when the object was detected while monitoring for the user input to cause the dispenser to dispense content.

The system 500 determines whether user input to cause the dispenser to dispense content is received based on the monitoring (1840). For example, the system 500 determines whether a signal from an input button pressed by a user has been received. The input button may be a dispense button that controls the system 500 to dispense content.

In response to a determination that user input to cause the dispenser to dispense content has been received, the system 500 dispenses content (1850) and turns off the beam of light (1860). For example, the controller 560 may control the dispenser 550 to dispense content (e.g., water) and may control the optical system 520 to turn off the beam of light. The system 500 may turn off the beam of light while dispensing content or may wait until content dispensing has ended prior to turning off the beam of light.

In response to a determination that user input to cause the dispenser to dispense content has not been received, the system 500 determines whether a threshold period of time has passed since detecting the object (1870). The system 500 may compare a time from when the object was detected to a threshold amount of time and make the determination based on the comparison. The threshold amount of time may be set to a time by which a user typically would have caused the dispenser to dispense content after moving an object to a position proximate to the dispenser. For instance, the threshold amount of time may be set to thirty seconds or one minute.

In response to a determination that the threshold period of time has passed since detecting the object, the system 500 turns off the beam of light (1880). For example, the controller 560 may control the optical system 520 to turn off the beam of light. The system 500 may turn off the beam of light after a threshold period of time has passed to conserve power when it is unlikely the user is using the beam of light to position a container.

In response to a determination that the threshold period of time has not passed since detecting the object, the system 500 continues to monitor for user input to cause the dispenser to dispense content.

In some implementations, the system 500 may track movement of the object detected as being proximate to the dispenser and determine whether or not to turn off the beam of light based on the tracked movement. In these implementations, the system 500 may determine that the object has moved out of an area proximate to the dispenser based on the tracked movement and control the optical system 520 to turn off the beam of light in response to the determination that the object has moved out of an area proximate to the dispenser. The system 500 also may control the optical system 520 to turn off the beam of light in response to a determination that no object is detected within an area proximate to the dispenser.

Figure 19:
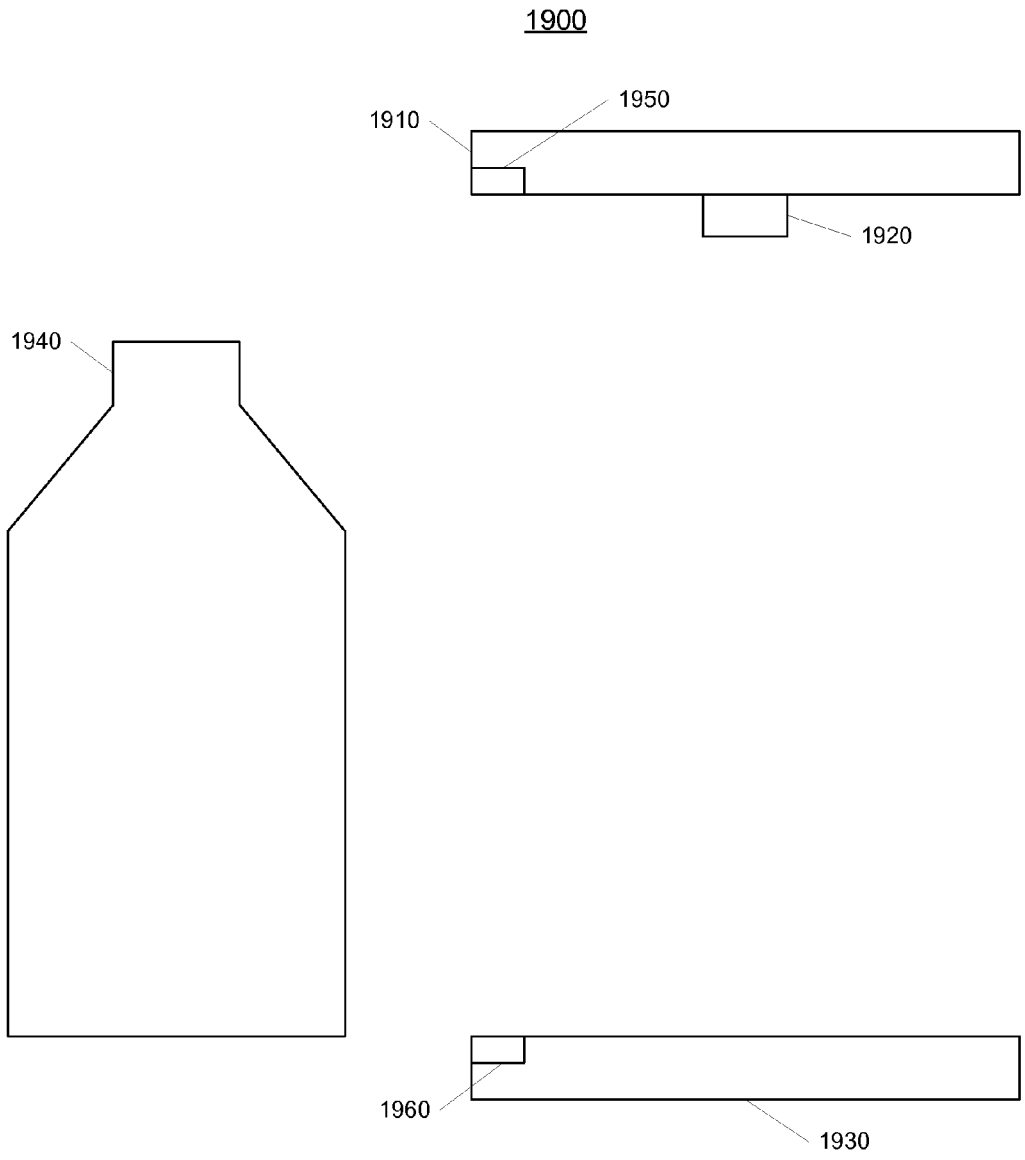
Figure 20:
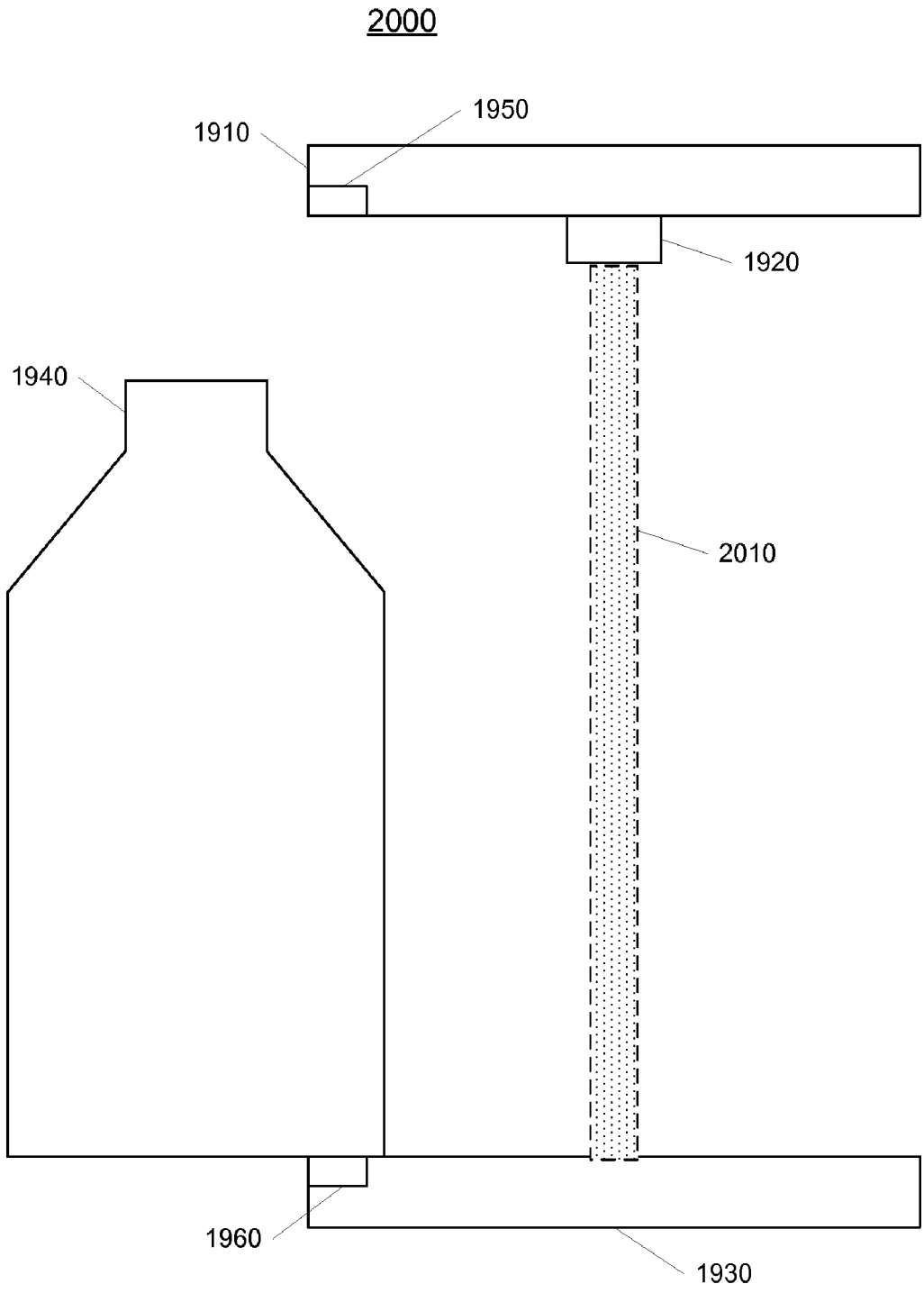

FIGS. 19 and 20 illustrate an example of a dispenser arrangement that directs a beam of light along at least a portion of an output flow path of a dispenser based on movement of a container to an area proximate to the dispenser. The dispenser arrangement 1900 includes an outlet housing 1910, an outlet 1920, a container support 1930, a first sensor part 1950, and a second sensor part 1960. The outlet housing 1910 may be similar to the outlet housing 710 described above, the outlet 1920 may be similar to the outlet 720 described above, and the container support 1930 may be similar to the container support 740 described above. The first sensor part 1950 and the second sensor part 1960 may be part of an optical interception detection device. The first sensor part 1950 may be an infrared emitter and the second sensor part 1960 may be an infrared receiver that detects an infrared light signal output by the infrared emitter. When no object is present between the first sensor part 1950 and the second sensor part 1960, the infrared light signal output by the infrared emitter is detected by the infrared receiver. When an object enters the area between the first sensor part 1950 and the second sensor part 1960, the infrared light signal output by the infrared emitter is blocked by the object and presence of the object is detected because the infrared receiver no longer detects the infrared light signal.

As shown in FIG. 19, the container 1940 is positioned outside of a dispensing area or cavity of the dispenser arrangement 1900. Because the container 1940 is not positioned between the first sensor part 1950 and the second sensor part 1960, the infrared light signal output by the first sensor part 1950 is detected by the second sensor part 1960.

Accordingly, the beam of light is off when the container 1940 is positioned as shown in FIG. 19.

As shown in FIG. 20, the container 1940 has been moved to a position where a portion of the container 1940 has entered the dispensing area or cavity. As such, a portion of the container 1940 is between the first sensor part 1950 and the second sensor part 1960 and prevents the infrared signal emitted from the first sensor part 1950 from reaching the second sensor part 1960. Because the infrared signal does not reach the second sensor part 1960, presence of the container 1940 is detected in the dispensing area or cavity (e.g., an area proximate to the dispenser). In response to detecting presence of the container 1940 in the dispensing area or cavity (e.g., an area proximate to the dispenser), a beam of light 2010 is directed along an output flow path defined by the outlet 1920. In this regard, as the container 1940 nears the outlet 1920, the beam of light 2010 is directed along the output flow path to assist a user in moving the container 1940 to a position at which content dispensed through the outlet 1920 is received in the container 1940.

In some implementations, sensors other than the first sensor part 1950 and the second sensor part 1960 may be used to detect presence of the container. In addition, although the first sensor part 1950 and the second sensor part 1960 are shown as being vertically oriented such that the infrared light signal is perpendicular to the container support 1930, the first sensor part 1950 and the second sensor part 1960 may have other orientations, such as a horizontal orientation such that the infrared light signal is parallel to the container support 1930. The first sensor part 1950 and the second sensor part 1960 also may be positioned at other places within the dispensing area or cavity or at other places within the dispenser arrangement 1900. For instance, the first sensor part 1950 and the second sensor part 1960 may be positioned at the outlet 1920 or adjacent to the outlet 1920 such that the first sensor part 1950 and the second sensor part 1960 detect objects that are present under the outlet 1920.

Figure 21:
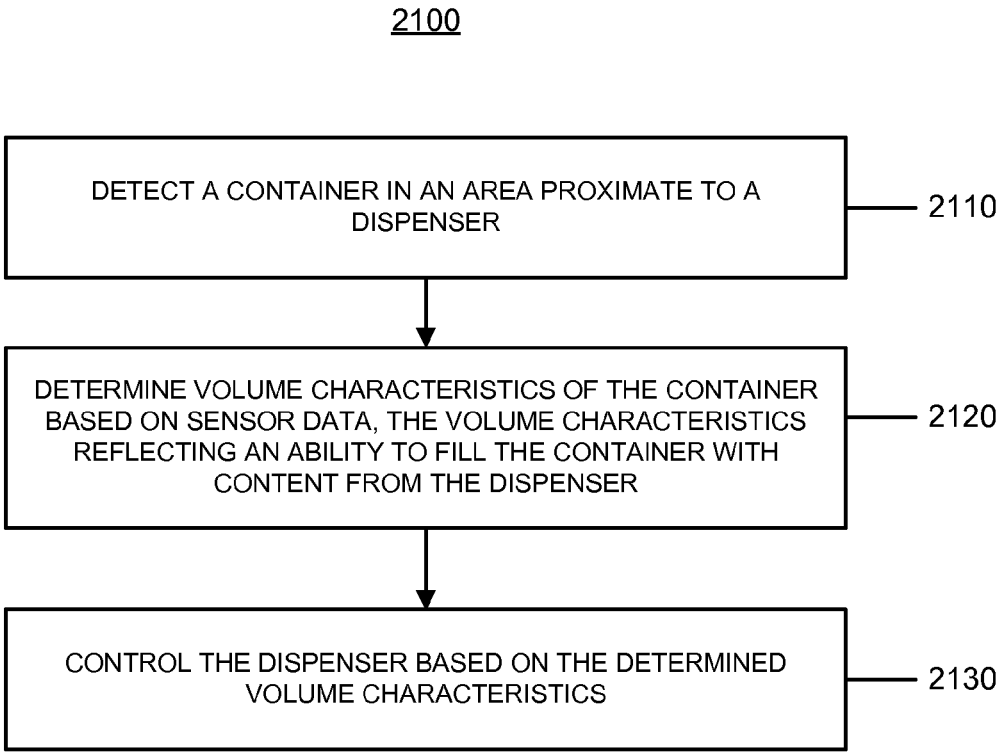

FIG. 21 illustrates an example of a process 2100 for controlling a dispenser based on volume characteristics of a container being filled by the dispenser. The operations of the process 2100 are described generally as being performed by the system 500. The operations of the process 2100 may be performed by any combination of the components of the system 500. In some implementations, operations of the process 2100 may be performed by one or more processors included in one or more electronic devices.

The system 500 detects a container in an area proximate to a dispenser (2110). The system 500 may detect a container in an area proximate to a dispenser using techniques similar to those discussed above with respect to numeral 1910 in FIG. 19.

The system 500 determines volume characteristics of the container based on sensor data (2120). The volume characteristics reflect an ability to fill the container with content from the dispenser. The system 500 may estimate volume characteristics of the container based on data from one or more sensors (e.g., any combination of the sensors discussed as being included in the detection unit 510 discussed above) that are configured to sense attributes of a container in an area proximate to a dispenser.

In some implementations, the system 500 may estimate measurements of a container detected in an area proximate to the dispenser and apply the estimated measurements to a volume calculation formula to estimate the volume of the container. For instance, the system 500 may estimate a width of a container, a length of the container, and a height of the container and multiply the estimated width, the estimated length, and the estimated height to estimate a volume of content the container is capable of receiving. When the container is shaped like a cylinder, the system 500 may estimate a radius of an opening of the cylindrical container and estimate a height of the container. Then, the system 500 may estimate the volume of the cylindrical container as the estimated radius squared multiplied by pi multiplied by the estimated height.

The system 500 may estimate measurements of a container using sensor data. For instance, any combination of one or more of the sensors described as being included in the detection unit 510 may be used to sense data that is used to estimate measurements of the container. The system 500 may use position detector sensors and/or optical interception detection devices to estimate measurements of the container. The system 500 may compute measurements of the container using multiple measurements of a position of the container from multiple sensors positioned in various places.

For example, a width of a container may be determined by two position detectors situated on opposite sides of a dispensing cavity. In this example, a first position detector measures a first distance from the first position detector to the container, a second position detector measures a second distance from the second position detector to the container, and the system 500 determines the width of the container by subtracting the first distance and the second distance from a known width between the first position detector and the second position detector (e.g., a known width of the dispensing cavity).

In another example, a height of a container may be determined by two optical interception detector devices situated along a side of a dispensing cavity and spaced apart in a vertical direction. In this example, a first optical interception detector device detects presence of a container at a first height of the first optical interception detector device, a second optical interception detector device detects a lack of presence of a container at a second height of the second optical interception detector device, and the system 500 determines the height of the container as being greater than the first height, but less than the second height.

The system 500 also may use one or more image based sensors (e.g., cameras) to capture one or more images of a container proximate to the dispenser and analyze the images to estimate measurements of the container. For example, the system 500 may detect a container in one or more images captured by the image based sensor and estimate measurements of the container based on the one or more images using image analysis techniques. In this example, the system 500 may compare aspects of a detected container to known reference points in the one or more images (e.g., detectable reference points that have known measurements, such as a container support in the one or more images) and estimate measurements of the container based on the comparison.

In some examples, the system 500 may be configured to identify non-container features or objects in an image and exclude the identified non-container features or objects in identifying measurements of the container. In these examples, the system 500 may compare features or objects in an image to reference images and exclude features or objects as being something other than the container. For instance, the system 500 may exclude background features of images taken by the image based sensor that are present in the background of all images captured by the image based sensor that do not include an object blocking the background feature. The system 500 also may exclude other recognizable, common features, such as a user's arm and hand holding a container. The system 500 may detect a user's arm and/or hand holding a container and remove that portion of the image from contributing to volume characteristics of the container.

The system 500 also may weigh a container in an area proximate to the dispenser. For instance, a container support may include a scale that measures a weight of objects (e.g., containers) placed on the container support. In this instance, the system 500 may estimate volume characteristics of a container based on a measured weight of a container. When two containers are made from the same material, the system 500 may estimate that the container that weighs more is capable of receiving a higher volume of content than the container that weighs less.

The system 500 further may determine an orientation of a container under an outlet as part of the volume characteristics. Specifically, because the volume characteristics reflect an ability to fill the container with content from the dispenser, the system 500 may detect an orientation of a container and determine whether the container is properly oriented to receive content from the dispenser.

The system 500 may determine volume characteristics of the container based on sensor data using techniques similar to those described below with respect to FIGS. 22 to 27. The system 500 may use any of the techniques described below with respect to FIGS. 22 to 27 and also may combine techniques described below with respect to FIGS. 22 to 27 with other techniques described throughout the disclosure.

The system 500 controls the dispenser based on the determined volume characteristics (2130). The system 500 may identify a volume of content that the container is capable of receiving based on the determined volume characteristics and prevent the dispenser from dispensing, into the container, more than the identified volume of content that the container is capable of receiving. The system 500 may set a recommended quantity of content to dispense based on the identified volume of content and enable a user to dispense the recommended quantity of content or adjust the recommended quantity of content.

The system 500 also may monitor volume characteristics of a container as the container is being filled by the dispenser and control the dispenser based on the monitored volume characteristics. For example, the system 500 may detect a container being removed from an area proximate to the dispenser as the dispenser is filling content into the container. In this example, the system 500 may determine that the volume characteristics of the container have changed to not being able to receive any content and, therefore, may stop dispensing content.

In another example, the system 500 may be filling a container that may be expanded and contracted to different sizes. In this example, the system 500 may detect the container being expanded or contracted during a dispensing operation, determine updated volume characteristics for the container based on the expansion or contraction of the container, and control the dispenser based on the updated volume characteristics. When the container is expanded, a volume that the container is capable of receiving is increased and the dispenser may be controlled to allow a user to dispense a greater quantity of content. When the container is contracted, a volume that the container is capable of receiving is decreased and the dispenser may be controlled to allow a user to dispense only a lower quantity of content.

The system 500 may output various status messages and/or alerts based on the determined volume characteristics. For instance, the system 500 may display a volume of content the container is estimated as being capable of receiving. The displayed estimated volume may be updated as the dispenser dispenses content into the container (e.g., decreased in a manner corresponding to the volume of content dispensed) to assist the user in determining how much more content the container is capable of holding. When a user sets a particular quantity of content to dispense that is greater than a volume of content the container is estimated as being capable of receiving, the system 500 may provide a warning message that indicates that the set quantity of content is greater than the volume of content the container is estimated as being capable of receiving. In addition, when a user is dispensing content, the system 500 may provide a warning message when the volume of content dispensed is approaching, reaches, or is greater than the volume of content the container is estimated as being capable of receiving. The warning message may alert the user that the volume of content the container is estimated as being capable of receiving will be exceeded shortly or has already been exceeded. The warning message also may warn the user that a spill may occur if the user continues to dispense content into the container. In some implementations, the system 500 may output warning messages or alerts based on the determined volume characteristics, but may not otherwise control the dispenser based on the determined volume characteristics. In these implementations, the system 500 may allow the user to ignore or avoid the determined volume characteristics of the container, even though the system 500 provides informational messages to the user indicating information related to the determined volume characteristics. The system 500 may allow the user to ignore the warning messages and alerts and control the dispenser in a manner that is contrary to the warning messages and alerts. The system 500 may allow the user to ignore the warning messages and alerts, but only after the user provides user input acknowledging the warning messages and alerts.

Figure 22:
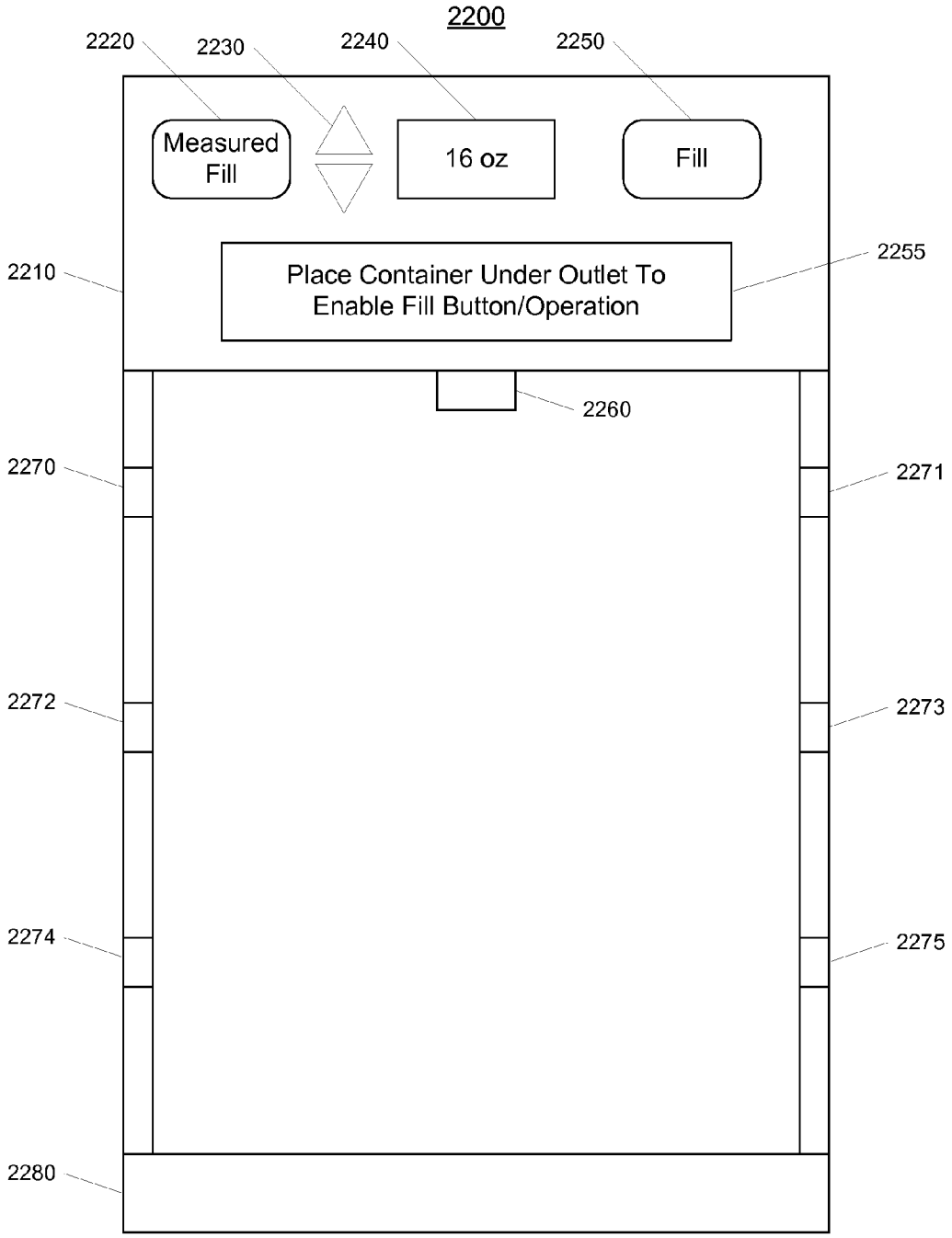
Figure 23:
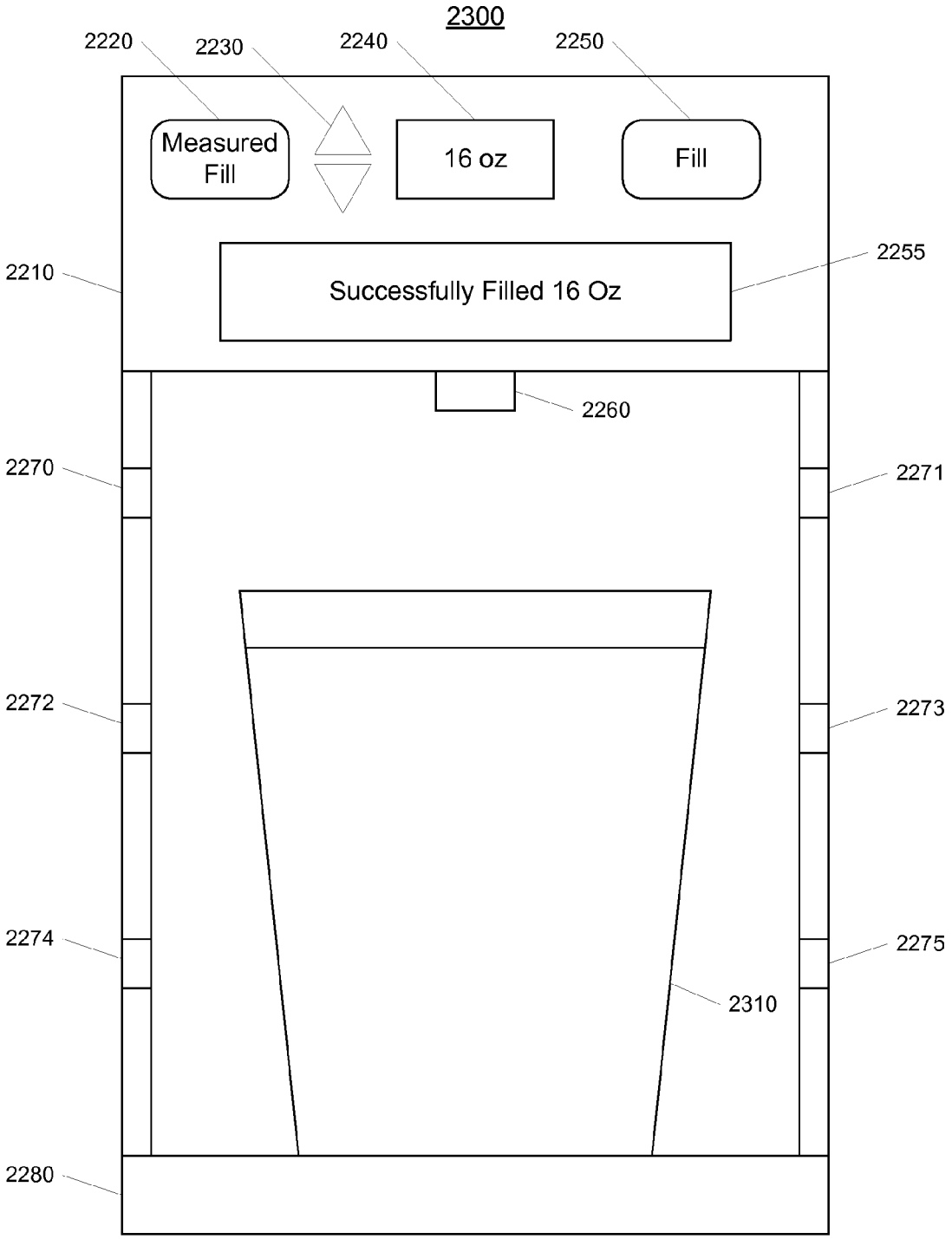
Figure 24:
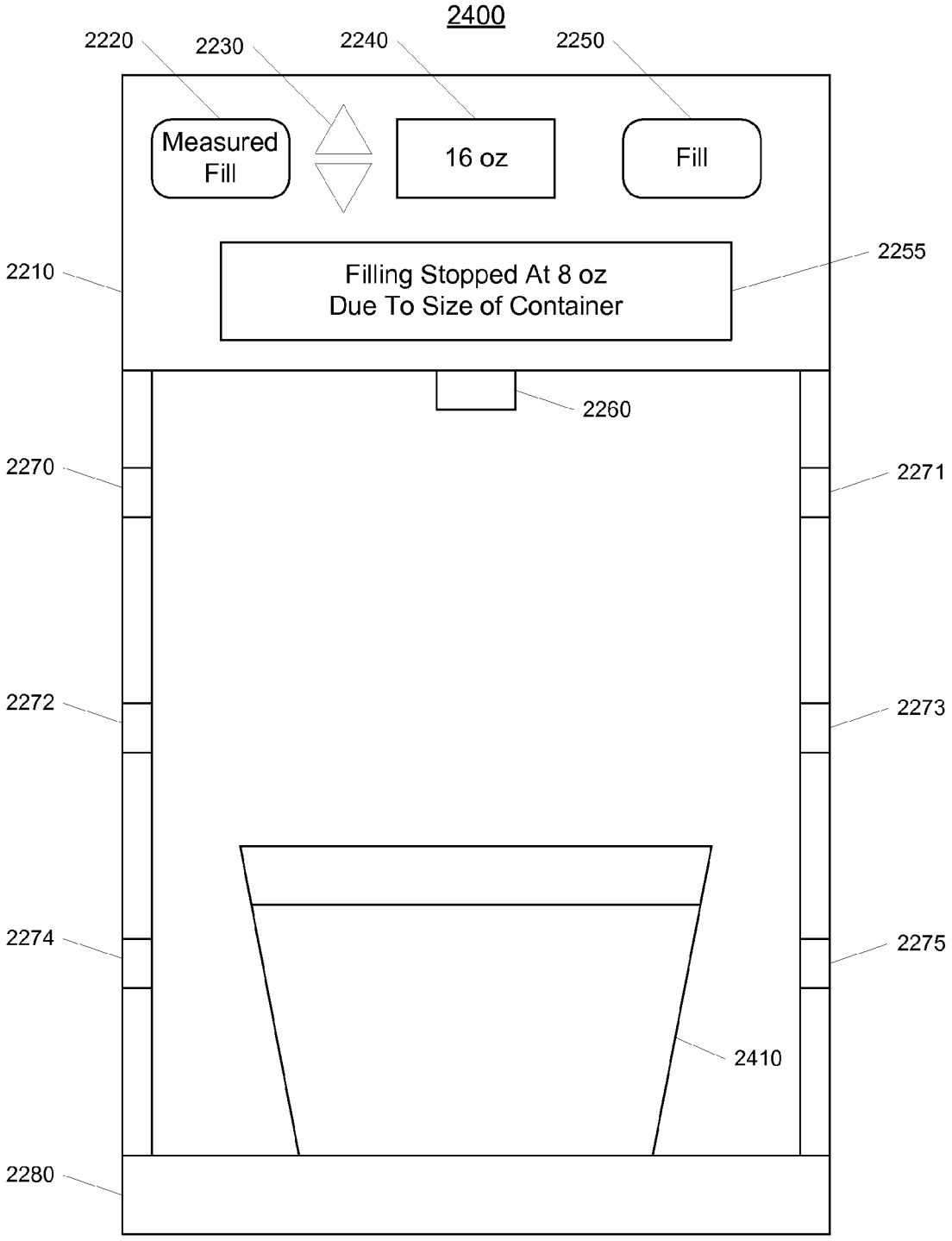

FIGS. 22-24 illustrate examples of a dispenser being controlled based on determined volume characteristics of a container. FIG. 22 illustrates a dispenser 2200 that includes an input area 2210, an outlet 2260, and a container support 2280. The input area 2210 includes a measured fill input button 2220, quantity control input buttons 2230, a display 2240, a fill input button 2250, and a display 2255. The measured fill input button 2220 causes the dispenser 2200 to set a particular quantity of content to dispense in response to the next command to dispense content that is received. The quantity control input buttons 2230 enable a user to adjust the particular quantity of content to dispense and the display 2240 displays the particular quantity of content to dispense. The fill input button 2250 causes the dispenser 2200 to dispense the particular quantity of content when pressed. The display 2255 displays a status message related to operation of the dispenser 2200.

The outlet 2260 may be similar to the outlet 720 and the outlet 1660 described above and the container support 2280 may be similar to the container support 740 and the container support 1680 described above. The dispenser 2200 also includes sensors 2270 to 2275 that are configured to sense attributes of a container positioned within a dispensing area or dispensing cavity of the dispenser 2200. The sensors 2270 to 2275 may be three optical interception detection devices, where each device is configured to detect whether an object is positioned in between a pair of sensor parts. Because the three optical interception detection devices are positioned at three different heights within the dispensing area or cavity, the sensors 2270 to 2275 may be able to detect (or estimate) a height of a container positioned within the dispensing area or cavity.

The sensors 2270 to 2275 also each may include a position detector that is configured to detect presence of an object within the dispensing area or cavity and detect a distance between the object and the sensor. Accordingly, when the sensors 2270 to 2275 each include a position detector, the sensors 2270 to 2275 may be able to detect (or estimate) a height of a container positioned within the dispensing area or cavity and further detect (or estimate) a width of a container positioned within the dispensing area or cavity based on the distance measured by the sensors 2270 to 2275. The sensor data captured by the sensors 2270 to 2275 may be used to determine volume characteristics of a container positioned proximate to the dispenser 2200 and the determined volume characteristics may be used to control operation of the dispenser 2200.

As shown in FIG. 22, a container is not present in an area proximate to the dispenser 2200. Accordingly, the sensors 2270 to 2275 detect that a container is not present within the dispensing area or cavity and the dispenser 2200 may be controlled based on the detection that a container is not present within the dispensing area or cavity (e.g., that volume characteristics indicate that zero volume of content may be received in a container). In this regard, the fill button 2250 may be disabled and the dispenser 2200 may be disabled from dispensing content because no container exists to receive content. The display 2255 may provide a status message that indicates that the dispenser 2200 is currently disabled and that the user needs to place a container under the outlet to enable operation of the dispenser 2200. For instance, the display 2255 may display a status message that instructs the user to "place a container under the outlet to enable the fill button and operation of the dispenser."

The dispenser 2200 may detect that no container is present prior to first receiving user input related to dispensing content and prevent the dispenser 2200 from dispensing any content in response to the user input related to dispensing content. In some examples, the dispenser 2200 may monitor for presence of a container (or changing volume characteristics) while the dispenser 2200 is dispensing content. In these examples, when the dispenser 2200 detects that a container is no longer present under the outlet 2260 while the dispenser 2200 is dispensing content, the dispenser 2200 may stop dispensing content in response to the detection that a container is no longer present under the outlet 2260 and provide a status message that a container needs to be placed under the outlet to continue dispensing. For instance, a user may place a container under the outlet 2260 and set a particular quantity of content to dispense using the measured fill input button 2220. After setting the particular quantity of content to dispense, the user may press the fill input button 2250 to begin dispensing the particular quantity of content into the container. As the dispenser 2200 is dispensing the particular quantity of the content, the container may be moved (e.g., moved by the user, inadvertently knocked over, etc.) and the dispenser 2200 may detect that a container is no longer present under the outlet 2260 (e.g., volume characteristics of the container have changed) and stop dispensing the particular quantity of the content. The dispenser 2200 may track the remaining quantity of content from the particular quantity that has not been dispensed and enable the user to control the dispenser 2200 to dispense the tracked quantity of content by replacing the container under the outlet 2260. The dispenser 2200 may dispense the tracked quantity of content automatically in response to the user replacing the container under the outlet 2260 or may wait for further user input to dispense the tracked quantity of content.

FIG. 23 illustrates an example of a dispenser 2300 in which a relatively large container 2310 has been placed under the outlet 2260. In this example, the sensors 2270 to 2275 detect presence of a container at the lower two levels of sensors (e.g., sensors 2272 to 2275 detect a container) and detect a lack of a container at the highest level of sensors (e.g., sensors 2270 and 2271 do not detect a container). Accordingly, the dispenser 2300 may determine that the container 2310 has a height from the container support 2280 that is between a height of the second level of sensors 2272 and 2273 and a height of the third level of sensors 2270 and 2271. Based on the determined height, the dispenser may estimate volume characteristics of the container 2310. For example, the dispenser 2300 may estimate that a container with a height that reaches the first level of sensors 2274 and 2275 is able to hold a volume of eight ounces of content, that a container with a height that reaches the second level of sensors 2272 and 2273 is able to hold a volume of sixteen ounces of content, and that a container with a height that reaches the third level of sensors 2270 and 2271 is able to hold a volume of twenty-four ounces of content. In this example, because the dispenser 2300 detects a height of the container 2310 as reaching the second level of sensors 2272 and 2273, but not the third level of sensors 2270 and 2271, the dispenser 2300 may estimate the volume of content that container 2310 is capable of holding as sixteen ounces.

In some implementations, the sensors 2270 to 2275 also may be configured to detect a distance between the sensors 2270 to 2275 and the container 2310. In these implementations, the dispenser 2300 may use the distance measurements to estimate a width of the container 2310 in addition to a height. The dispenser 2300 may use the estimated width in addition to the height in determining volume characteristics. For instance, when a different container that has the same height as the container 2310, but a narrower width is placed under the outlet 2260, the dispenser 2300 may determine that the different container is capable of holding less content (e.g., twelve ounces) than the container 2310. In addition, the dispenser 2300 may account for differences in widths detected by sensors at different levels in determining volume characteristics. In this regard, the dispenser 2300 may determine that a stemmed wine glass that has the same height as the container 2310 is capable of holding less content (e.g., eight ounces) than the container 2310 because the dispenser 2300 detects the stemmed portion of the wine glass as having a very narrow width and attributes little or no volume to the stemmed portion of the wine glass.

The dispenser 2300 controls dispensing operations based on the estimated volume characteristics of the container 2310. As shown, a user has controlled the dispenser 2300 to dispense a set quantity of content of sixteen ounces. Because the estimated volume characteristics of the container 2310 indicate that the container 2310 is capable of holding sixteen ounces, the dispenser 2300 allows the entire sixteen ounces to be dispensed into the container 2310. The dispenser 2300 also may update the display 2255 to provide a status message that all sixteen ounces were filled successfully.

FIG. 24 illustrates an example of a dispenser 2400 in which a relatively small container 2410 has been placed under the outlet 2260. In this example, the sensors 2270 to 2275 detect presence of a container at the lowest level of sensors (e.g., sensors 2274 and 2275 detect a container) and detect a lack of a container at the highest two levels of sensors (e.g., sensors 2270 to 2273 do not detect a container). Accordingly, the dispenser 2400 may determine that the container 2410 has a height from the container support 2280 that is between a height of the first level of sensors 2274 and 2275 and a height of the second level of sensors 2272 and 2273. Based on the determined height, the dispenser may estimate volume characteristics of the container 2410. In the example described above in estimating that the container 2310 is capable of holding sixteen ounces of content, because the dispenser 2400 detects a height of the container 2410 as reaching the first level of sensors 2274 and 2275, but not the second level of sensors 2272 and 2273, the dispenser 2400 may estimate the volume of content that container 2410 is capable of holding as eight ounces.

The dispenser 2400 controls dispensing operations based on the estimated volume characteristics of the container 2410. As shown, a user has controlled the dispenser 2400 to dispense a set quantity of content of sixteen ounces. In contrast to the example shown in FIG. 23, the estimated volume characteristics of the container 2410 indicate that the container 2410 is not capable receiving the entire quantity of content set to be dispensed and the dispenser 2400 controls dispensing operations accordingly. Specifically, because the estimated volume characteristics of the container 2410 indicate that the container 2410 is capable of holding eight ounces, the dispenser 2400 stops dispensing content after eight ounces of content have been dispensed and does not dispense the entire sixteen ounces set by the user. The dispenser 2400 also may update the display 2255 to provide a status message that dispensing was stopped at eight ounces due to the size of the container.

In some examples, the dispenser 2400 may control dispensing operations based on the estimated volume characteristics of the container 2410 using other techniques. For instance, because the estimated volume characteristics of the container 2410 indicate that the container 2410 is capable of holding eight ounces, the dispenser 2400 may prevent a user from setting a quantity of content to dispense that is greater than eight ounces. Also, the dispenser 2400 may allow the user to dispense a quantity of content that is greater than eight ounces, but provide an alert message (e.g., an audible and/or displayed alert message) when the user attempts to dispense a quantity of content that is greater than eight ounces and, thereby, provide the user with an opportunity to decrease the quantity of content prior to dispensing. The alert message may indicate that the container 2410 is not be capable of holding the quantity of content set to be dispensed and also may require the user to provide additional user input to cause the set quantity of content that is greater than eight ounces to be dispensed.

Figure 25:
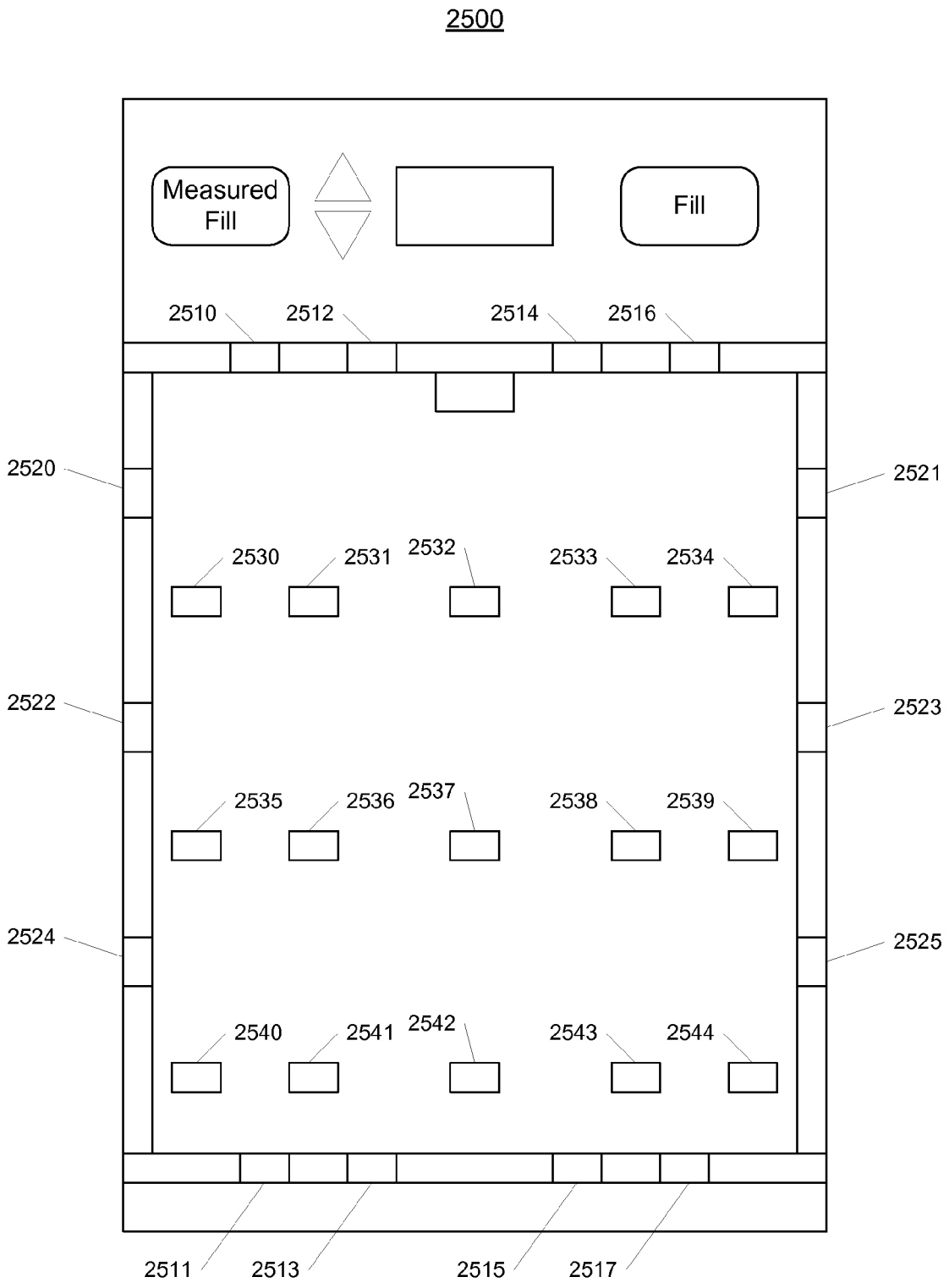
Figure 26:
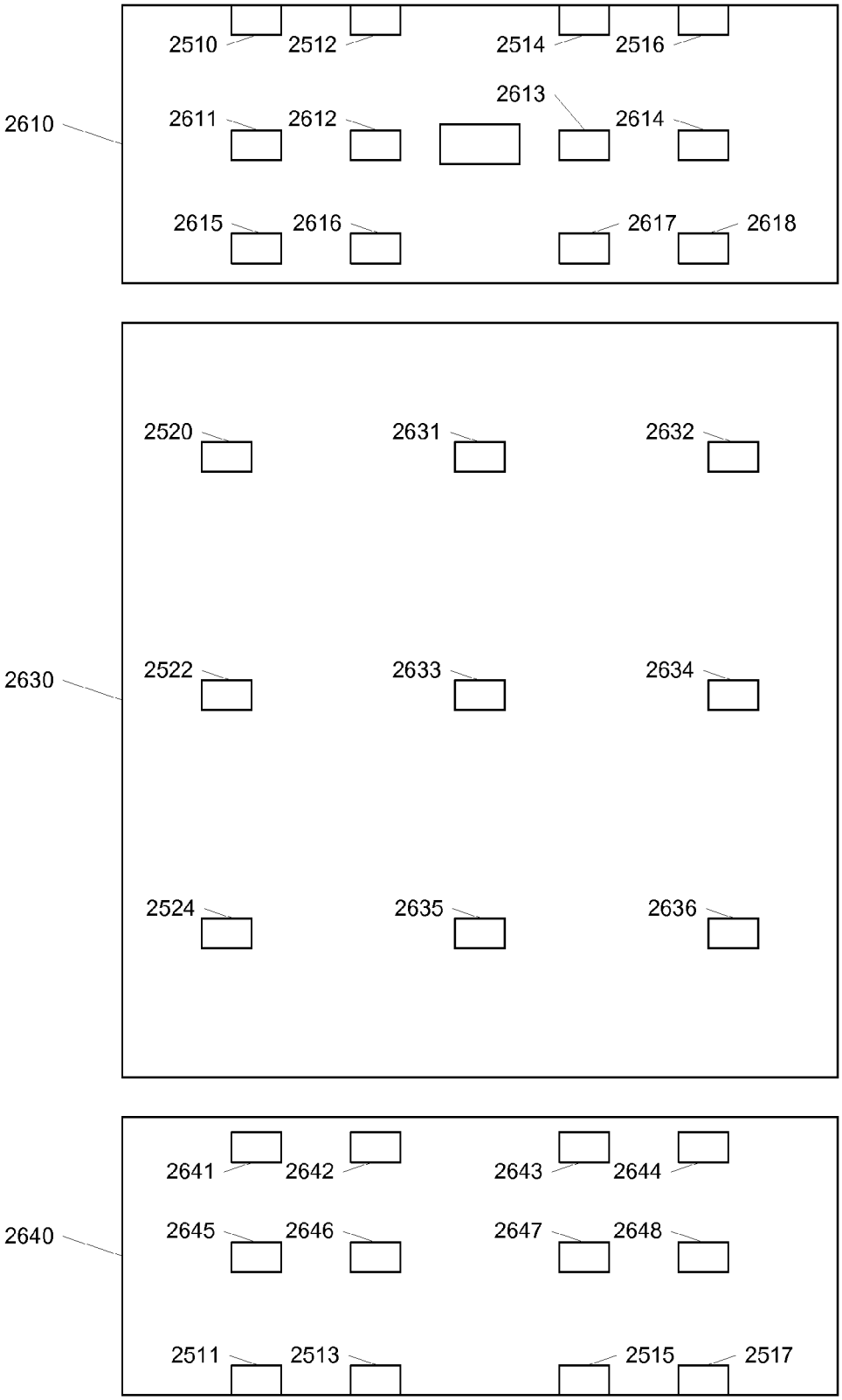

FIGS. 25-26 illustrate an example of a sensor arrangement that is configured to collect sensor data that enables determination of volume characteristics of a container. The sensor arrangement may include a grid of sensors (e.g., multiple rows and multiple columns of sensors) at each surface that defines a dispensing area or cavity. Although the dispenser 2500 is shown as having a dispensing cavity that has five surfaces (e.g., a top surface, a bottom surface, two side surfaces, and a back surface), other implementations may have a dispensing area or cavity defined by more or fewer surfaces (e.g., a dispensing area defined by a top surface, a bottom surface, and a back surface, but no side surfaces). In addition, other implementations may include a grid of sensors on less than all of the surfaces that define the dispensing area or cavity.

As shown, the dispenser 2500 includes sensors 2510, 2512, 2514, and 2516 on a top surface (e.g., an outlet housing) that defines a top of a dispensing cavity, sensors 2511, 2513, 2515, and 2517 on a bottom surface (e.g., a container support) that defines a bottom of the dispensing cavity, sensors 2520, 2522, and 2524 on a first side surface that defines a first side of the dispensing cavity, sensors 2521, 2523, and 2525 on a second side surface that defines a second side of the dispensing cavity, and sensors 2530 to 2544 on a back surface that defines a back of the dispensing cavity. The sensors 2530 to 2544 are shown in FIG. 25 as a grid of sensors arranged across the back surface.

Referring to FIG. 26, a top surface 2610 of the dispenser 2500 that defines a top of the dispensing cavity is shown. The top surface 2610 includes sensors 2510, 2512, 2514, 2516, and 2611 to 2618 that are arranged in a grid across the top surface. A first side surface 2630 includes sensors 2520, 2522, 2524, and 2631 to 2636 that are arranged in a grid across the first side surface. The second side surface may have a similar sensor arrangement as the first side surface in which a grid of sensors is arranged across the second side surface. A bottom surface 2640 includes sensors 2511, 2513, 2515, 2517, and 2641 to 2648 that are arranged in a grid across the bottom surface.

The sensors shown in FIGS. 25 and 26 may be any type of sensor described throughout this disclosure. For example, the sensors may be pairs of sensor parts that represent optical interception detection devices (e.g., the sensor 2510 and the sensor 2511 may be a pair of sensor parts that represents an optical interception detection device). The sensors also may be position detectors that are configured to detect presence of an object within the dispensing cavity and detect a distance between the object and the sensor. In some implementations, the sensors may include multiple, different types of sensors. For example, the sensors on the back surface (i.e., sensors 2530 to 2544) may be position detectors because a surface of the dispensing cavity opposite of the back surface does not exist and all of the other sensors may be pairs of sensor parts that represent optical interception detection devices because all of the other surfaces have a corresponding surface of the dispensing cavity on the opposite side of the cavity.

Because the sensors shown in FIGS. 25 and 26 are arranged in grids on each surface of the dispensing cavity, the sensors to may be used estimate measurements of a container positioned within the dispensing cavity in three dimensions (e.g., a height of a container, a width of the container, and a depth of the container). The measurements taken in three dimensions may be used to estimate volume characteristics of a container. For instance, the estimated height measurement, the estimated width measurement, and the estimated depth measurement may be multiplied together to compute an estimated volume of the container.

In some implementations, because the sensors shown in FIGS. 25 and 26 are arranged in grids on each surface of the dispensing cavity, the sensors to may be used to estimate a shape of a container positioned within the dispensing cavity on each side of the container. The volume characteristics of the container may be determined based on the determined shape of the container. For example, the sensor data may be used to identify multiple, small segments of the container and the volume for each identified segment may be determined (e.g., by multiplying an estimated height, width, and depth of the segment) and added together to compute an estimated volume of the container. In another example, the sensor data may be used to determine a maximum volume of a container by multiplying a maximum, estimated height, width, and depth of the container to compute a maximum volume of the container. In this example, the sensor data may be used to identify portions within the maximum volume where the container is not present. An estimated volume for each identified portion may be subtracted from the maximum volume to compute the volume of the container.

Figure 27:
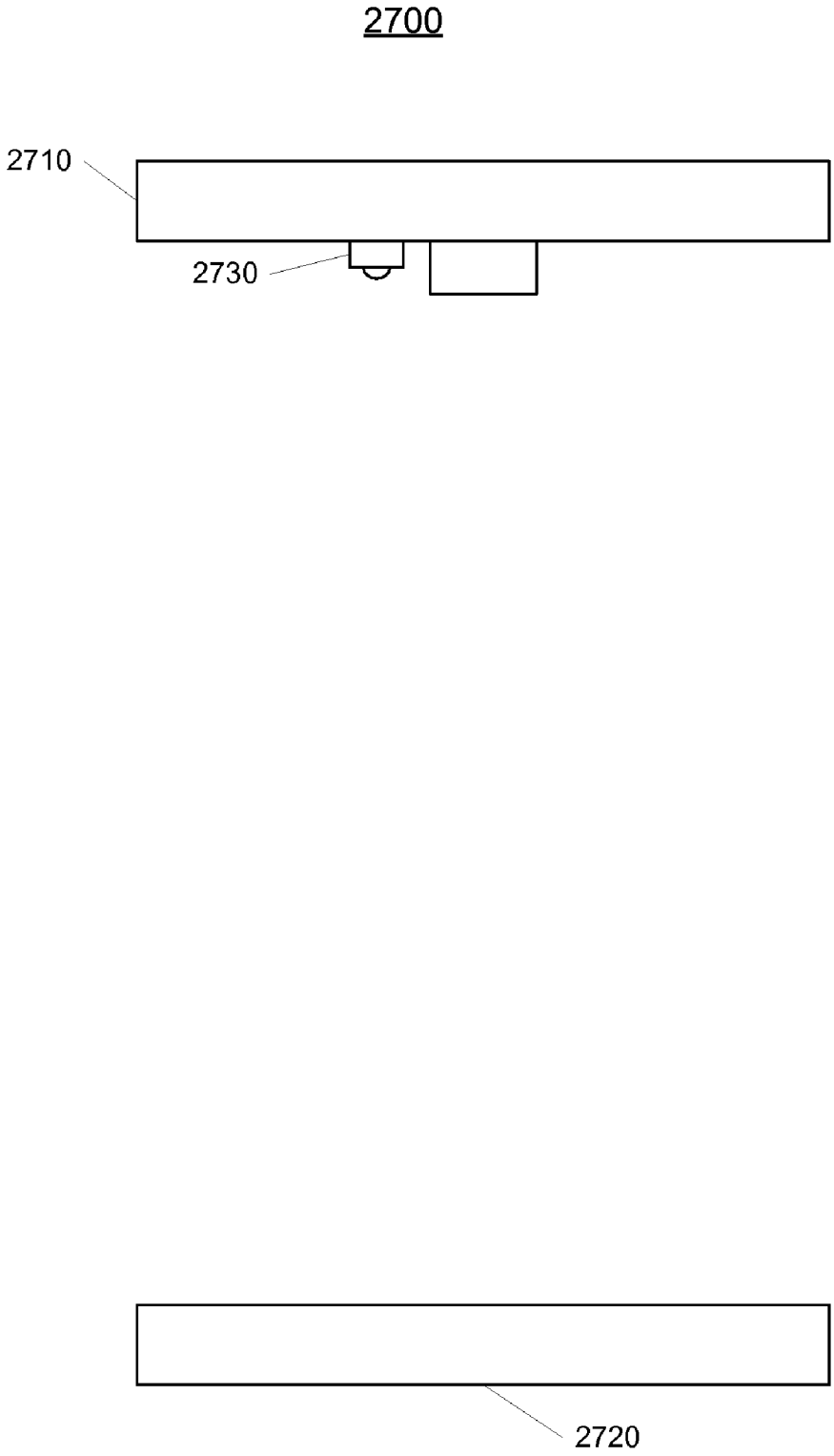

FIG. 27 illustrates an example of an image sensor arrangement that is configured to collect image data that enables determination of volume characteristics of a container. A dispenser 2700 may include an outlet housing 2710, a container support 2720, and a camera 2730. The outlet housing 2710 may be similar to the outlet housing 710 described above with respect to FIG. 7 and the container support 2720 may be similar to the container support 740 described above with respect to FIG. 7. The camera 2730 is supported by the outlet housing 2710 and oriented to capture images of a dispensing area or cavity of the dispenser 2700. For instance, the camera 2730 may be oriented to capture images of an area under the outlet of the dispenser 2700. The camera 2730 may be a digital camera and may be configured to capture single images of the dispensing area or may be a video camera that is configured to capture a series of images of the dispensing area over time.

The dispenser 2700 may use images captured by the camera 2730 to determine volume characteristics of a container positioned within a dispensing area or cavity defined by the dispenser 2700. The dispenser 2700 may process images captured by the camera 2730 using image analysis techniques that determine measurements of objects within images. In some implementations, the dispenser 2700 may be calibrated based on images of background items captured by the camera 2730. In these implementations, the dispenser 2700 may use known distances/measurement of portions of the dispenser 2700 that are included within images captured by the camera 2730 to assist in determining measurements and/or an estimated volume of a container positioned within a dispensing area or cavity. For instance, the dispenser 2700 may use known features as reference points (e.g., an edge of the dispenser cavity, the container support 2720, etc.) that are compared to features of a container within the same image and used to determine measurements and/or an estimated volume of the container.

Images captured by the camera 2730 also may be used to determine movement of a container with respect to the dispensing area or cavity. For example, the dispenser 2700 may compare a series of images taken over a period of time and compare the position of a container in successive images to determine movement of the container. The determined movement of the container may be used in controlling the dispenser 2700.

Although a single camera 2730 is shown in FIG. 27, multiple cameras at a variety of positions in the dispenser 2700 may be used to capture additional image data of a container. Images from the multiple cameras may be analyzed together to determine volume characteristics of the container. The camera 2730 also may be positioned in other locations within the dispenser 2700. For example, the camera 2730 may positioned and supported by the container support 2720 or may be positioned at another surface (e.g., a back surface) of the dispensing area or cavity of the dispenser 2700.

Figure 28:
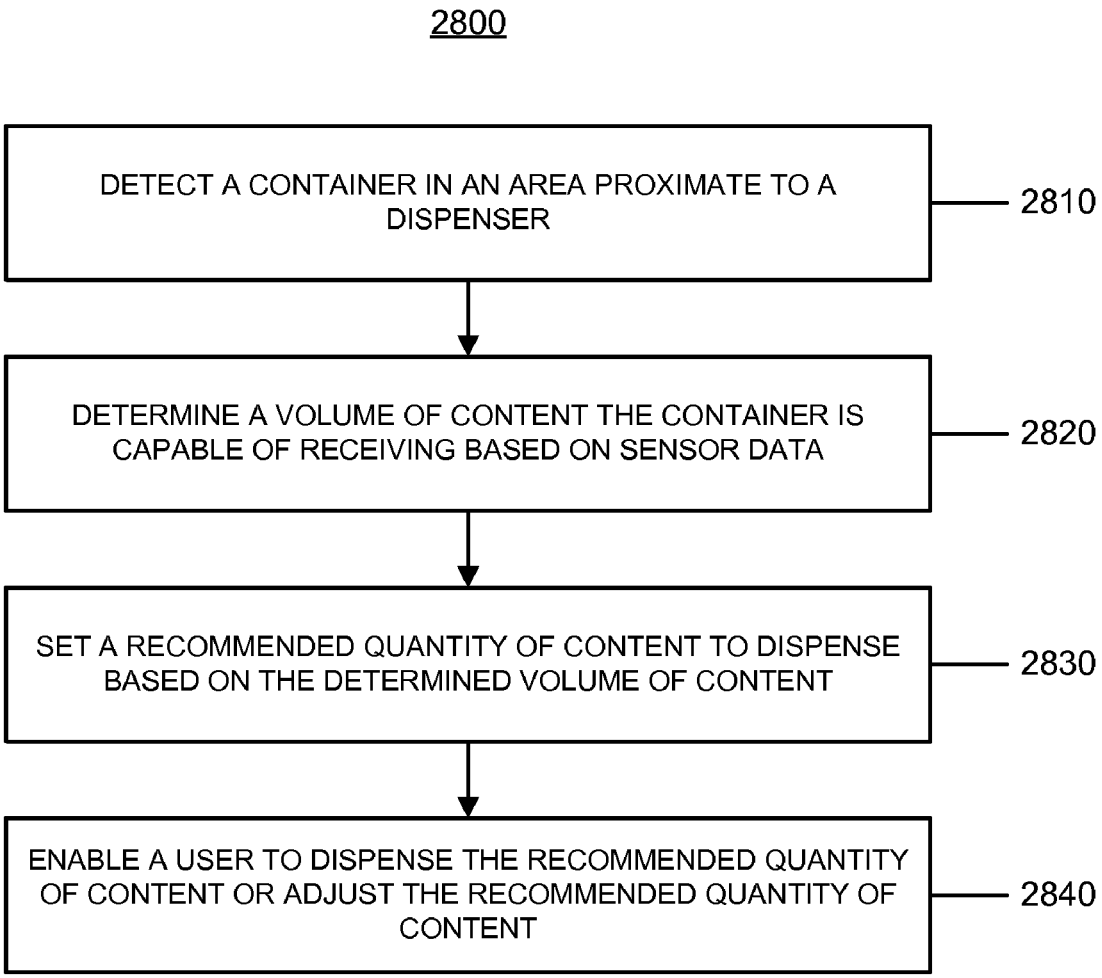

FIG. 28 illustrates an example of a process 2800 for setting a recommended quantity of content to dispense based on a determined volume of content of a container. The operations of the process 2800 are described generally as being performed by the system 500. The operations of the process 2800 may be performed by any combination of the components of the system 500. In some implementations, operations of the process 2800 may be performed by one or more processors included in one or more electronic devices.

The system 500 detects a container in an area proximate to a dispenser (2810). The system 500 may detect a container in an area proximate to a dispenser using techniques similar to those discussed above with respect to numeral 1910 in FIG. 19 and reference numeral 2110 in FIG. 21.

The system 500 determines a volume of content the container is capable of receiving based on sensor data (2820). The system 500 may determine a volume of content the container is capable of receiving based on sensor data using techniques similar to those discussed above with respect to reference numeral 2110 in FIG. 21.

The system 500 sets a recommended quantity of content to dispense based on the determined volume of content (2830). When a user presses a measured fill input button, the system 500 may set a quantity to dispense in response to the measured fill input command based on the determined volume of content. For example, the system 500 may set the quantity of content equal to the determined volume content. In this example, when the system 500 determines that a container is capable of receiving a relatively small volume of content, the system 500 may set the recommended quantity of content to a relatively small volume of content automatically, without user intervention, in response to a measured fill command. Alternatively, when the system 500 determines that a container is capable of receiving a relatively large volume of content, the system 500 may set the recommended quantity of content to a relatively large volume of content automatically, without user intervention, in response to a measured fill command.

The system 500 enables a user to dispense the recommended quantity of content or adjust the recommended quantity of content (2840). For example, the system 500 may dispense the recommended quantity of content in response to a user input command to dispense content. In this example, when the system 500 receives the user input command to dispense content, the controller 560 may control the dispenser 550 to dispense the recommended quantity of content (e.g., water) by monitoring an amount or volume of content dispensed by the dispenser and stopping the dispenser from dispensing content when the monitored amount or volume of content reaches the recommended quantity of content.

In addition, the system 500 may enable a user to modify the recommended quantity of content (e.g., increase or decrease the recommended quantity of content). In some examples, the system 500 sets the recommended quantity of content as a maximum volume of content the container is determined to be capable of holding. In these implementations, the user may only be able to decrease the recommended quantity of content. The system 500 may enable the user to dispense the adjusted quantity of content.

Figure 29:
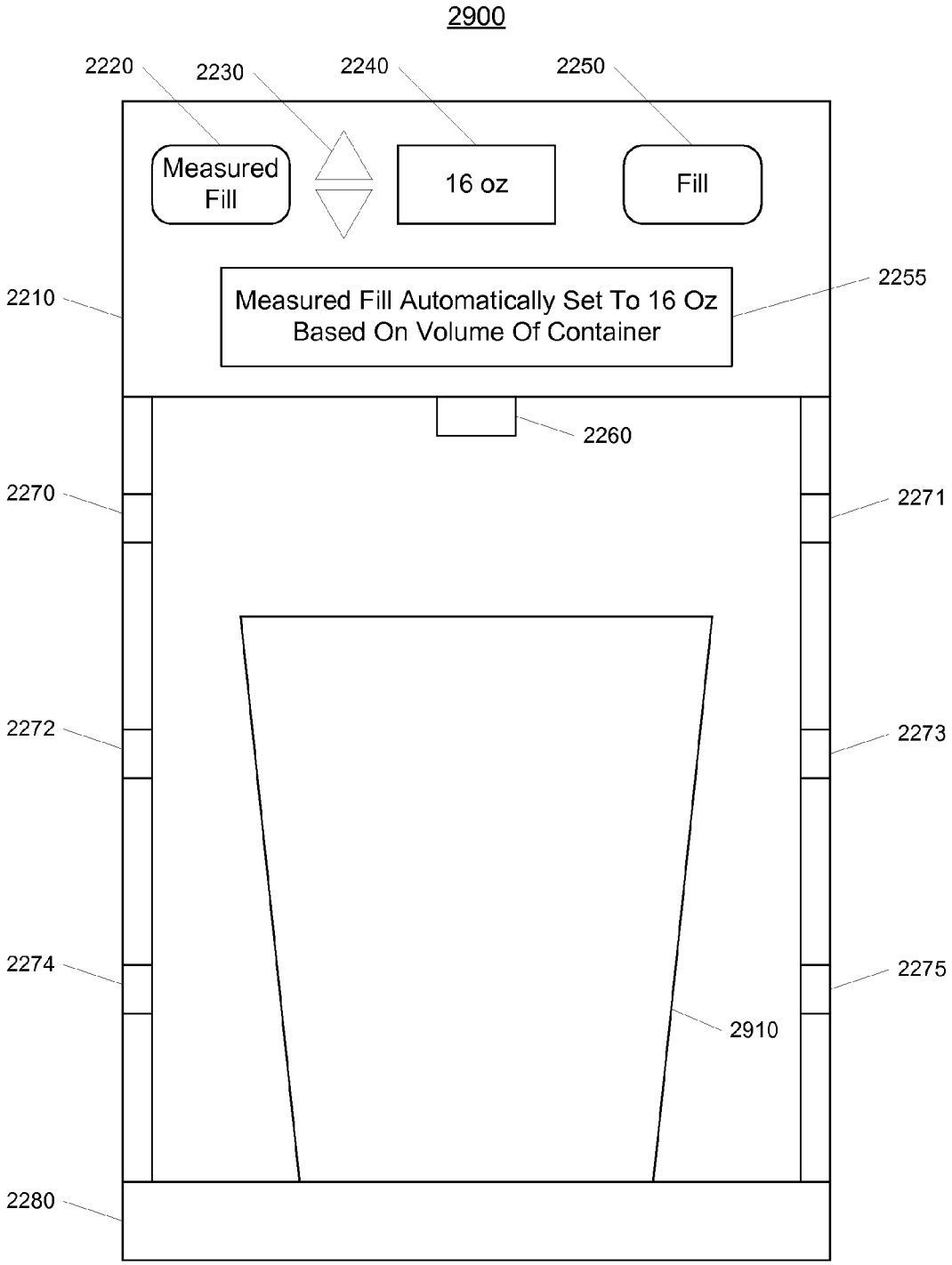
Figure 30:
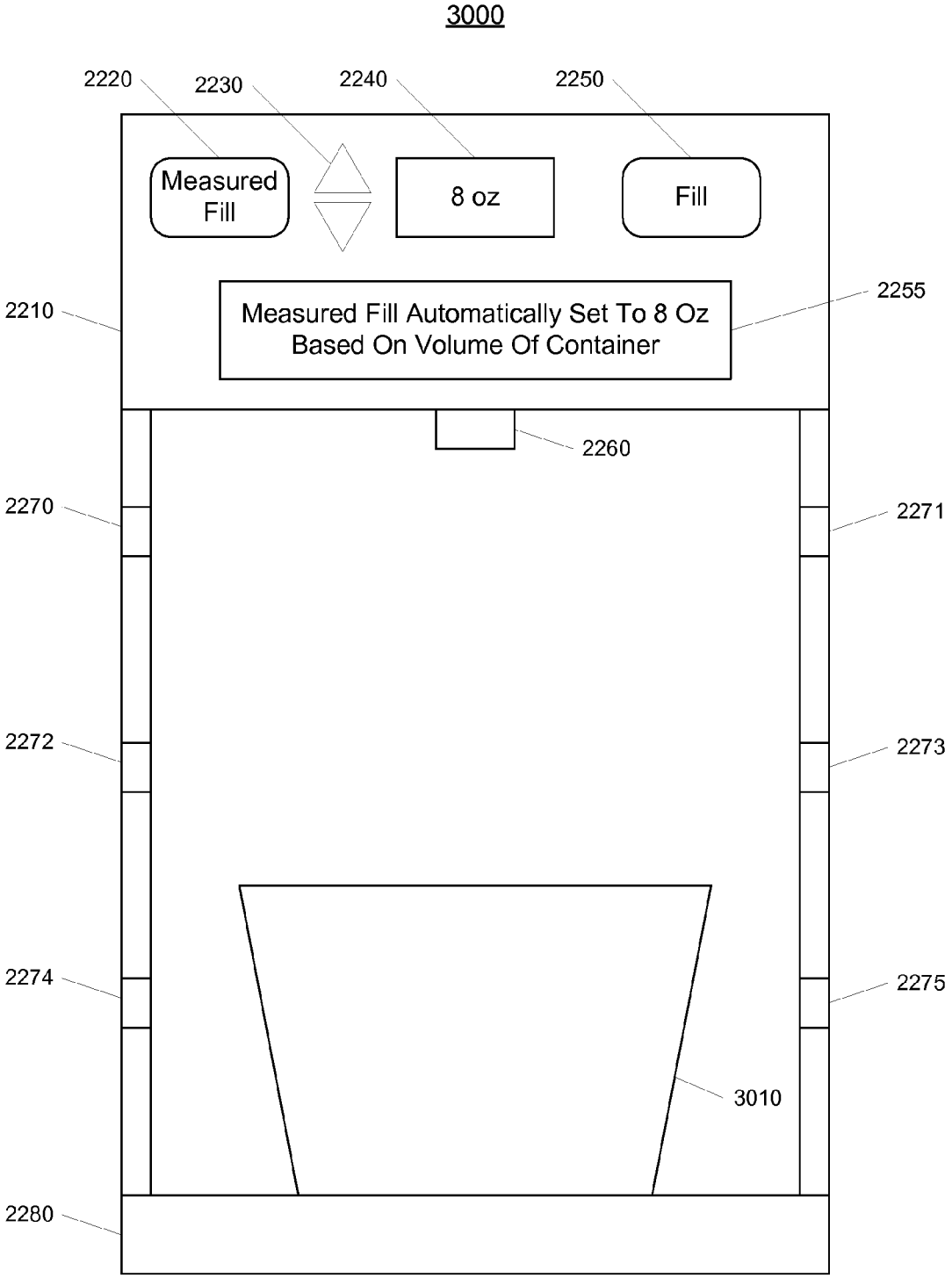

FIGS. 29-30 illustrate examples of setting a recommended quantity of content to dispense based on a determined volume of content of a container. FIG. 29 illustrates an example of a dispenser 2900 in which a relatively large container 2910 has been placed under the outlet 2260. In this example, the sensors 2270 to 2275 detect presence of a container at the lower two levels of sensors (e.g., sensors 2272 to 2275 detect a container) and detect a lack of a container at the highest level of sensors (e.g., sensors 2270 and 2271 do not detect a container). Accordingly, the dispenser 2900 may determine that the container 2910 has a height from the container support 2280 that is between a height of the second level of sensors 2272 and 2273 and a height of the third level of sensors 2270 and 2271. Based on the determined height, the dispenser may estimate volume characteristics of the container 2910. For example, the dispenser 2900 may estimate that a container with a height that reaches the first level of sensors 2274 and 2275 is able to hold a volume of eight ounces of content, that a container with a height that reaches the second level of sensors 2272 and 2273 is able to hold a volume of sixteen ounces of content, and that a container with a height that reaches the third level of sensors 2270 and 2271 is able to hold a volume of twenty-four ounces of content. In this example, because the dispenser 2900 detects a height of the container 2910 as reaching the second level of sensors 2272 and 2273, but not the third level of sensors 2270 and 2271, the dispenser 2900 may estimate the volume of content that container 2910 is capable of holding as sixteen ounces.

In some implementations, the sensors 2270 to 2275 also may be configured to detect a distance between the sensors 2270 to 2275 and the container 2910. In these implementations, the dispenser 2900 may use the distance measurements to estimate a width of the container 2910 in addition to a height. The dispenser 2900 may use the estimated width in addition to the height in determining volume characteristics. For instance, when a different container that has the same height as the container 2910, but a narrower width is placed under the outlet 2260, the dispenser 2900 may determine that the different container is capable of holding less content (e.g., twelve ounces) than the container 2910. In addition, the dispenser 2900 may account for differences in widths detected by sensors at different levels in determining volume characteristics. In this regard, the dispenser 2900 may determine that a stemmed wine glass that has the same height as the container 2910 is capable of holding less content (e.g., eight ounces) than the container 2910 because the dispenser 2900 detects the stemmed portion of the wine glass as having a very narrow width and attributes little or no volume to the stemmed portion of the wine glass.

The dispenser 2900 sets a recommended quantity of content based on the estimated volume characteristics of the container 2910. As shown, a user has pressed the measured fill input button 2220. Because the estimated volume characteristics of the container 2910 indicate that the container 2910 is capable of holding sixteen ounces, the dispenser 2900 automatically, without human intervention, sets a recommended quantity of content to sixteen ounces and displays the recommended quantity of content (e.g., sixteen ounces) in the display 2240. The dispenser 2900 also may update the display 2255 to provide a status message that indicates that the measured fill has been automatically set to sixteen ounces based on the volume of the container.

FIG. 30 illustrates an example of a dispenser 3000 in which a relatively small container 3010 has been placed under the outlet 2260. In this example, the sensors 2270 to 2275 detect presence of a container at the lowest level of sensors (e.g., sensors 2274 and 2275 detect a container) and detect a lack of a container at the highest two levels of sensors (e.g., sensors 2270 to 2273 do not detect a container). Accordingly, the dispenser 3000 may determine that the container 3010 has a height from the container support 2280 that is between a height of the first level of sensors 2274 and 2275 and a height of the second level of sensors 2272 and 2273. Based on the determined height, the dispenser may estimate volume characteristics of the container 3010. In the example described above in estimating that the container 2910 is capable of holding sixteen ounces of content, because the dispenser 3000 detects a height of the container 3010 as reaching the first level of sensors 2274 and 2275, but not the second level of sensors 2272 and 2273, the dispenser 3000 may estimate the volume of content that container 3010 is capable of holding as eight ounces.

The dispenser 3000 sets a recommended quantity of content based on the estimated volume characteristics of the container 3010. As shown, a user has pressed the measured fill input button 2220. Because the estimated volume characteristics of the container 3010 indicate that the container 3010 is capable of holding eight ounces, the dispenser 3000 automatically, without human intervention, sets a recommended quantity of content to eight ounces and displays the recommended quantity of content (e.g., eight ounces) in the display 2240. The dispenser 3000 also may update the display 2255 to provide a status message that indicates that the measured fill has been automatically set to eight ounces based on the volume of the container. By automatically setting a recommended quantity of content to dispense based on a determined volume of a container, a user's experience may be enhanced because the user may be able to more quickly set a desirable quantity of content to dispense, particularly when the user often fills containers of varying sizes.

Figure 31:
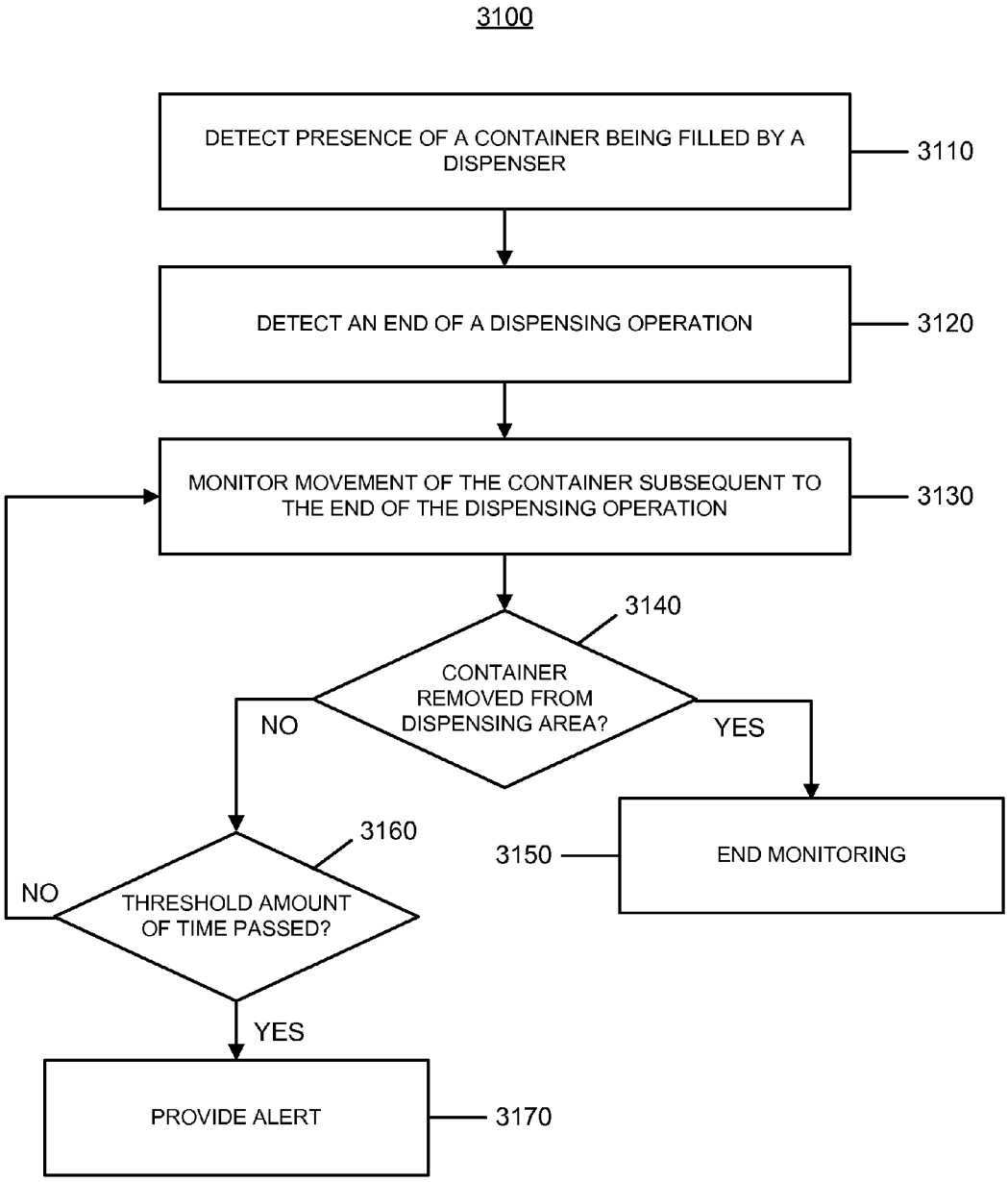

FIG. 31 illustrates an example of a process 3100 for providing an alert when a container remains in a dispensing area for more than a threshold period of time. The operations of the process 3100 are described generally as being performed by the system 500. The operations of the process 3100 may be performed by any combination of the components of the system 500. In some implementations, operations of the process 3100 may be performed by one or more processors included in one or more electronic devices.

The system 500 detects presence of a container being filled by a dispenser (3110). The system 500 may detect a container being filled by a dispenser using techniques similar to those discussed above with respect to numeral 1910 in FIG. 19 and reference numeral 2110 in FIG. 21.

The system 500 detects an end of a dispensing operation (3120). For instance, the system 500 may detect that the dispenser has stopped dispensing content based on user input. When user input was received to cause the dispenser to dispense a particular quantity of content, the system 500 may detect when the dispenser has completed dispensing the particular quantity of content. When a user is providing user input to manually control the dispenser to dispense content (e.g., the user is pressing and holding a fill button, the user is pressing a container against a dispenser control lever or pad, etc.), the system 500 may detect when the user has stopped providing user input to manually control the dispenser to dispense content (e.g., detect when the user releases a fill button or a dispensing control pad or lever). The system 500 may detect the end of a dispensing operation by monitoring user input provided by the user, by monitoring control signals related to controlling the dispenser, and/or by monitoring content flow from the dispenser.

The system 500 monitors movement of the container subsequent to the end of the dispensing operation (3130). For example, after detecting the end of the dispensing operation, the system 500 may access and analyze sensor data from one or more sensors configured to sense whether a container is in an area proximate to the dispenser. Based on the sensor data, the system 500 may track movement of the container or whether the container remains stationary and positioned in the area proximate to the dispenser. The system 500 may use any type of sensor data described throughout the disclosure to monitor movement of the container.

The system 500 determines whether container has been removed from a dispensing area based on the monitoring (3140). The system 500 may analyze the tracked movement of the container (if any) after the end of the dispensing operation and, based on the analysis, determines whether the container has been removed from the dispensing area. For instance, the system 500 may determine that the container has been removed from the dispensing area when the system 500 detects absence of a container in the dispensing area at a point after the end of the dispensing operation or when the system 500 tracks movement of the container from a position within the dispensing area to a position outside of the dispensing area. The system 500 may determine that the container has not been removed from the dispensing area when the system 500 detects presence of a container in the dispensing area at all points of monitoring for a container after the end of the dispensing operation. The system 500 also may detect that the container has not been removed from the dispensing area when the system 500 detects that the container has remained stationary after the dispensing operation based on tracked movement of the container.

In response to a determination that the container has been removed from the dispensing area, the system 500 ends monitoring (3150). The system 500 may end monitoring by stopping monitoring sensor data related to the particular container filled during the dispensing operation. The system 500 may update, in electronic storage, electronic state information of the system 500 to indicate that a filled container does not remain in the dispensing area or that no container is positioned in the dispensing area. Based on the updated state information, the system 500 may monitor for a new container being moved into the dispensing area, instead of monitoring for removal of the particular container filled during the dispensing operation from the dispensing area.

In response to a determination that the container has not been removed from the dispensing area, the system 500 determines whether a threshold period of time has passed since the end of the dispensing operation (3160). The system 500 may compare a time from when the dispensing operation ended to a threshold amount of time and make the determination based on the comparison. The threshold amount of time may be set to a time by which a user typically would have removed a container from a dispensing area after ending a dispensing operation. For instance, the threshold amount of time may be set to thirty seconds or one minute.

In response to a determination that the threshold period of time has passed since the end of the dispensing operation, the system 500 provides an alert (3170). For example, the system 500 displays (or otherwise outputs) an alert message that indicates that a container remains in the dispensing area after the end of the dispensing operation is detected. The system 500 may audibly output the alert message using a speaker or may provide an audible output (e.g., a beep) in combination with a displayed alert message to attempt to draw attention of a user to the alert message. The alert message may indicate that the container remaining in the dispensing area is filled with content, may indicate that the container has remained in the dispensing area for a threshold period of time after the end of a dispensing operation, and may indicate the amount of time that the container has remained in the dispensing area after the end of a dispensing operation.

Providing an alert may be helpful to a user because the user may have forgotten that the container remains in the dispensing area. Because the container is filled with content, leaving the container in the dispensing area may risk inadvertent spilling of the content in the container and/or breaking of the container if the container is knocked from the dispensing area. For instance, a parent of a small child may inadvertently leave a container resting on a container support after performing a dispensing operation. By inadvertently leaving the container resting on the container support, the parent has created a risky situation because the small child may knock the container from the container support, which may cause the content in the container to spill, may cause the container to break, and/or may cause an injury to the small child (e.g., a portion of the container striking the small child) or an otherwise unsafe situation (e.g., a wet floor from spilled content, broken glass on the floor, etc.). Providing the alert may assist the parent in identifying the risky situation and taking action to correct the risky situation.

In response to a determination that the threshold period of time has not passed since the end of the dispensing operation, the system 500 continues to monitor movement of the container subsequent to the end of the dispensing operation.

Although FIG. 31 describes providing an alert in connection with an end of a dispensing operation, the system 500 also may provide alerts when a container remains in a dispensing area or cavity for a threshold period of time, irrespective of a dispensing operation. In this regard, instead of measuring a time from an end of a dispensing operation, the system 500 may measure a time from when a container is placed in the dispensing area or cavity and compare the measured time to a threshold period of time. Based on the comparison, the system 500 may determine whether the container has been placed in the dispensing area or cavity for a threshold period of time and provide an alert when the container has been placed in the dispensing area or cavity for more than the threshold period of time.

For instance, a user may place a container in a dispensing area or cavity, become distracted prior to dispensing content into the container placed in the dispensing area or cavity, and inadvertently leave the container in the dispensing area or cavity for more than a threshold period of time. In this situation, the system 500 may provide an alert message indicating that a container has been positioned in the dispensing area or cavity for more than a threshold period of time. This type of alert message may be beneficial to remind the user that the container remains in the cavity and that the user has not completed a dispensing operation. Providing the alert also may assist the user in identifying a risky situation and taking action to correct the risky situation.

In some examples, the system 500 may consider other operations related to the dispenser, in addition to the time from when the container was placed in the dispensing area or cavity, in determining whether to provide an alert. For instance, if the dispenser is being controlled to dispense content, the system 500 may determine not to provide an alert, even though the time from when the container was placed in the dispensing area or cavity exceeds the threshold amount of time. In addition, the system 500 may detect whether a user is in an area proximate to the dispenser in determining whether to provide an alert. When a user is detected as standing in front of the dispenser, the system 500 may determine not to provide an alert, even though the time from when the container was placed in the dispensing area or cavity exceeds the threshold amount of time. When a user is not detected as standing in front of the dispenser, the system 500 may provide an alert when the time from when the container was placed in the dispensing area or cavity exceeds the threshold amount of time.

Figure 32:
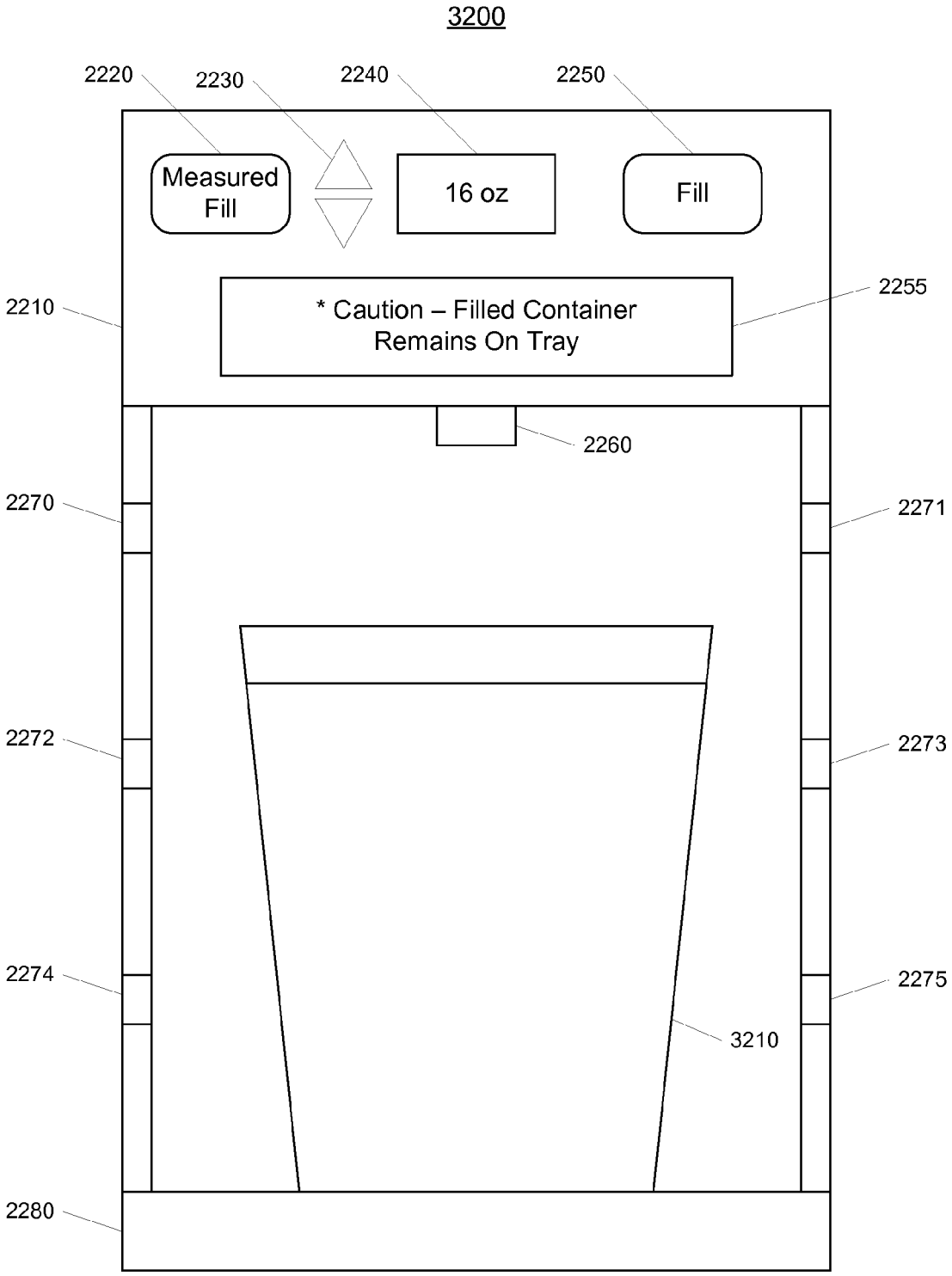

FIG. 32 illustrates an example of providing an alert when a filled container remains in a dispensing area for more than a threshold period of time. As shown in FIG. 32, a user has used a dispenser 3200 to perform a measured fill dispensing operation to fill a container 3210 with sixteen ounces of water. After the measured fill dispensing operation completed, the user has left the container 3210 resting on the container support 2280 (e.g., the user became preoccupied with another matter and inadvertently forgot that the container 3210 remained resting on the container support 2280). The dispenser 3200 detects that the container 3210 remains on the container support 2280 using sensor data from the sensors 2270 to 2275 and also detects that a threshold period of time has passed since the end of the measured fill dispensing operation. In response to detecting that the container 3210 remains on the container support 2280 and that a threshold period of time has passed since the end of the measured fill dispensing operation, the dispenser 3200 updates the display 2255 to display an alert message that indicates that a filled container remains on the container support 2280. The dispenser 3200 also may provide an audible alert to alert a user to the presence of a filled container in the dispensing area. The audible alert and the alert message may assist a user in remembering that the filled container remains in the dispensing area and needs to be removed.

Figure 33:
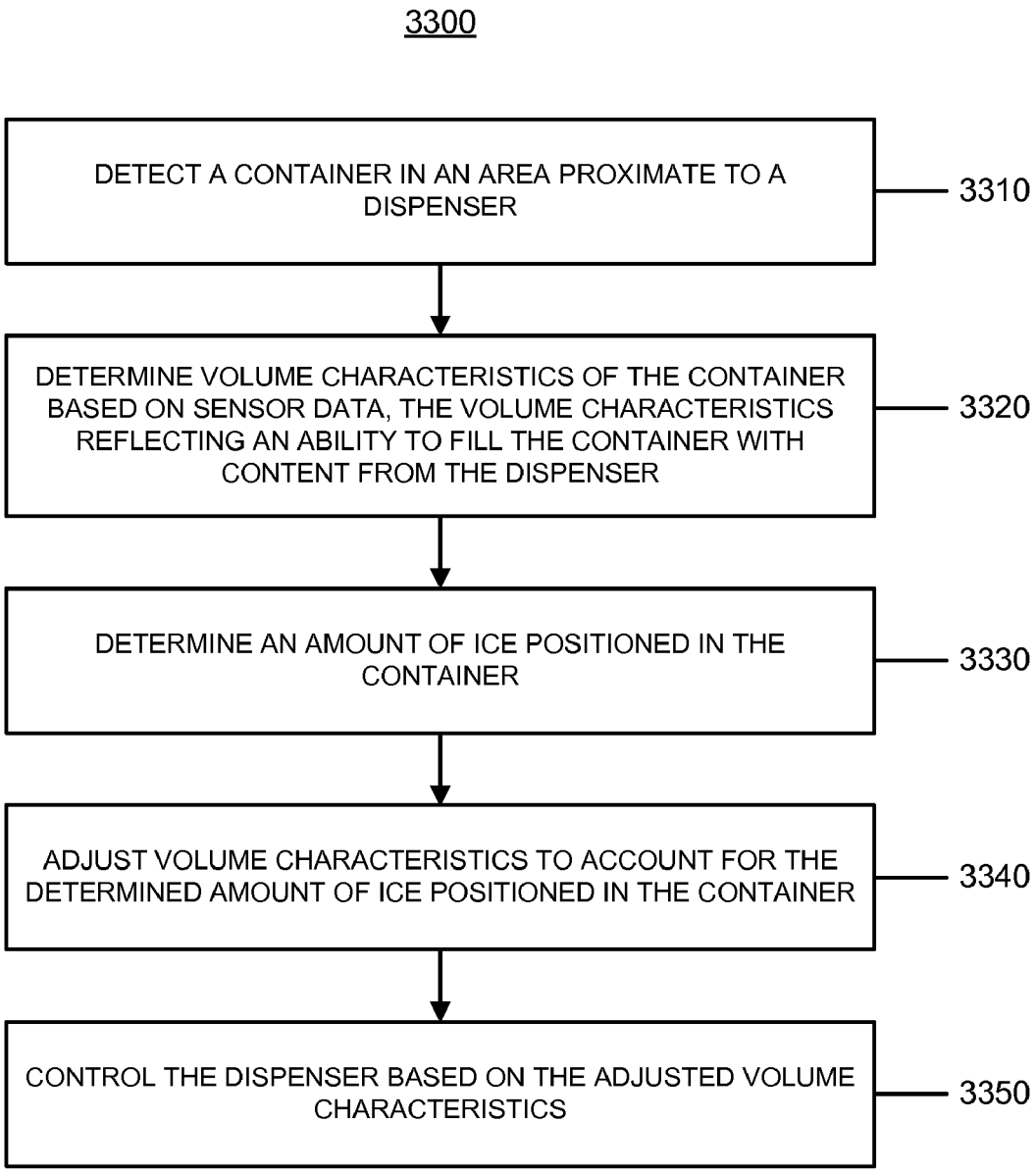

FIG. 33 illustrates an example of a process 3300 for accounting for a determined amount of ice positioned in a container when controlling a dispenser based on volume characteristics of the container. The operations of the process 3300 are described generally as being performed by the system 500. The operations of the process 3300 may be performed by any combination of the components of the system 500. In some implementations, operations of the process 3300 may be performed by one or more processors included in one or more electronic devices.

The system 500 detects a container in an area proximate to a dispenser (3310). The system 500 may detect a container in an area proximate to a dispenser using techniques similar to those discussed above with respect to numeral 1910 in FIG. 19 and reference numeral 2110 in FIG. 21.

The system 500 determines volume characteristics of the container based on sensor data (3320). The volume characteristics reflect an ability to fill the container with content from the dispenser. The system 500 may determine volume characteristics of the container based on sensor data using techniques similar to those discussed above with respect to reference numeral 2120 in FIG. 21.

The system 500 determines an amount of ice positioned in the container (3330). For instance, the system 500 may detect a recent ice dispensing operation (e.g., an ice dispensing operation that occurred within a relatively short period of time prior to the determination) and determine an amount of ice dispensed in the recent ice dispensing operation. The system 500 may determine the amount of ice dispensed in the recent ice dispensing operation using a sensor that measures an amount of ice being dispensed from a dispenser. The system 500 also may determine the amount of ice dispensed in the recent ice dispensing operation by measuring a length of time of the ice dispensing operation and determining the amount of ice typically dispensed from the dispenser in an ice dispensing operation of the measured amount of time. The system 500 further may determine the amount of ice dispensed in the recent ice dispensing operation by identifying a particular quantity of ice a user set to be dispensed when the dispenser is capable of setting a particular quantity of ice. Because the ice was dispensed in a recent ice dispensing operation, the system 500 may infer that the ice was dispensed into a container currently detected in an area proximate to the dispenser.

In some implementations, the system 500 may track movement of a container after a recent ice dispensing operation to determine whether the container that is in the area proximate to the dispenser is the container that was filled with ice during the ice dispensing operation. For instance, in these implementations, the system 500 may monitor movement of the container subsequent to the ice dispensing operation and determine whether the container that was filled with ice is the same container currently detected in the dispensing area. The system 500 may analyze tracked movement of the container (if any) after the end of the ice dispensing operation and, based on the analysis, may determine whether the container was removed from the dispensing area after the ice dispensing operation. The system 500 may determine that the container was removed from the dispensing area and is not the container currently detected in the area proximate to the dispenser when the system 500 detects absence of a container in the dispensing area at a point after the end of the ice dispensing operation or when the system 500 tracks movement of the container from a position within the dispensing area to a position outside of the dispensing area. The system 500 may determine that the container has not been removed from the dispensing area when the system 500 detects presence of a container in the dispensing area at all points of monitoring for a container after the end of the dispensing operation. The system 500 also may detect that the container has not been removed from the dispensing area and is the container currently detected in the area proximate to the dispenser when the system 500 detects that the container has remained stationary after the dispensing operation based on tracked movements of the container (e.g., when ice and water are dispensed through the same outlet or outlets positioned at the same location). When the dispenser has separate outlets for ice and water dispensing, the system 500 may track movement of the container between the two, separate outlets in determining whether the container in the area proximate to the dispenser is the container that was filled with ice during the ice dispensing operation.

The system 500 also may determine an amount of ice positioned in the container by sensing the amount of ice positioned in the container. For example, when the container is positioned on a container support that includes a scale configured to weigh objects placed on the container support, the system 500 may estimate an amount of ice positioned in the container based on a measurement taken by the scale. In this example, the system 500 may weigh the container prior to an ice dispensing operation, weigh the container after the ice dispensing operation, and determine the amount of ice within the container by comparing the measured weight of the container prior to the ice dispensing operation and the measured weight of the container after the ice dispensing operation. The system 500 may calibrate or zero out the scale when a container is placed on the scale and directly measure a weight of ice dispensed into the container after the calibration.

The system 500 may use other types of sensors to sense the amount of ice positioned in the container. When the system 500 includes sensors that have corresponding emission and detection elements (e.g., an infrared emitter and an infrared receiver pair), the system 500 may sense the amount of ice positioned in the container using the sensors. For instance, because the ice positioned in the container attenuates a signal emitted from an emission element, the detection element may detect a reduced signal in portions of the container in which ice is positioned as compared to other portions of the container. When the container is clear plastic or glass, a signal emitted from an emission element may pass through portions of the container without ice with relatively little attenuation and a signal emitted from an emission element may pass through portions of the container with ice with relatively great attenuation. The system 500 may have sensors arranged throughout a dispensing area and detect the difference in attenuation in portions of the container with ice and portions of the container without ice. Based on the detected difference, the system 500 may sense an amount of ice that is positioned within the container.

The system 500 adjusts the determined volume characteristics of the container to account for the determined amount of ice positioned in the container (3340). For example, the system 500 may subtract the volume of ice positioned in the container from a volume of content the container is capable of receiving as reflected in the determined volume characteristics. In this example, the system 500 may estimate the volume of ice positioned in the container and reduce the volume the container is capable of receiving accordingly.

The system 500 controls the dispenser based on the adjusted volume characteristics (3350). The system 500 may control the dispenser based on the adjusted volume characteristics using any of the techniques described above for controlling a dispenser based on determined volume characteristics. For instance, the system 500 may prevent the dispenser from dispensing a volume of content that is greater than a volume of content that the adjusted volume characteristics indicate the container as being capable of receiving. The system 500 also may set a recommended quantity of content to dispense as a volume of content that the adjusted volume characteristics indicate the container as being capable of receiving.

Figure 34:
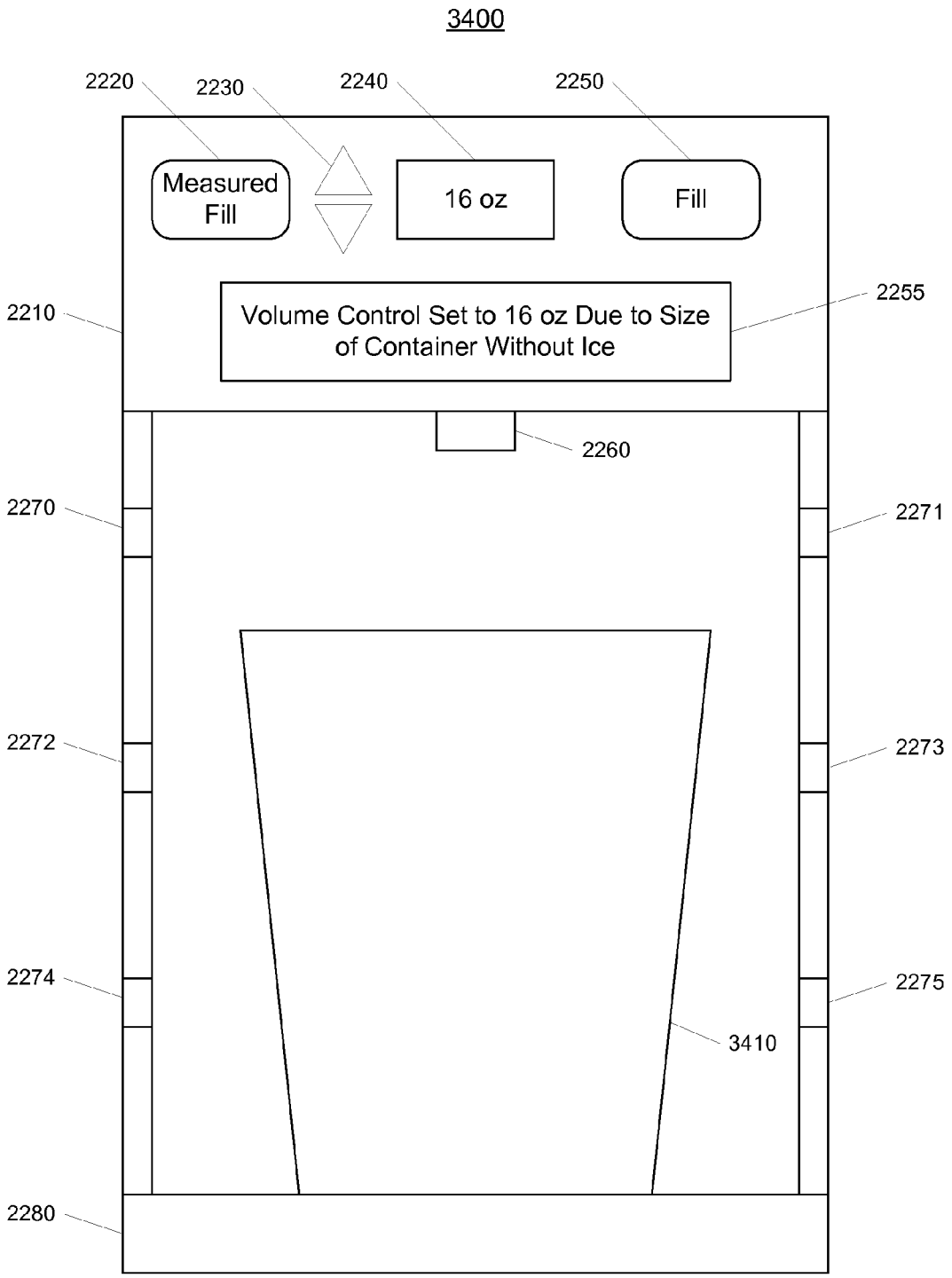
Figure 35:
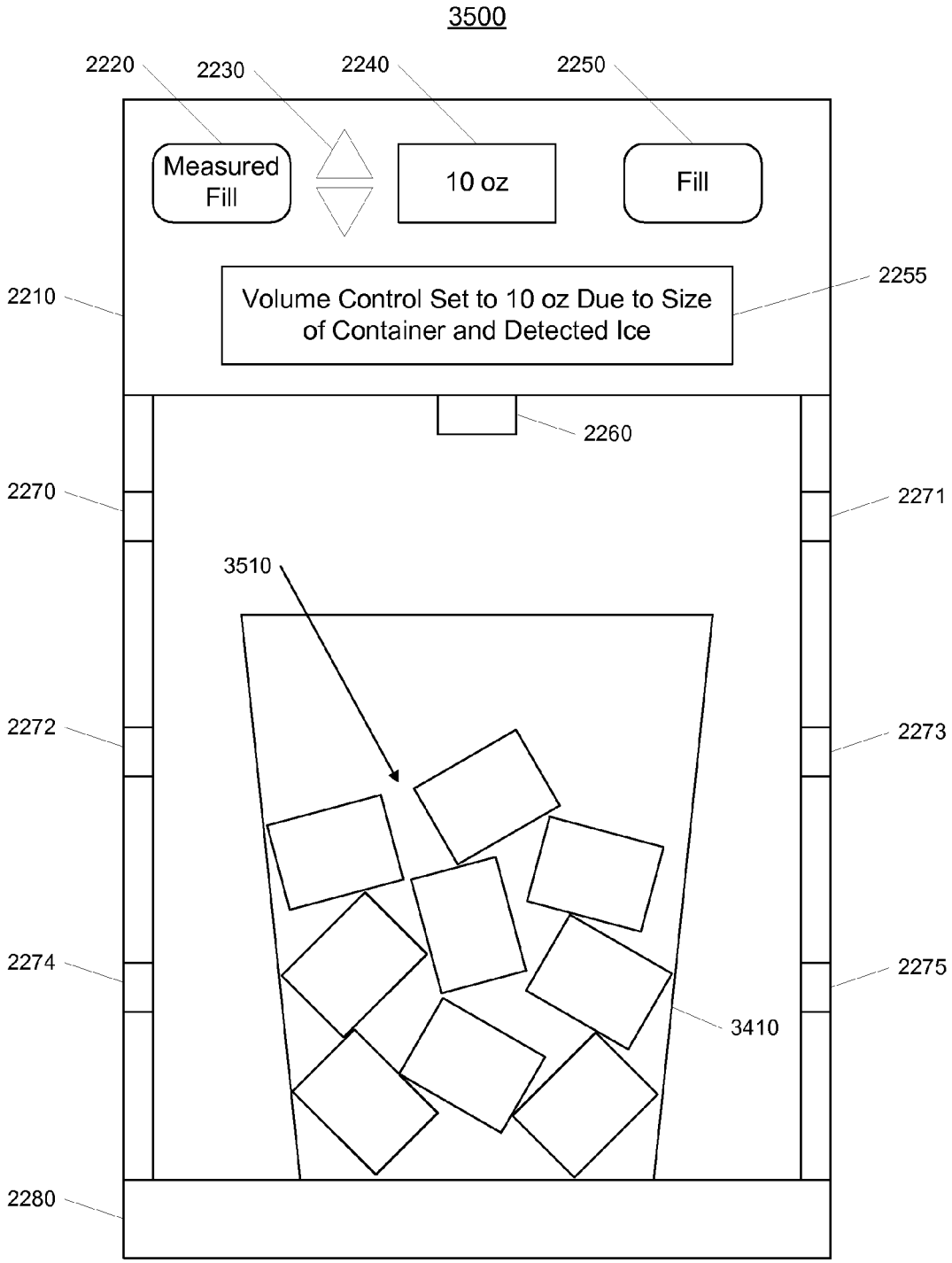

FIGS. 34-35 illustrate examples of accounting for a determined amount of ice positioned in a container when controlling a dispenser based on volume characteristics of the container. FIG. 34 illustrates an example of a dispenser 3400 in which a container 3410 has been placed under the outlet 2260 without any ice positioned within the container 3410. In this example, the dispenser 3400 determines volume characteristics of the container 3410 as being capable of receiving sixteen ounces of content and also determines that the container 3410 does not have ice positioned in the container 3410. Because the dispenser 3400 determines that the container 3410 does not have ice positioned within the container 3410, the dispenser 3400 controls operation based on the determination that the container 3410 is capable of receiving sixteen ounces of content. For instance, the dispenser 3400 may automatically, without human intervention, set a recommended quantity of content to sixteen ounces and display the recommended quantity of content (e.g., sixteen ounces) in the display 2240. The dispenser 3400 also may update the display 2255 to provide a status message that indicates that volume control has been set to sixteen ounces due to the size of the container without ice.

FIG. 35 illustrates an example of a dispenser 3500 in which the container 3410 has been placed under the outlet 2260 with ice 3510 positioned within the container 3410. In this example, the dispenser 3500 determines volume characteristics of the container 3410 as being capable of receiving sixteen ounces of content. The dispenser 3500 also determines an amount of ice positioned within the container 3410. For instance, the dispenser 3500 may estimate that the ice 3510 positioned within the container corresponds to a volume of six ounces. Because the dispenser 3500 determines that the container 3410 is capable of receiving sixteen ounces of content, but already has ice 3510 that corresponds to six ounces of content positioned within the container 3410, the dispenser 3500 adjusts the volume of content the container 3410 is capable of receiving from sixteen ounces to ten ounces and controls operation of the dispenser 3500 based on the determination that the container 3410 is capable of receiving ten ounces of content when the container is filled with the ice 3510. For instance, the dispenser 3500 may automatically, without human intervention, set a recommended quantity of content to ten ounces and display the recommended quantity of content (e.g., ten ounces) in the display 2240. The dispenser 3500 also may update the display 2255 to provide a status message that indicates that volume control has been set to ten ounces due to the size of the container and detected ice within the container.

In some implementations, the dispenser arrangements shown throughout the description may be included in an appliance, such as a refrigerator. In these implementations, the dispenser arrangements may be attached to a freezing compartment door of the refrigerator or a refrigerating compartment of the refrigerator. In this regard, the dispenser arrangements may be provided in any type of refrigerator, whether the refrigerator be a side-by-side refrigerator in which a freezing compartment and refrigerating compartment are positioned next to one another, a top mount refrigerator in which the freezing compartment is positioned above the refrigerating compartment, or a bottom mount refrigerator in which the freezing compartment is positioned below the refrigerating compartment. Each compartment of the refrigerator may include one or multiple doors and the dispenser arrangements may be provided in any of the doors. The dispenser arrangements also may be provided in a refrigerator that does not include a freezing compartment or in a freezer that does not include a refrigerating compartment. The dispenser arrangements may be standalone appliances, whose primary function is to dispense content.

It will be understood that various modifications may be made. For example, other useful implementations still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a dispenser that includes an outlet and that is configured to dispense content through the outlet and along an output flow path;

a user input device that is configured to receive a first user input command to set a particular quantity of content to dispense from the dispenser;

a detection unit configured to detect the first user input command to set the particular quantity of content to dispense from the dispenser;

an optical system that is configured to, in response to detecting the first user input command to set the particular quantity of content to dispense from the dispenser, direct light along at least a portion of the output flow path of the dispenser to assist a user in positioning a container to receive content dispensed along the output flow path; and a controller configured to monitor for a second user input command to cause the dispenser to dispense the particular quantity of content, the controller being configured to, in response to detecting the second user input command, control the dispenser to dispense the particular quantity of content and control the optical system to turn off the light, and the controller being configured to, in response to detecting at least a threshold amount of time has passed after receipt of the first user input command without receipt of the second user input command, control the optical system to turn off the light.

2. The refrigerator of claim 1:

wherein the detection unit includes at least one sensor and is configured to sense an object in an area proximate to the dispenser based on output from the at least one sensor; and wherein the controller is configured to trigger the optical system to start directing light along at least the portion of the output flow path of the dispenser in response to the detection unit sensing the object in the area proximate to the dispenser.

3. The refrigerator of claim 1 wherein the detection unit is configured to detect a container in an area proximate to the dispenser and, in response to detecting the container in the area proximate to the dispenser, determine volume characteristics of the container based on sensor data, the volume characteristics reflecting an ability to fill the container with content from the dispenser, wherein the controller is configured to control the dispenser based on the determined volume characteristics of the container.

4. The refrigerator of claim 3 wherein the controller is configured to identify a volume of content that the container is capable of receiving based on the determined volume characteristics and control the dispenser based on the determined volume characteristics of the container by preventing the dispenser from dispensing, into the container, more than the identified volume of content that the container is capable of receiving.

5. The refrigerator of claim 3 wherein the controller is configured to identify a volume of content that the container is capable of receiving based on the determined volume characteristics and control the dispenser based on the determined volume characteristics of the container by setting a recommended quantity of content to dispense based on the identified volume of content and enabling a user to dispense the recommended quantity of content or adjust the recommended quantity of content.

6. The refrigerator of claim 5, wherein setting the recommended quantity of content to dispense based on the identified volume of content comprises:

automatically, without user input, setting the recommended quantity of content to dispense to a quantity that is less than the identified volume of content that the container is capable of receiving; and controlling display of the recommended quantity of content with an indication that the recommended quantity of content was automatically set based on the volume of content that the container is capable of receiving.

7. The refrigerator of claim 1 wherein the detection unit is configured to detect a container in an area proximate to the dispenser and, in response to detecting the container in the area proximate to the dispenser, determine volume characteristics of the container based on sensor data, the volume characteristics reflecting an ability to fill the container with content from the dispenser, further comprising:

an ice detection unit configured to determine an amount of ice positioned in the container and adjust the determined volume characteristics to account for the determined amount of ice positioned in the container;

wherein the controller is configured to control the dispenser based on the adjusted volume characteristics of the container.

8. The refrigerator of claim 7:

wherein the ice detection unit is configured to adjust the determined volume characteristics to account for the determined amount of ice positioned in the container by subtracting a volume of ice positioned in the container from a volume of content the container is capable of receiving as reflected in the determined volume characteristics; and wherein the controller is configured to control the dispenser based on the adjusted volume characteristics of the container by:

automatically, without user input, setting a recommended quantity of content to dispense based on a result of subtracting the volume of ice positioned in the container from the volume of content the container is capable of receiving as reflected in the determined volume characteristics; and controlling display of the recommended quantity of content with an indication that the recommended quantity of content accounts for ice positioned in the container.

9. The refrigerator of claim 1:

wherein the detection unit is configured to sense an object in an area proximate to the outlet of the dispenser based on output from the at least one sensor; and wherein the controller is configured to trigger the optical system to start directing light along at least the portion of the output flow path of the dispenser in response to the detection unit sensing the object in the area proximate to the outlet of the dispenser.

10. The refrigerator of claim 1:

wherein the detection unit is configured to sense an object entering a dispensing area or cavity defined by an outlet housing and a container support based on output from the at least one sensor; and wherein the controller is configured to trigger the optical system to start directing light along at least the portion of the output flow path of the dispenser in response to the detection unit sensing the object entering the dispensing area or cavity defined by the outlet housing and the container support.

11. The refrigerator of claim 1:

wherein the detection unit is configured to sense a container in a position in which at least a portion of the container is positioned directly under the outlet of the dispenser based on output from the at least one sensor; and wherein the controller is configured to trigger the optical system to start directing light along at least the portion of the output flow path of the dispenser in response to the detection unit sensing the container in the position in which at least the portion of the container is positioned directly under the outlet of the dispenser.

12. The refrigerator of claim 1:

wherein the detection unit is configured to sense a container being placed on a container support based on output from the at least one sensor; and wherein the controller is configured to trigger the optical system to start directing light along at least the portion of the output flow path of the dispenser in response to the detection unit sensing the container being placed on the container support.

13. The refrigerator of claim 1:

wherein the detection unit is configured to sense an object within a threshold distance of the outlet of the dispenser based on output from the at least one sensor; and wherein the controller is configured to trigger the optical system to start directing light along at least the portion of the output flow path of the dispenser in response to the detection unit sensing the object within the threshold distance of the outlet of the dispenser.

14. The refrigerator of claim 1:

wherein the detection unit is configured to sense an object within a particular radius extending from the outlet of the dispenser based on output from the at least one sensor; and wherein the controller is configured to trigger the optical system to start directing light along at least the portion of the output flow path of the dispenser in response to the detection unit sensing the object within the particular radius extending from the outlet of the dispenser.

15. The refrigerator of claim 1:

wherein the at least one sensor includes a first sensor part and a second sensor part that are configured to sense when an object is positioned between the first sensor part and the second sensor part, the first sensor part and the second sensor part being located in the area proximate to the dispenser;

wherein the detection unit is configured to sense the object between the first sensor part and the second sensor part based on output from at least one of the first sensor part and the second sensor part; and wherein the controller is configured to trigger the optical system to start directing light along at least the portion of the output flow path of the dispenser in response to the detection unit sensing the object between the first sensor part and the second sensor part.

16. The refrigerator of claim 15:

wherein the first sensor part and the second sensor part are located at an entrance of a dispensing area or cavity defined by an outlet housing and a container support;

wherein the detection unit is configured to sense an object at the entrance of the dispensing area or cavity defined by the outlet housing and the container support based on output from at least one of the first sensor part and the second sensor part; and wherein the controller is configured to trigger the optical system to start directing light along at least the portion of the output flow path of the dispenser in response to the detection unit sensing the object at the entrance of the dispensing area or cavity defined by the outlet housing and the container support.

17. The refrigerator of claim 1:

wherein the detection unit is configured to detect motion of the object located in the area proximate to the dispenser and determine whether the detected motion of the object is toward or away from the dispenser; and wherein the controller is configured to control the optical system differently depending on whether the detection unit determines that the detected motion of the object is toward the dispenser or away from the dispenser.

18. The refrigerator of claim 1 wherein the controller is configured to:

monitor for user input to cause the dispenser to dispense content after triggering the optical system to start directing light along at least the portion of the output flow path of the dispenser;

determine whether user input to cause the dispenser to dispense content is received based on the monitoring;

control the dispenser to dispense content and control the optical system to stop directing light along at least the portion of the output flow path of the dispenser based on a determination that user input to cause the dispenser to dispense content has been received;

determine whether a threshold period of time has passed since the detection unit sensed the object in the area proximate to the dispenser based on a determination that user input to cause the dispenser to dispense content has not been received;

control the optical system to stop directing light along at least the portion of the output flow path of the dispenser based on a determination that the threshold period of time has passed since the detection unit sensed the object in the area proximate to the dispenser; and continue to monitor for user input to cause the dispenser to dispense content while the optical system directs light along at least the portion of the output flow path of the dispenser based on a determination that the threshold period of time has not passed since the detection unit sensed the object in the area proximate to the dispenser.

19. A refrigerator comprising:

a dispenser that includes an outlet and that is configured to dispense content through the outlet and along an output flow path;

a user input device that is configured to receive a user input command to dispense content from the dispenser;

a detection unit configured to detect the user input command to dispense content from the dispenser;

an optical system that is configured to direct light along at least a portion of the output flow path of the dispenser to assist a user in positioning a container to receive content dispensed along the output flow path; and a controller configured to delay dispensing of content from the dispenser in response to the user input command, control the optical system to direct light along at least a portion of the output flow path while delaying the dispensing of content, measure a time from when the user input command to dispense content was detected, compare the measured time from when the user input command to dispense content was detected to a threshold time, determine when the measured time reaches the threshold time based on the comparison, and control the dispenser to dispense content in response to a determination that the measured time has reached the threshold time.

20. A refrigerator comprising:

a dispenser that includes an outlet and that is configured to dispense content through the outlet and along an output flow path;

a detection unit configured to detect presence of a container being filled by the dispenser;

an optical system that is configured to direct light along at least a portion of the output flow path of the dispenser to assist a user in positioning a container to receive content dispensed along the output flow path; and a controller that is configured to detect an end of a dispensing operation, that is configured to monitor movement of the container subsequent to the end of the dispensing operation, that is configured to determine whether the container has been removed from a dispensing area based on the monitoring, that is configured to discontinue monitoring in response to a determination that the container has been removed from the dispensing area, that is configured to determine whether a threshold period of time has passed after detecting the end of the dispensing operation in response to a determination that the container has not been removed from the dispensing area, and that is configured to provide an alert indicating that a filled container remains in the dispensing area in response to a determination that the threshold period of time has passed after detecting the end of the dispensing operation.

* * * * *